US012757975B2

(12) United States Patent
Antony et al.

(10) Patent No.: US 12,757,975 B2
(45) Date of Patent: Oct. 13, 2026

(54) ARTICLE OF FOOTWEAR INCLUDING A SOLE STRUCTURE

(71) Applicant: Nike, Inc., Beaverton, OR (US)

(72) Inventors: Merrily J. Antony, Portland, OR (US); Travis J. Berrian, Portland, OR (US); Wesley K. Chan, Portland, OR (US); Bryan P. Conrad, Lake Oswego, OR (US); Zachary M. Elder, Portland, OR (US); Wade Flanagan, Portland, OR (US); Paul Hooper, Vancouver, WA (US); Samuel S. Kass, Portland, OR (US); Benjamin J. Monfils, Portland, OR (US); Nikita A. Troufanov, Portland, OR (US); Jeremy W. Webber, Portland, OR (US)

(73) Assignee: NIKE, INC., Beaverton, OR (US)

( * ) Notice: Subject to any disclaimer, the term of this patent is extended or adjusted under 35 U.S.C. 154(b) by 0 days.

(21) Appl. No.: 18/605,050

(22) Filed: Mar. 14, 2024

(65) Prior Publication Data

US 2024/0306767 A1 Sep. 19, 2024

Related U.S. Application Data

(60) Provisional application No. 63/559,432, filed on Feb. 29, 2024, provisional application No. 63/584,745, (Continued)

(51) Int. Cl.
*A43B 13/20* (2006.01)
*A43B 13/14* (2006.01)

(52) U.S. Cl.
CPC ..... *A43B 13/20* (2013.01); *A43B 13/145* (2013.01); *A43B 13/206* (2013.01)

(58) Field of Classification Search
CPC ..... A43B 13/20; A43B 13/206; A43B 13/145
See application file for complete search history.

(56) References Cited

U.S. PATENT DOCUMENTS 2,183,277 A * 12/1939 Heilhecker ..... A43B 13/36 36/15
4,160,331 A 7/1979 Bell
(Continued)

FOREIGN PATENT DOCUMENTS

EP 0456434 A2 * 11/1991 ..... A43B 17/03
KR 101018393 B1 * 3/2011
(Continued)

OTHER PUBLICATIONS

International Search Report and Written Opinion, PCT/US2024/019941, mailed Jun. 11, 2024. (8 pages).

*Primary Examiner* — Megan E Lynch
(74) *Attorney, Agent, or Firm* — Bookoff McAndrews, PLLC

(57) ABSTRACT

An article of footwear having an anterior end and a posterior end opposite the anterior end, and an upper including an interior void partially defined by a ground-facing surface. The ground-facing surface has a plurality of supports; a sole including a first surface facing the interior void and a second, ground-facing surface, the sole disposed within the interior void of the upper, wherein the sole includes one or more extensions extending from the second surface, wherein each of the one or more extensions is received by a respective one of the plurality of supports; and a cushioning element extending from the posterior end toward the anterior end, the cushioning element including a first surface facing the upper and a second, ground-facing surface, wherein the one or more supports and one or more extensions engage the first surface of the cushioning element.

17 Claims, 35 Drawing Sheets

Related U.S. Application Data filed on Sep. 22, 2023, provisional application No. 63/490,520, filed on Mar. 15, 2023.

(56) References Cited

U.S. PATENT DOCUMENTS 4,377,042 A * 3/1983 Bauer ..... A43B 13/36 36/15
4,420,894 A * 12/1983 Glassman ..... A43B 13/36 36/12
4,774,774 A * 10/1988 Allen, Jr. ..... A43B 13/20 36/28
5,123,180 A 6/1992 Nannig et al.
5,729,918 A 3/1998 Smets
5,741,568 A * 4/1998 Rudy ..... A43B 7/144 442/244
5,794,359 A * 8/1998 Jenkins ..... A43B 13/20 36/28
5,832,630 A * 11/1998 Potter ..... A43B 17/035 36/43
6,082,025 A 7/2000 Bonk et al.
6,158,149 A * 12/2000 Rudy ..... A43B 13/206 36/71
6,258,421 B1 * 7/2001 Potter ..... A43B 13/206 36/43
6,754,981 B1 * 6/2004 Edwards ..... A43B 7/1445 36/3 R
11,317,676 B2 5/2022 Peyton et al.
11,612,211 B2 3/2023 Christensen et al.
2005/0132608 A1 6/2005 Dojan et al.
2005/0133968 A1 6/2005 Foxen et al.
2006/0048413 A1 * 3/2006 Sokolowski ..... A43B 23/0215 36/45
2006/0096125 A1 5/2006 Yen
2006/0130368 A1 * 6/2006 Morgan ..... A43B 13/145 36/59 R
2006/0137221 A1 6/2006 Dojan
2006/0156579 A1 7/2006 Hoffer et al.
2009/0151093 A1 6/2009 Schindler et al.
2009/0151196 A1 6/2009 Schindler et al.
2011/0314699 A1 * 12/2011 Byrne ..... A43B 7/149 36/43
2013/0227857 A1 * 9/2013 Schindler ..... A43B 13/20 36/83
2014/0283413 A1 9/2014 Christensen et al.
2015/0033577 A1 2/2015 Dahl et al.
2015/0272271 A1 10/2015 Campos, II et al.
2015/0327624 A1 11/2015 Grott et al.
2016/0007676 A1 1/2016 Leimer et al.
2016/0192737 A1 * 7/2016 Campos, II ..... A43B 13/223 12/146 B
2016/0324264 A1 * 11/2016 Johnson ..... A43B 3/244
2017/0035146 A1 2/2017 Peyton
2017/0119096 A1 5/2017 Greene
2017/0265565 A1 9/2017 Connell et al.
2018/0338577 A1 * 11/2018 Elder ..... A43B 3/0057
2018/0338578 A1 * 11/2018 Elder ..... A43B 5/00
2019/0365036 A1 * 12/2019 Meeker ..... A43B 3/0052
2020/0128913 A1 4/2020 Loverin
2020/0154826 A1 5/2020 Case et al.
2020/0359742 A1 11/2020 Campos et al.
2021/0145117 A1 5/2021 Montross et al.
2021/0195996 A1 7/2021 Chan et al.
2021/0345729 A1 11/2021 Chan
2021/0368920 A1 12/2021 Elder et al.
2021/0368923 A1 12/2021 Seid
2022/0378148 A1 12/2022 Eldem et al.
2022/0378150 A1 * 12/2022 Brooks ..... A43B 13/206
2022/0395058 A1 * 12/2022 Petrie ..... A43B 13/203
2023/0041247 A1 2/2023 Bandyopadhyay et al.
2023/0042037 A1 2/2023 Bandyopadhyay et al.
2023/0043845 A1 2/2023 Bandyopadhyay et al.
2023/0354959 A1 11/2023 Andrews et al.
2024/0000184 A1 * 1/2024 Takashima ..... A43B 13/146
2024/0180291 A1 6/2024 Andrews et al.
2024/0306766 A1 9/2024 Antony et al.
2024/0306767 A1 9/2024 Antony et al.
2024/0306768 A1 9/2024 Antony et al.
2024/0306769 A1 9/2024 Antony et al.
2024/0373979 A1 11/2024 Bates et al.
2024/0398060 A1 12/2024 Cobb

FOREIGN PATENT DOCUMENTS

KR 101089139 B1 * 12/2011 ..... A43B 7/08
WO 9520332 A1 8/1995
WO WO-2006095996 A1 * 9/2006 ..... B29D 35/081

* cited by examiner

ARTICLE OF FOOTWEAR INCLUDING A SOLE STRUCTURE

CROSS-REFERENCE TO RELATED APPLICATIONS

This application claims the benefit of U.S. Provisional Application Ser. No. 63/490,520, filed Mar. 15, 2023; U.S. Provisional Application Ser. No. 63/584,745, filed Sep. 22, 2023; and U.S. Provisional Application Ser. No. 63/559,432, filed Feb. 29, 2024, and which are hereby incorporated by reference in their entirety.

TECHNICAL FIELD

The present disclosure relates generally to sole structures for articles of footwear, and more particularly, to sole structures incorporating an upper bonded to a cushioning element.

BACKGROUND

This section provides background information related to the present disclosure which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner. Some or all of these elements may be replaced or removed as desired to improve weight and other desired characteristics.

Midsoles employing fluid-filled bladders typically include a bladder formed from two barrier layers of polymer material that are sealed or bonded together. The fluid-filled bladders are pressurized with a fluid such as air, and may incorporate tensile members within the bladder to retain the shape of the bladder when compressed resiliently under applied loads, such as during athletic movements. Generally, bladders are designed with an emphasis on balancing support for the foot and cushioning characteristics that relate to responsiveness as the bladder resiliently compresses under an applied load.

BRIEF DESCRIPTION OF THE DRAWINGS

Corresponding reference numerals indicate corresponding parts throughout the several views of the drawings.

DETAILED DESCRIPTION

Figure 1:
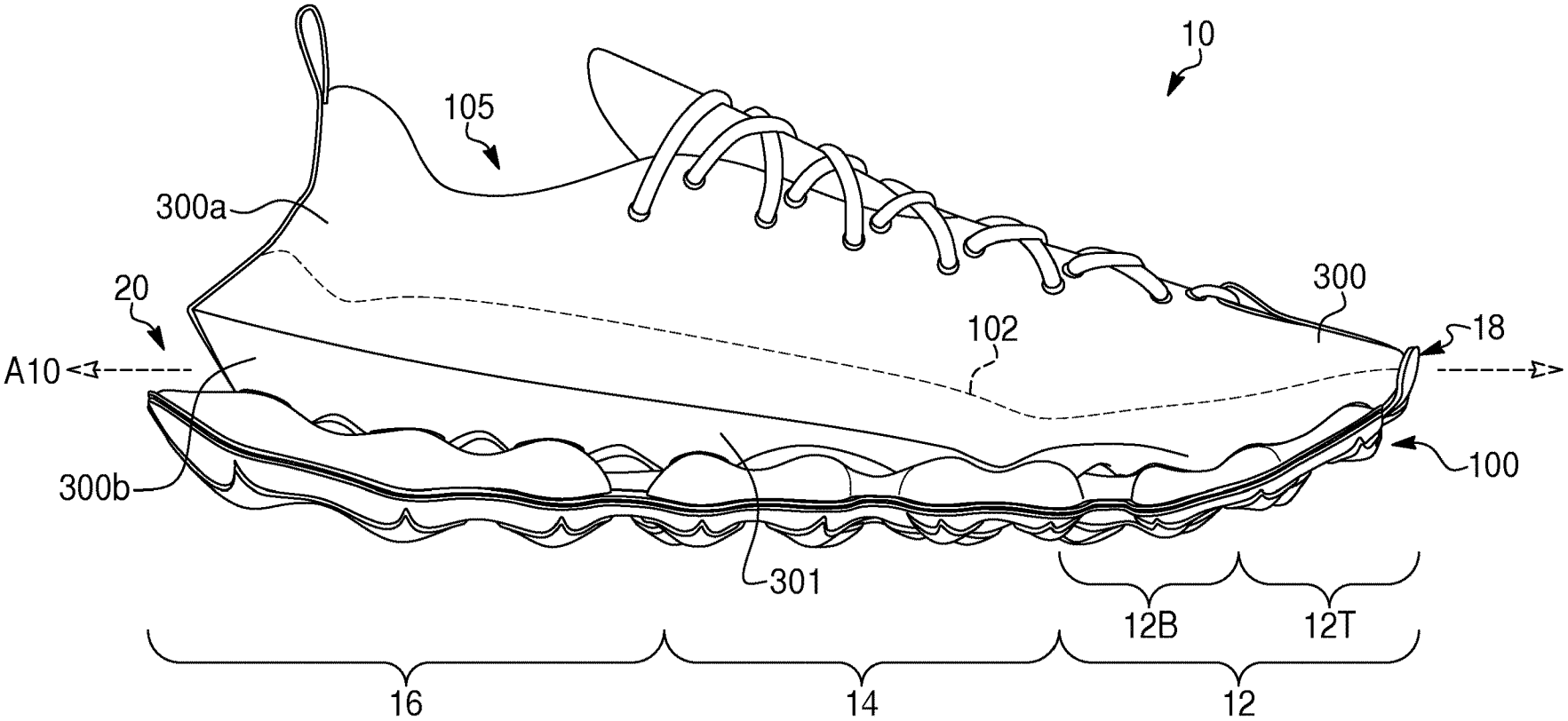
FIG. 1 is a side view of an article of footwear.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or; layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

When an element or layer includes a directional and/or spatial term (e.g., top, bottom, medial, lateral, etc.), the directional and/or spatial term is used relative to a user's foot anatomy when the article of footwear is being worn by a user. The user is considered to be standing on a flat, level surface.

In the discussion that follows, terms "about," "approximately," "substantially," and the like, when used in describing a numerical value, denote a variation of +/−10% of that value, unless specified otherwise.

Figure 2:
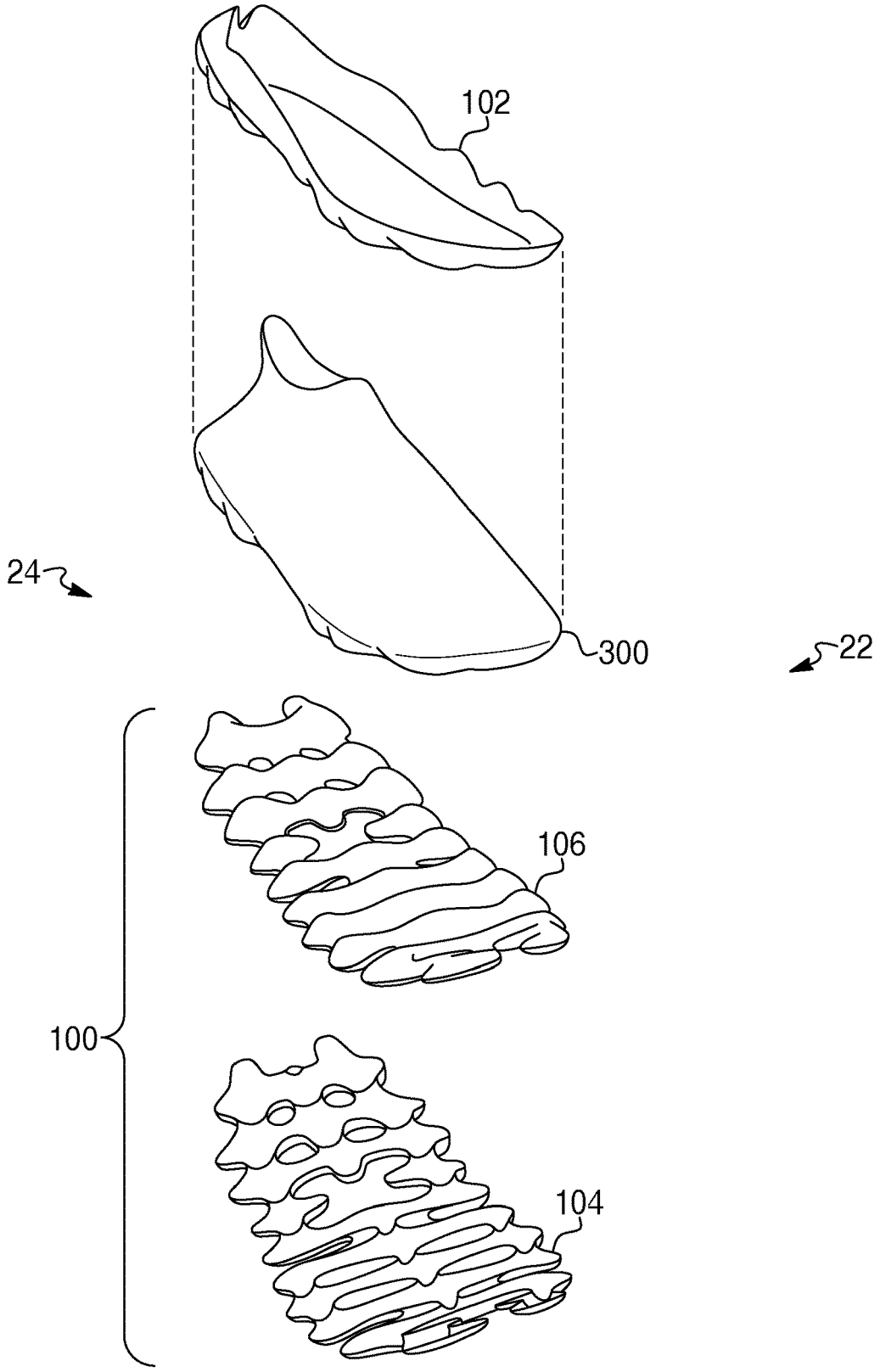
FIG. 2 is an exploded perspective view of the article of footwear of FIG. 1.

Referring to FIG. 1, an article of footwear 10 includes a sole structure 100 and an upper 300 attached to the sole structure 100. The article of footwear 10 may be divided into one or more regions. The regions may include a forefoot region 12, a mid-foot region 14, and a heel region 16. The forefoot region 12 may be further described as including a toe portion 12T corresponding to the phalanges of the foot, and a ball portion 12B corresponding to a metatarsophalangeal (MTP) joint. The mid-foot region 14 may correspond with an arch area of the foot, and the heel region 16 may correspond with rear portions of the foot, including a calcaneus bone. The footwear 10 may further include an anterior end 18 associated with a forward-most point of the forefoot region 12, and a posterior end 20 corresponding to a rearward-most point of the heel region 16. A longitudinal axis A10 of the footwear 10 extends along a length of the footwear 10 from the anterior end 18 to the posterior end 20, and generally divides the footwear 10 into a medial side 22 and a lateral side 24, as shown in FIG. 2. Accordingly, the medial side 22 and the lateral side 24 respectively correspond with opposite sides of the footwear 10 and extend through the regions 12, 14, 16.

In examples of articles of footwear 10, the upper 300 may include a textile skin or vamp 300*a* and a strobel 300*b*, which may be integrally manufactured together as a single unit or as separate units joined together (e.g., with stitching and/or adhesive bonding) to define an interior void 105. The strobel 300*b* may include a bottom surface 301 opposing the sole structure 100, and an opposing top surface (not shown) defining a footbed of the interior void 105. The vamp 300*a* of the upper 300 may be comprised of a material suitable for being formed in a thin layer while providing durability, water resistance, a desired level of comfort, and a desired level of protection for a foot of a user of the article of footwear 10, such as meshes, textiles, foams, leather, and synthetic leather.

In the shown example, the article of footwear 10 also includes a drop-in midsole 102 disposed on the top surface, which is contoured to conform to a profile of the bottom surface (e.g., plantar) of a user's foot. In other examples of articles of footwear 10, the upper 300 may incorporate alternative insoles or sockliners that are disposed on the top surface of the strobel 300*b* and reside within the interior void 105 of the upper 300 to receive a plantar surface of the foot to enhance the comfort of the article of footwear 10. As further shown in FIG. 1, the upper 300 defines an ankle opening 103 disposed in the heel region 16, which provides access to the interior void 105. For example, the ankle opening 103 can receive a foot to secure the foot within the interior void 105 and facilitate entry and removal of the foot from and into the interior void 105.

In an exemplary embodiment, the midsole 102 may be removably disposed within the interior void 105 of the upper 300 and received by the ankle opening 103. In other words, the midsole 102 may not be permanently attached within the upper 300. The midsole 102 may serve as a foot-receiving portion of the article of footwear 10. In alternative examples, the midsole 102 may be cemented, glued, or otherwise permanently affixed inside the upper 300 (e.g., defining a footbed of the interior void 105). In some examples, the midsole 102 may also include an upper facing surface 603 that is textured. Further description of the midsole 102 is provided below with respect to FIGS. 6A and 6B.

With reference to FIGS. 1 and 2, the sole structure 100 includes a cushioning element (airsole) 106 configured to provide cushioning characteristics to the sole structure 100, and an outsole 104 configured to provide a ground-contacting or ground-facing surface 30*a* (shown in FIG. 9) of the article of footwear 10. As will be described in greater detail below, the cushioning element 106 is coupled directly to the upper 300 such that no other structural elements of the article of footwear 10 are disposed between the upper 300 and the cushioning element 106 (e.g., no other cushioning components, such as foam midsoles). In some embodiments, the cushioning element 106 and the upper 300 are coupled directly to each other with an adhesive compound and/or tie layer that is disposed between the upper 300 and the cushioning element 106.

When coupled directly to the cushioning element 106, the strobel 300*b* of the upper 300 may have an average thickness that is substantially less than an average thickness of the midsole 102 and less than an average thickness of the cushioning element 106. As used herein, the average thicknesses (e.g., for the midsole 102, the strobel 103*b*, and the cushioning element 106) are measured at an intersection of its central longitudinal and lateral-medial axes. Specifically, the average thicknesses (e.g., for the midsole 102, the strobel 103*b*, and the cushioning element 106) may be measured at an intersection of its central longitudinal and lateral-medial axes disposed centrally within the mid-foot region 14 of the article of footwear 10.

The midsole 102 may have an average thickness ranging between about 7 millimeters to about 60 millimeters, between about 15 millimeters and 50 millimeters, or between about 25 millimeters and 40 millimeters. In an example, the midsole 102 may have an average thickness of about 35 millimeters. The cushioning element 106 may have an average thickness ranging between about 7 millimeters to about 40 millimeters, between about 10 millimeters and about 30 millimeters, or between about 15 millimeters and about 25 millimeters. In an example, the cushioning element 106 may have an average thickness of about 20 millimeters. The strobel 300*b* of the upper 300 may have a thickness ranging between about 0.05 millimeters to about 2 millimeters, between about 0.1 millimeters and about 1 millimeter, or between about 0.3 millimeters and about 0.7 millimeters. In an example, the upper 300 may have an average thickness of about 0.5 millimeters.

As will be described in greater detail below, any of the midsole 102, the cushioning element 106, and/or the strobel 300*b* may have a variable thickness or a substantially uniform thickness depending on a desired level of cushioning, support, and comfort. Additionally, the configuration of the article of footwear 10 shown in FIGS. 1 and 2 with the midsole 102, strobel 300*b*, and the cushioning element 106 reduces the overall weight of the article of footwear 10 as well as providing improved sustainability for the article of footwear 10. By reducing the number of parts that need to be strictly adhered to one another, the amount of adhesive and material required to form the article of footwear 10 is reduced. Additionally, individual components (e.g., the midsole 102) may be replaced during the lifetime of the article of footwear 10 instead of needing to discard the entirety of the article of footwear 10 at end of life.

Figure 3A:
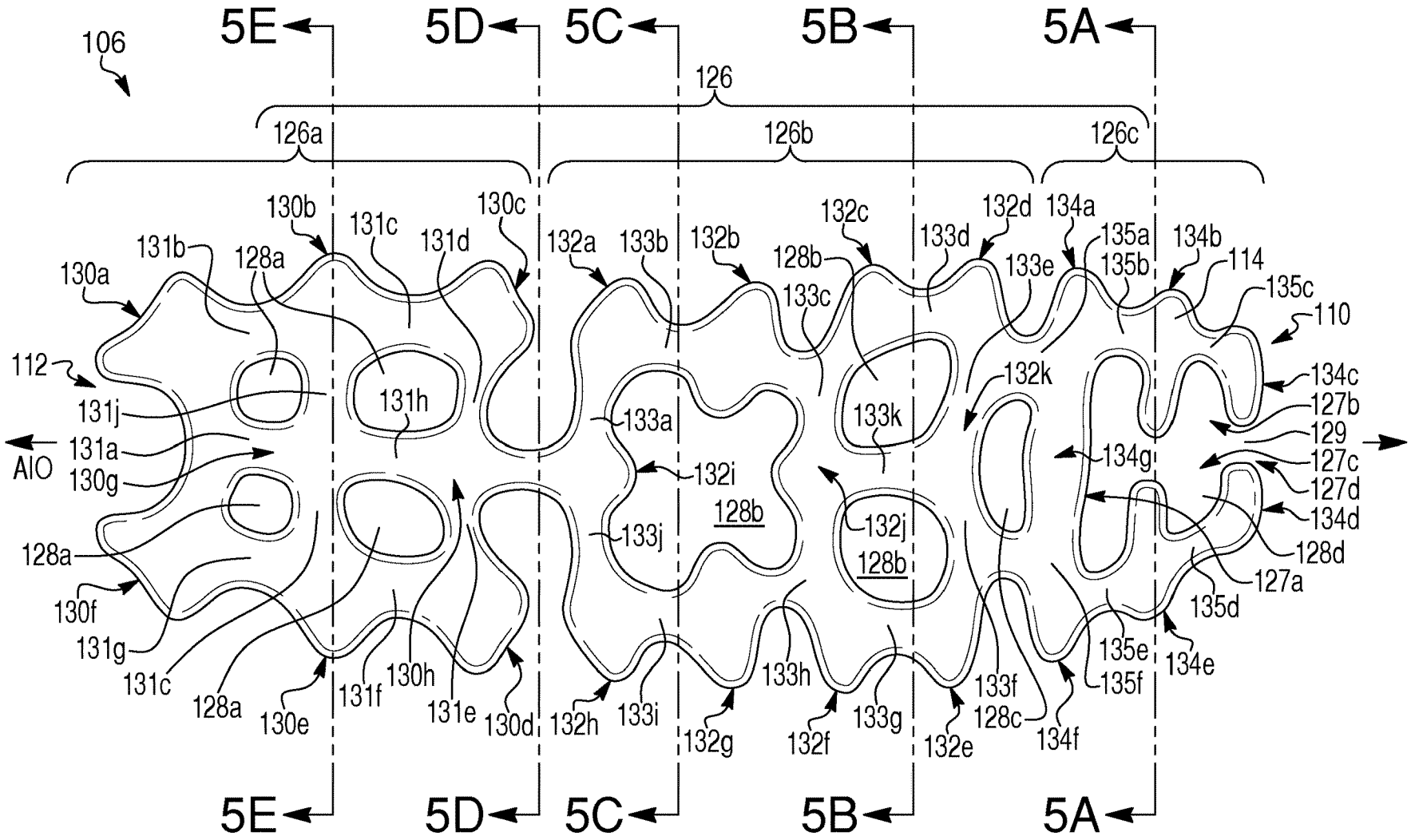
FIG. 3A is a top view of a cushioning element of the article of footwear of FIG. 1.

With reference to FIG. 3A, the longitudinal axis A10 of the cushioning element 106 extends from a first end 110 in the forefoot region 12 to a second end 112 in the heel region 16. The cushioning element 106 includes a first (top) surface 114 and a second (bottom) surface 116 (shown below in FIG. 3B) formed on an opposite side of the cushioning element 106 from the first surface 114. The first surface 114 is coupled with the bottom surface 301 of the strobel 300*b* (of the upper 300), as will be described in greater detail below.

The cushioning element 106 is a fluid-filled cushioning element, such as an airbag or bladder. As shown, the cushioning element 106 includes an opposing pair of films 216, 218 (film 218 shown below in FIG. 3C). In some embodiments, one or both of the opposing pair of films 216, 218 may comprise a barrier film. For example, one or both of the opposing pair of films 216, 218 comprises a multilayer film, such as disclosed in U.S. Pat. No. 6,082,025 and U.S. Publication No. 2023/0043845. In the illustrated example, interior, opposing surfaces (i.e. facing each other) of the films 216, 218 are joined together at discrete locations to form a peripheral seam 122 (shown in FIG. 3C). The upper and lower films 216, 218 are spaced apart from each other between the peripheral seam 122 to define a plurality of bulbs 126.

The plurality of bulbs 126 including a first set of bulbs 126*a*, a second set of bulbs 126*b*, and a third set of bulbs 126*c*. In an example, the first set of bulbs 126*a* have a substantially bulbous shape defined by a generally ovate central portion with one or more round-edged protrusions extending outwardly from the central portion. In the example, some of the second set of bulbs 126*b* may have a shape that is a rounded triangle while others of the second set of bulbs 126*b* have the substantially bulbous shape. In the example, some of the third set of bulbs 126*c* have a substantially elongate shape. Each respective bulb of the set of bulbs 126*a*, 126*b*, and 126*c* is shown to have a respective length and plan-view profile that are distinct from the lengths and profiles of others of the set of bulbs 126*a*, 126*b*, and 126*c*. Additionally, in an example, a given bulb may have a length that is smaller than a width of the given bulb. The length extending substantially parallel to the axis A10. The width extending substantially perpendicular to the axis A10. In such an example, the width of the given bulb extends past an outer periphery of the upper 300.

In some examples, one or more bulbs of the sets of bulbs 126*a*, 126*b*, and 126*c* has a width that is larger than its length. In some examples, only some of the bulbs 126 of the article of footwear 10 may have this configuration. For example, bulbs 126 disposed in the heel region 16 may have a configuration of width greater than length, while those bulbs 126 in the midfoot region 14 and forefoot region 12 do not. In other examples bulbs 126 disposed in the midfoot region 14 may have a configuration of width greater than length, while those bulbs 126 in the heel region 16 and forefoot region 12 do not. In other examples bulbs 126 disposed in the forefoot region 12 may have a configuration of width greater than length, while those bulbs 126 in the heel region 16 and midfoot region 14 do not. In still other examples, all of the bulbs of the sets of bulbs 126*a*, 126*b*, and 126*c* has a width that is larger than its length. In some other examples, the one or more sets of bulbs 126*a*, 126*b*, and 126*c* have a uniform length and width.

The sets of bulbs 126*a*, 126*b*, and 126*c* may provide added stability to the article of footwear 10 due to the respective widths of the bulbs extending past an outer periphery of the upper 300. In other words, the sets of bulbs 126*a*, 126*b*, and 126*c* may provide medial and lateral stability platforms for the article of footwear 10. Additionally, the bulbs 126 including the configuration of having a length being shorter than a width may provide added flexibility to the article of footwear 10. In other embodiments, the plurality of bulbs 126 may include other shapes such as ovular, round, tubular, square, or the like such that the bulbs 126 provide a desired form of cushioning to the article of footwear 10.

The first set of bulbs 126*a* includes a first bulb 130*a*, a second bulb 130*b*, a third bulb 130*c*, a fourth bulb 130*d*, a fifth bulb 130*e*, a sixth bulb 130*f*, a first central bulb 130*g*, and a second central bulb 130*h*. Bridge portions 131*a*, 131*b*, 131*c*, 131*d*, 131*e*, 131*f*, 131*g*, 131*h*, 131*i*, and 131*j* interconnect respective first set of bulbs 126*a*.

In an example, bridge portion 131*a* is disposed between and interconnects first bulb 130*a*, sixth bulb 130*f*, and first central bulb 130*g*. Bridge portion 131*b* is disposed between and interconnects first bulb 130*a* and second bulb 130*b*. Bridge portion 131*c* is disposed between and interconnects second bulb 130*b* and third bulb 130*c*. Bridge portion 131*d* is disposed between and interconnects third bulb 130*c* and second central bulb 130*h*. Bridge portion 131*e* is disposed between and interconnects second central bulb 130*h* and fourth bulb 130*d*. Bridge portion 131*f* is disposed between and interconnects fourth bulb 130*d* and fifth bulb 130*e*. Bridge portion 131*g* is disposed between and interconnects fifth bulb 130*e* and sixth bulb 130*f*. Bridge portion 131*h* is disposed between and interconnects second central bulb 130*h* and first central bulb 130*g*. Bridge portion 131*i* is disposed between and interconnects first central bulb 130*g* and fifth bulb 130*e*. Bridge portion 131*h* is disposed between and interconnects first central bulb 130*g* and second bulb 130*b*. In the example, each of bridge portions 131*a*-131*h* is a portion of the upper film 216 extending between respective bulbs of the first set of bulbs 126*a*.

The second set of bulbs 126*b* includes a first bulb 132*a*, a second bulb 132*b*, a third bulb 132*c*, a fourth bulb 132*d*, a fifth bulb 132*e*, a sixth bulb 132*f*, a seventh bulb 132*g*, an eighth bulb 132*h*, a first central bulb 132*i*, a second central bulb 132*j*, and a third central bulb 132*k*. Bridge portions 133*a*, 133*b*, 133*c*, 133*d*, 133*e*, 133*f*, 133*g*, 133*h*, 133*i*, 133*j*, and 133*k* interconnect respective second set of bulbs 126*b*.

In an example, bridge portion 133*a* is disposed between and interconnects first bulb 132*a* and first central bulb 132*i*. Bridge portion 133*b* is disposed between and interconnects first bulb 132*a* and second bulb 132*b*. Bridge portion 133*c* is disposed between and interconnects second bulb 132*b*, second central bulb 132*j*, and third bulb 132*c*. Bridge portion 133*d* is disposed between and interconnects third bulb 132*c* and fourth bulb 132*d*. Bridge portion 133*e* is disposed between and interconnects fourth bulb 132*d* and third central bulb 132*k*. Bridge portion 133*f* is disposed between and interconnects third central bulb 132*k* and fifth bulb 132*e*. Bridge portion 133*g* is disposed between and interconnects fifth bulb 132*e* and sixth bulb 132*f*. Bridge portion 133*h* is disposed between and interconnects sixth bulb 132*f*, second central bulb 132*j*, and seventh bulb 132*g*. Bridge portion 133*i* is disposed between and interconnects seventh bulb 132*g* and eighth bulb 132*h*. Bridge portion 133*j* is disposed between and interconnects eighth bulb 132*h* and first central bulb 132*i*. Bridge portion 133*k* is disposed between and interconnects second central bulb 132*j* and third central bulb 132*k*. In the example, each of bridge portions 133*a*-133*k* is a portion of the upper film 216 extending between respective bulbs of the second set of bulbs 126*b*.

The third set of bulbs 126*c* includes a first bulb 134*a*, a second bulb 134*b*, a third bulb 134*c*, a fourth bulb 134*d*, a fifth bulb 134*e*, a sixth bulb 134*f*, and a central bulb 134*g*. Bridge portions 135*a*, 135*b*, 135*c*, 135*d*, 135*e*, and 135*f*, interconnect respective third set of bulbs 126*c*.

In an example, bridge portion 135*a* is disposed between and interconnects first bulb 134*a* and central bulb 134*g*. Bridge portion 135*b* is disposed between and interconnects first bulb 134*a* and second bulb 134*b*. Bridge portion 135*c* is disposed between and interconnects second bulb 134*b* and third bulb 134*c*. Bridge portion 135*d* is disposed between and interconnects fourth bulb 134*d* and fifth bulb 134*e*. Bridge portion 135*e* is disposed between and interconnects fifth bulb 134*e* and sixth bulb 134*f*. Bridge portion 135*f* is disposed between and interconnects sixth bulb 134*f* and central bulb 134*g*. In the example, each of bridge portions 135*a*-135*f* is a portion of the upper film 216 extending between respective bulbs of the third set of bulbs 126*c*.

Each of the respective bulbs 120*a*-120*h*, 132*a*-132*k*, and 134*a*-134*k* has a variable cross-sectional area so as to taper from a midpoint of the respective lobe respective bulbs 120*a*-120*h*, 132*a*-132*k*, and 134*a*-134*k* to the ends of the respective lobes respective bulbs 120*a*-120*h*, 132*a*-132*k*, and 134*a*-134*k*. For example, each of the lobes respective bulbs 120*a*-120*h*, 132*a*-132*k*, and 134*a*-134*k* includes a first end having a first cross-sectional area, a second end opposite the first end having a second cross-sectional area, and an intermediate portion disposed between the first end and the second end and having a third cross-sectional area that is greater than the first cross-sectional area and the second cross-sectional area. The first end is disposed at an outermost portion of a respective bulb 120*a*-120*h*, 132*a*-132*k*, and 134*a*-134*k*. The second end is disposed at an innermost portion of a respective bulb 120*a*-120*h*, 132*a*-132*k*, and 134*a*-134*k*. Accordingly, each of the respective bulbs 120*a*-120*h*, 132*a*-132*k*, and 134*a*-134*k* tapers towards the respective first end and second end from the intermediate portion so as to define a plurality of valleys and pockets, as is further described below. Each pocket and valley alternate with the respective bulbs along the length of the cushioning element 106.

One or more openings (coined areas) are disposed between respective bulbs of a given set of bulbs. The one or more openings are portions of the cushioning element 106 in which material has been removed or is otherwise absent from the cushioning element 106, and a void exists. A first plurality of openings 128*a* are disposed between respective bulbs of the first set of bulbs 126*a*. The first plurality of openings 128*a* are further disposed between respective bridge portions. As an example, an opening of the first plurality of openings 128*a* may be disposed between and surrounded by first bulb 130*a*, bridge portion 131*a*, second bulb 130*b*, bridge portion 131*b*, bridge portion 131*j*, first central bulb 130*g*, and bridge portion 131*a*. As an example, an opening of the first plurality of openings 128*a* may be disposed between and surrounded by second bulb 130*b*, bridge portion 131*c*, third bulb 130*c*, bridge portion 131*d*, second central bulb 130*h*, bridge portion 131*h*, first central bulb 130*g*, and bridge portion 131*j*. As an example, an opening of the first plurality of openings 128*a* may be disposed between and surrounded by first central bulb 130*g*, bridge portion 131*h*, second central bulb 130*h*, bridge portion 131*e*, fourth bulb 130*d*, bridge portion 131*f*, fifth bulb 130*e*, and bridge portion 131*i*. As an example, an opening of the first plurality of openings 128*a* may be disposed between and surrounded by first central bulb 130*g*, bridge portion 131*i*, fifth bulb 130*e*, bridge portion 131*g*, sixth bulb 130*f*, and bridge portion 131*a*.

Each opening of the first plurality of openings 128*a* may have a cross-sectional area that is variable. Each cross-sectional area of a respective opening of the first plurality of openings 128*a* may be different from one another. Each of the first plurality of openings 128*a* is shown having a distinct length and a distinct plan-view profile. As opposed to a polygonal profile bounded by straight edges, the plan-view profile of each of the first plurality of openings 128*a* is defined by curved and undulating borders, having a width that varies along the length of the respective openings 128*a*. For example, each of the first plurality of openings 128*a* may be rounded rectangles. Each of the first plurality of openings 128*a* may have a longer posterior-anterior dimension that is substantially parallel to axis A10 (shown in FIG. 1) than a lateral-medial dimension that is substantially perpendicular to axis A10 (shown in FIG. 1), or vice-versa. In alternate examples, the first plurality of openings 128*a* may have a uniform shape. In an example, one or more of the plurality of openings 128*a* are disposed more posterior to one or more of the other of the plurality of openings 128*a*. In the example, the opening(s) 128*a* that are disposed posterior to the other of the opening(s) 128*a* have a smaller posterior-anterior dimension parallel to the axis A10 (shown in FIG. 1).

A second plurality of openings 128*b* are disposed between respective bulbs of the second set of bulbs 126*b*. Each of the second plurality of openings 128*b* is shown having a distinct length and a distinct plan-view profile. As opposed to a polygonal profile bounded by straight edges, the plan-view profile of each of the second plurality of openings 128*b* is defined by curved and undulating borders, having a width that varies along the length of the respective openings 128*b*. The second plurality of openings 128*b* are further disposed between respective bridge portions. As an example, a first opening of the second plurality of openings 128*b* may be disposed between and surrounded by bridge portion 133*a*, first bulb 132*a*, bridge portion 133*b*, second bulb 132*b*, bridge portion 133*c*, second central bulb 132*j*, bridge portion 133*h*, seventh bulb 132*g*; bridge portion 133*i*, eighth bulb 132*h*, bridge portion 133*j*, and first central bulb 132*i*. As an example, a second opening of the second plurality of openings 128*b* may be disposed between and surrounded by bridge portion 133*c*, third bulb 132*c*, bridge portion 133*d*, fourth bulb 132*d*, bridge portion 133*e*, third central bulb 132*k*, bridge portion 133*k*, and second central bulb 132*j*. As an example, a third opening of the second plurality of openings 128*b* may be disposed between and surrounded by bridge portion 133*h*, second central bulb 132*j*, bridge portion 133*k*, third central bulb 132*k*, bridge portion 133*f*, fifth bulb 132*e*, bridge portion 133*g*, and sixth bulb 132*f*. Each opening of the second plurality of openings 128*b* may have a cross-sectional area from that is variable. Each cross-sectional area of a respective opening of the first plurality of openings 128*b* may be different from one another.

For example, the first opening of the second plurality of openings 128*b* may have a substantially rounded X-shape. The second and third openings 128*b* may be generally ovular in shape. The first opening of the second plurality of openings 128*b* may be disposed posterior to the second and third openings of the second plurality of openings 128*b*. The first opening of the second plurality of openings 128*b* may be disposed in the mid-foot region 14 such that the first opening of the second plurality of openings 128*b* rests at a midpoint of the sole structure 100. The first opening of the second plurality of openings 128*b* may be larger in area than both of the second and third openings of the second plurality of openings 128*b*. Each of the second and third openings of the plurality of openings 128*b* may have a longer posterior-anterior dimension that is substantially parallel to axis A10 (shown in FIG. 1) than a lateral-medial dimension that is substantially perpendicular to axis A10 (shown in FIG. 1), or vice-versa. In alternate examples, the second plurality of openings 128*b* may have a uniform shape.

A third opening 128*c* is disposed between the second set of bulbs 126*b* and the third set of bulbs 126*c*. The third opening 128*a* is further disposed between respective bridge portions. As an example, the third opening 128*c* is disposed between bridge portion 133*e*, bridge portion 135*a*, central bulb 134*g*, bridge portion 135*f*, bridge portion 133*f*, and third central bulb 132*k*. The third opening 128*c* may have a cross-sectional area that is variable. For example, the third opening 128*c* may have a crescent moon shape or a bean shape. In other words, the third opening 128*c* may be substantially semi-circular.

In an example, each of the openings 128*a*, 128*b*, and 128*c* is fully enclosed by their respective bulbs and bridge portions. As will be described below, a fourth opening 128*d* is only partially enclosed by respective bulbs and bridge portions.

The fourth opening 128*d* is disposed between respective bulbs of the third set of bulbs 126*c*. The fourth opening 128*d* is further disposed between respective bridge portions. The fourth opening 128*d* includes a mouth 129. The fourth opening 128*d* is disposed between and bounded at a posterior portion 127*a*, a medial portion 127*b*, and a lateral portion 127*c* by the third set of bulbs 126*c* and the respective bridge portions. An anterior portion 127*d* of the fourth opening 128*d* is disposed adjacent the anterior end 18. As an example, the posterior portion 127*a* of the fourth opening 128*d* is bounded by a portion of first bulb 134*a*, bridge portion 135*a*, central bulb 134*g*, bridge portion 135*f*, and a portion of sixth bulb 134*f*. The medial portion 127*b* of the fourth opening 128*d* is bounded by a portion of first bulb 134*a*, bridge portion 135*b*, second bulb 134*b*, bridge portion 135*c*, and third bulb 134*c*. The lateral portion 127*c* of the fourth opening 128*d* is bounded by fourth bulb 134*d*, bridge portion 135*d*, fifth bulb 134*e*, bridge portion 135*e*, and a portion of sixth bulb 134*f*. The mouth 129 is disposed between third bulb 134*c* and fourth bulb 134*d* of the third set of bulbs 126*c* at the anterior portion 127*d* of the fourth opening 128*d*. The mouth 129 is not fully enclosed and is open to the external environment at its anterior end 127*d*.

The fourth opening 128*d* may have a cross-sectional area that is variable. For example, the fourth opening 128*d* may have a substantially H-shape.

Figure 3B:
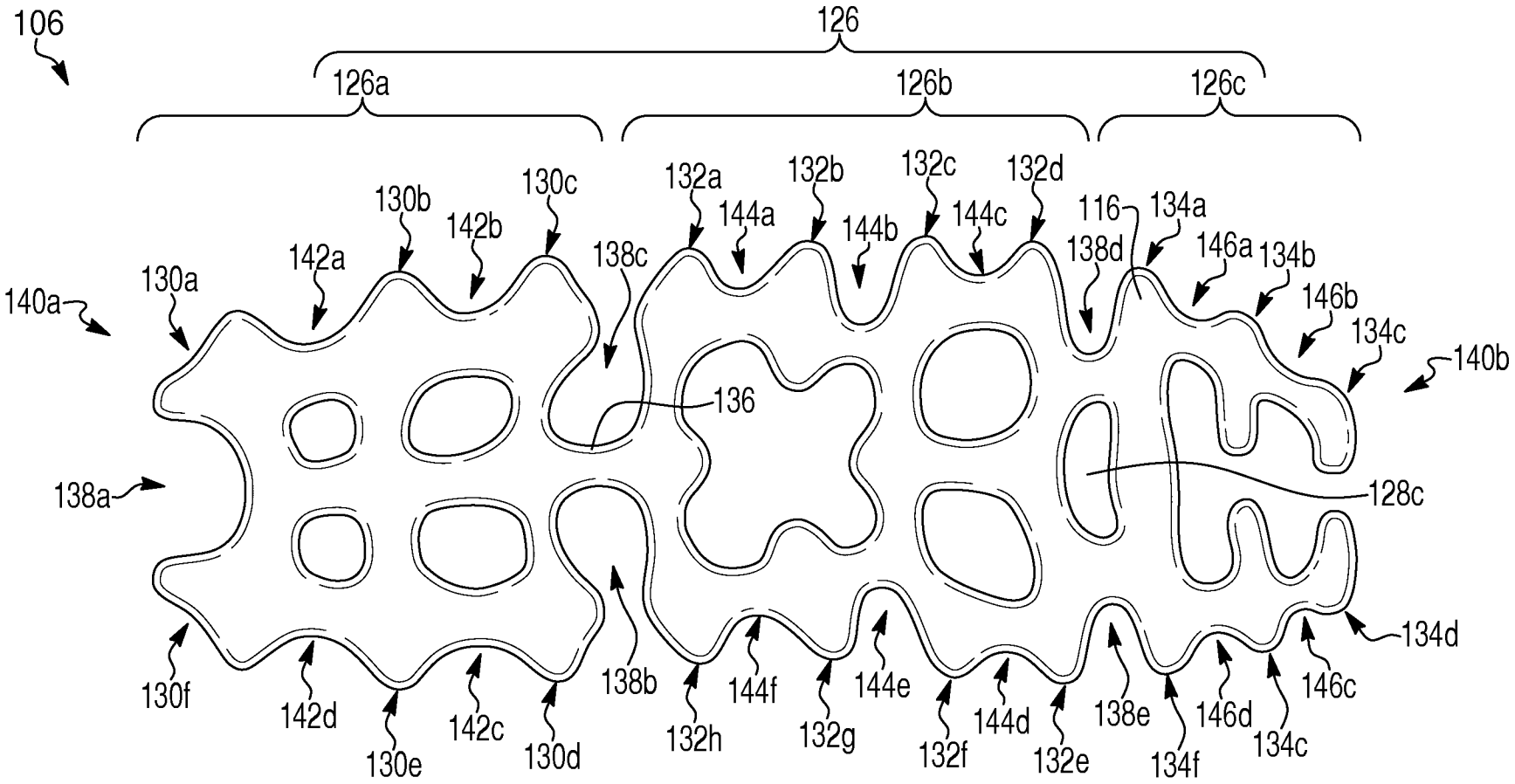
FIG. 3B is a bottom view of a cushioning element of the article of footwear of FIG. 1.

Referring to FIG. 3B, the second surface 116 is disposed facing a ground surface. The cushioning element 106 further includes a neck 136, and a plurality of pockets (138*a*, 138*b*, 138*c*, 138*d*, and 138*e*). The plurality of pockets may be an indentation in the outer circumference of the cushioning element 106 primarily between respective sets of bulbs 126*a*, 126*b*, and 126*c*. In an example, one of the plurality of pockets may be disposed between individual bulbs of the set of bulbs 126*a*. In an example, the plurality of pockets are concave when viewed from an external vantage point of the article of footwear 10. The plurality of pockets include a posterior pocket 138*a*, a first medial pocket 138*b*, a first lateral pocket 138*c*, a second lateral pocket 138*d*, and a second medial pocket 138*e*. The posterior pocket 138*a* is disposed at a posterior region 140*a* of the cushioning element 106. The posterior pocket 138*a* is disposed between first bulb 130*a* of the first set of bulbs 126*a* and sixth bulb 130*f* of the first set of bulbs 126*a*.

The first medial pocket 138*b* is disposed on a medial side of the cushioning element 106. The first medial pocket 138*b* is disposed between the third bulb 130*c* of the first set of bulbs 126*a* and the first bulb 132*a* of the second set of bulbs 126*b*. The first lateral pocket 138*c* is disposed on a lateral side of the cushioning element 106. The first lateral pocket 138*c* is disposed between the fourth bulb 130*d* of the first set of bulbs 126*a* and the eighth bulb 132*h* of the second set of bulbs 126*b*. The second lateral pocket 138*d* is disposed on the lateral side of the cushioning element 106. The second lateral pocket 138*d* is disposed between fourth bulb 132*d* of the second set of bulbs 126*b* and first bulb 134*a* of the third set of bulbs 126*c*. The second medial pocket 138*e* is disposed on the medial side of the cushioning element 106. The second medial pocket 138*e* is disposed between fifth bulb 132*e* of the second set of bulbs 126*a* and the sixth bulb 134*f* of the third set of bulbs 126*c*.

The neck 136 is disposed between the first set of bulbs 126*a* and the second set of bulbs 126*b*. The neck 136 connects the first set of bulbs 126*a* to the second set of bulbs 126*b*. The neck 136 has a reduced width in the lateral-medial direction perpendicular to the axis A10 (shown in FIG. 1) when compared to the width of the first set of bulbs 126*a* and the second set of bulbs 126*b* in the lateral-medial direction. A length of the neck 136 extending in the posterior-anterior direction parallel to the axis A10 (shown in FIG. 1) may be equal to a maximum length of the first medial pocket 138*b* and the first lateral pocket 138*c*. In some examples, the neck 136 allows for fluid communication between the set of bulbs 126*a* and the set of bulbs 126*b*. In some other examples, the neck 136 is pinched or otherwise closed off to prevent fluid communication between the set of bulbs 126*a* and the set of bulbs 126*b*. It is contemplated that the neck 136 may be pinched or otherwise throttled to allow for a desired amount of fluid flow between the set of bulbs 126*a* and the set of bulbs 126*b*.

With continued reference to FIG. 3B, the cushioning element 106 further includes valleys between adjacent pairs of bulbs. The one or more valleys may be an indentation in the outer circumference of the cushioning element 106 between respective bulbs of a given set of bulbs 126*a*, 126*b*, and 126*c*. In an example, the one or more valleys are concave when viewed from an external vantage point of the article of footwear 10. The cushioning element 106 includes valleys 142*a*, 142*b*, 142*c*, and 142*d* disposed between adjacent pairs of the first set of bulbs 126*a*. Valley 142*a* is disposed between first bulb 130*a* and second bulb 130*b*. Valley 142*b* is disposed between second bulb 130*b* and third bulb 130*c*. Valley 142*c* is disposed between fourth bulb 130*d* and fifth bulb 130*e*. Valley 142*d* is disposed between fifth bulb 130*e* and sixth bulb 130*f*.

In an example, each of bulbs 130*a-h*, 132*a-k*, and 134*a-g* and bridge portions 131*a-j*, 133*a-k*, and 135*a-f* may be in fluid communication with one another. In other examples, the bulbs 130*a-h*, 132*a-k*, and 134*a-g* and bridge portions 131*a-j*, 133*a-k*, and 135*a-f* may not be in fluid communication with one another and may be fluidly sealed off from one another.

The cushioning element 106 includes valleys 144*a*, 144*b*, 144*c*, 144*d*, 144*e*, and 144*f* disposed between adjacent pairs of the second set of bulbs 126*b*. Valley 144*a* is disposed between first bulb 132*a* and second bulb 132*b*. Valley 144*b* is disposed between second bulb 132*b* and third bulb 132*c*. Valley 144*c* is disposed between third bulb 132*c* and fourth bulb 132*d*. Valley 144*d* is disposed between fifth bulb 132*e* and sixth bulb 132*f*. Valley 144*e* is disposed between sixth bulb 132*f* and seventh bulb 132*g*. Valley 144*f* is disposed between seventh bulb 132*g* and eighth bulb 132*h*.

The cushioning element 106 includes valleys 146*a*, 146*b*, 146*c*, and 146*d* disposed between adjacent pairs of the third set of bulbs 126*c*. Valley 146*a* is disposed between first bulb 134*a* and second bulb 134*b*. Valley 146*b* is disposed between second bulb 134*b* and third bulb 134*c*. Valley 146*c* is disposed between fourth bulb 134*d* and fifth bulb 134*e*. Valley 146*d* is disposed between fifth bulb 134*e* and sixth bulb 134*f*.

Figure 3C:
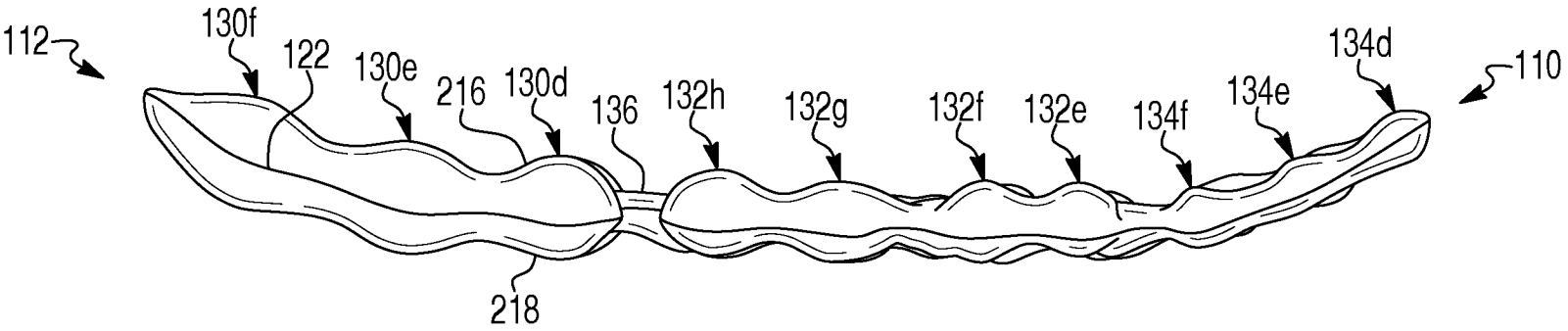
FIG. 3C is a side view of the cushioning element of the article of footwear of FIG. 1.

Referring to FIG. 3C, the peripheral seam 122 extends around the outer periphery of the cushioning element 106. The bulbs are formed of both barrier films 216, 218. Each of bulbs 130*a-h*, 132*a-k*, and 134*a-g* extend on both sides of peripheral seam 122. In other words, a top portion of the bulbs 130*a-h*, 132*a-k*, and 134*a-g* corresponds with the barrier film 216 and a bottom portion opposite the top portion of the bulbs 130*a-h*, 132*a-k*, and 134*a-g* corresponds with the barrier film 218. Additionally the bridge portions are formed of both barrier films 216, 218. Each of bridge portions 131*a-j*, 133*a-k*, and 135*a-f* extend on both sides of peripheral seam 122. In other words, a top portion of the bridge portions 131*a-j*, 133*a-k*, and 135*a-f* corresponds with barrier film 216 and a bottom portion opposite the top portion of the bridge portions 131*a-j*, 133*a-k*, and 135*a-f* corresponds with the barrier film 218.

In an example, each of the sets of bulbs 126*a*, 126, and 126*c* are fluidly isolated from one another. For example, some or all of the sets of bulbs 126*a*, 126, and 126*c* may be pressurized to different values. One or more of the sets of bulbs 126*a*, 126, and 126*c* may have a first pressure. One or more of the sets of bulbs 126*a*, 126, and 126*c* may have a second pressure different from the first pressure. One or more of the sets of bulbs 126*a*, 126, and 126*c* may have a third pressure different from the first pressure and the second pressure.

In one example, one or more groups of the sets of bulbs 126*a*, 126*b*, and 126*c* may have the same first pressure. Other groups of the sets of bulbs 126*a*, 126*b*, and 126*c* may have the same second pressure. For example, the sets of bulbs 126*a*, and 126*b* may have the same first pressure. The first pressure may be 15 PSI (103 kPA). The set of bulbs 126*c* may have a second pressure. The second pressure may be 5 PSI (34 kPA). In another example, the first pressure may be 5 PSI (34 kPA) and the second pressure may be 15 PSI (103 kPA). As another example, the set of bulbs 126*a* may have a first pressure, and the set of bulbs 126*b* and 126*c* may have a second pressure. The first pressure may be 15 PSI (103 kPA). The second pressure may be 5 PSI (34 kPA). In another example, the first pressure may be 5 PSI (34 kPA). The second pressure may be 15 PSI (103 kPA). In another example, the first pressure may be 15 PSI (103 kPA) and the second pressure may be 17 PSI (117 kPA).

In one example, the pressure values of each of the sets of bulbs 126*a*, 126*b*, and 126*c* are substantially similar or the same. In one example, the pressure values of each of the sets of bulbs 126*a*, 126*b*, and 126*c* vary from one set of bulbs to another. For example, when moving from the heel region 16 to the forefoot region 12, the pressure values decrease. In such an example, the pressure value of the set of bulbs 126*c* is less than the pressure value of the set of bulbs 126*b*, and the pressure value of the set of bulbs 126*a* is less than the pressure value of the sets of bulbs 126*b*.

As another example, when moving from the heel region 16 to forefoot 12, the pressure values may increase. In such an example, the pressure value of the set of bulbs 126*c* is greater than the pressure value of the set of bulbs 126*b*, and the pressure value of the set of bulbs 126*a* is greater than the pressure value of the sets of bulbs 126*b*. In an alternative example, an individual bulb may have its own pressure within a given set of bulbs 126*a*, 126*b*, and 126*c*.

The pressure value ranges from about atmospheric pressure to about 40 PSI (276 kPA). In an example, the first pressure of the first set of bulbs 126*a* is about 15 PSI (103 kPA), the second pressure of second set of bulbs 126*b* and the third pressure of the third set of bulbs 126*c* is about 5 PSI (34 kPA). Each of the set of bulbs 126*a*, 126*b*, and 126*c* may be in fluid communication with one another. In other examples, the set of bulbs 126*a*, 126*b*, and 126*c* may not be in fluid communication with one another. In some example, only some of the set of bulbs 126*a*, 126*b*, and 126*c* are in fluid communication with one another while others of the set of bulbs 126*a*, 126*b*, and 126*c* are not in fluid communication with one another.

Figure 4A:
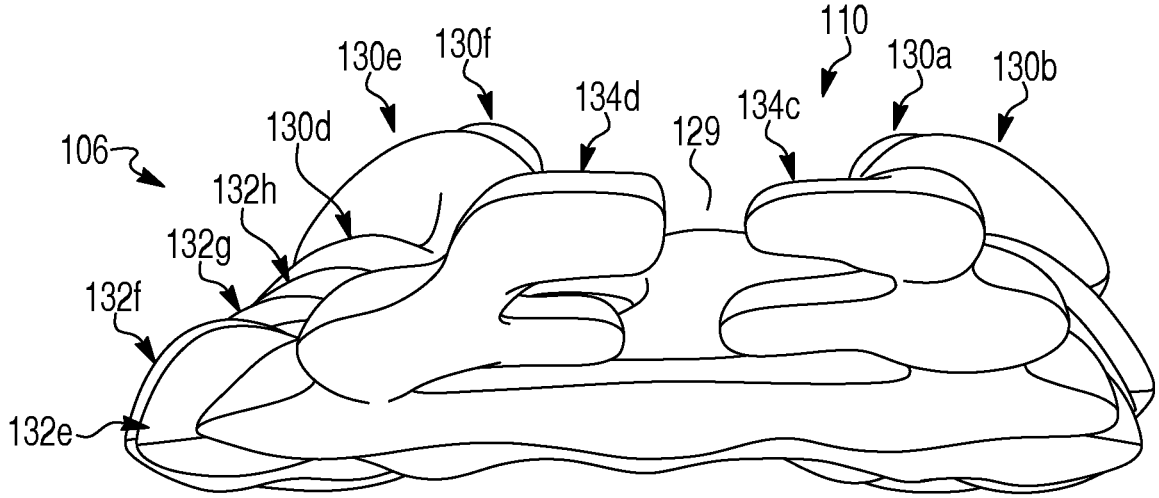
FIG. 4A is a front view of the cushioning element of the article of footwear of FIG. 1.
Figure 4B:
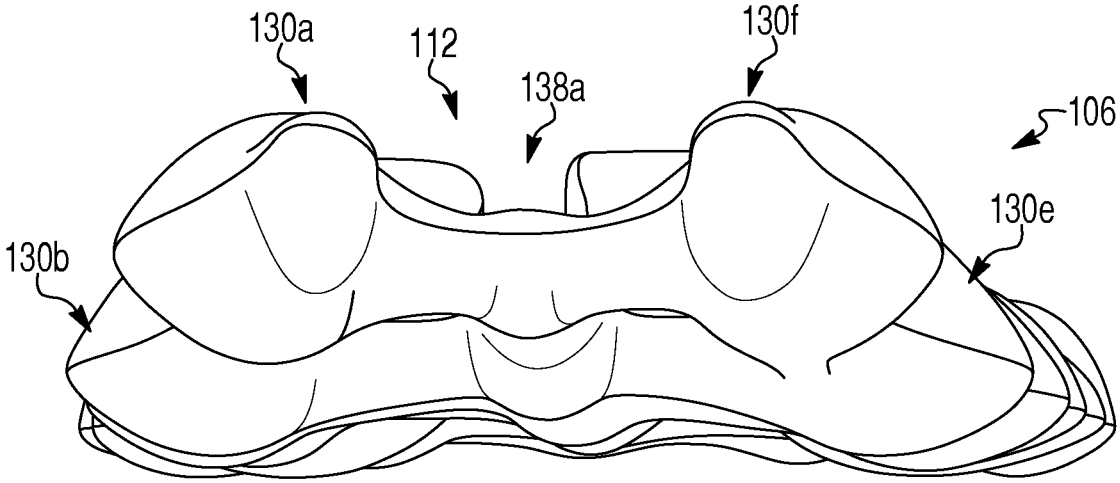
FIG. 4B is a rear view of the cushioning element of the article of footwear of FIG. 1.

FIG. 4A shows an anterior view of the cushioning element 106. The anterior view shows the mouth 129 exposing interior portions of the anterior end 127*d* of the cushioning element 106. FIG. 4B shows a posterior view of the cushioning element 106. The posterior view shows valley 138*a* forming a gap between first bulb 130*a* and sixth bulb 130*f*.

As shown in FIGS. 4A and 4B, the cushioning element 106 may be substantially curved from the first end 110 to the second end 112 such that the first end 110 and the second end 112 may rest in the same plane, but portions of the cushioning element 106 between the first end 110 and the second end 112 rest in a different plane than that of the first end 110 and the second end 112. In other examples, the cushioning element 106 may be substantially flat from the first end 110 to the second end 112 such that the first end 110 and the second end 112 rest in the same plane. In other examples, the cushioning element 106 may be substantially curved from the first end 110 to the second end 112 such that the first end 110 and the second end 112 do not rest in the same plane.

With reference to FIGS. 5A-5E, the cushioning element 106 includes an average cross-sectional dimension (e.g., an average thickness). The average thickness can be the average of all measurements taken between the barrier films 216, 218 of a given bulb 130*a-h*, 132*a-k*, and 134*a-g* of the cushioning element 106 and a given bridge portion 131*a-j*, 133*a-k*, and 135*a-f* of the cushioning element 106. The cushioning element 106 can be sliced and viewed along a line extending parallel to a given vertical plane, the line representing a thickness. The collection of the vertical lines within a respective bulb are averaged to give the average thickness T106.

Therefore, the term "average thickness," when used with reference to a specific element e.g., such as the average thickness of bulbs 130*a-h*, 132*a-k*, and 134*a-g* and bridge portions 131*a-j*, 133*a-k*, and 135*a-f*, relates only to the average thickness of the specific element.

The average thickness T106 of each of bulbs 130*a-h*, 132*a-k*, and 134*a-g* and bridge portions 131*a-j*, 133*a-k*, and 135*a-f* extends parallel to a vertical plane of the cushioning element 106. The average thickness T106 is between about 0.5 millimeters and about 25 millimeters. In an example, average thickness T106 is about 7 millimeters.

In an example, when moving from the posterior end 112 to the anterior end 112, the average thickness may decrease. The first set of bulbs 126*a* may have a first thickness T106*a*, the second set of bulbs 126*b* may have a second thickness T106*b*, and the third set of bulbs 126*c* may have a third thickness T106*c*. The first thickness T106*a* may be greater than the second thickness T106*b*. The second thickness T106*b* may be greater than the third thickness T106*c*. For example, the first thickness T106*a* is about 20 millimeters. The second thickness T106*b* is about 15 millimeters. The third thickness T106*c* is about 10 mm. As another example, when moving from the posterior end 112 to the anterior end 112, the average thickness may increase. The first thickness T106*a* may be less than the second thickness T106*b*. The second thickness T106*b* may be less than the third thickness T106*c*. For example, the first thickness T106*a* is about 12 millimeters. The second thickness T106*b* is about 15 millimeters. The third thickness T106*c* is about 17 millimeters. In another example, when moving from the medial side 22 to the lateral side 24, the average thickness may decrease. As another example, when moving from the medial side 22 to the lateral side 24, the average thickness may increase. As another example when moving from the medial side 22 to the lateral side 24, the average thickness is wider at outer areas and narrower at inner areas.

In one example, the thickness T106 of each of the bulbs 130*a-h*, 132*a-k*, and 134*a-g* and bridge portions 131*a-j*, 133*a-k*, and 135*a-f* are substantially similar or the same. In one example, the thickness T106 of each of the bulbs 130*a-h*, 132*a-k*, and 134*a-g* and bridge portions 131*a-j*, 133*a-k*, and 135*a-f* vary from one another.

Figure 5A:
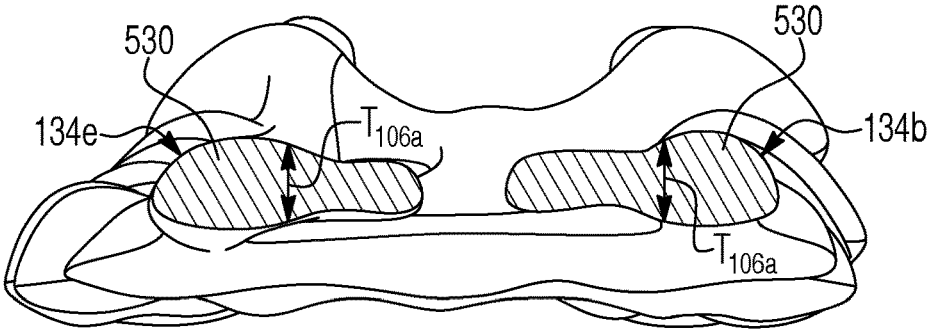
FIG. 5A is a cross-section view of the cushioning element of the article of footwear of FIG. 1 taken along line 5A-5A of FIG. 3A.

FIG. 5A shows a cross-section of the cushioning element 106 taken along axis 5A-5A of FIG. 3A. The barrier films 216, 218 each form a respective portion of an interior void 530 of the cushioning element 106. The interior void 530 shown along the cross-section 5A-5A may be substantially oblong in shape.

Figure 5B:
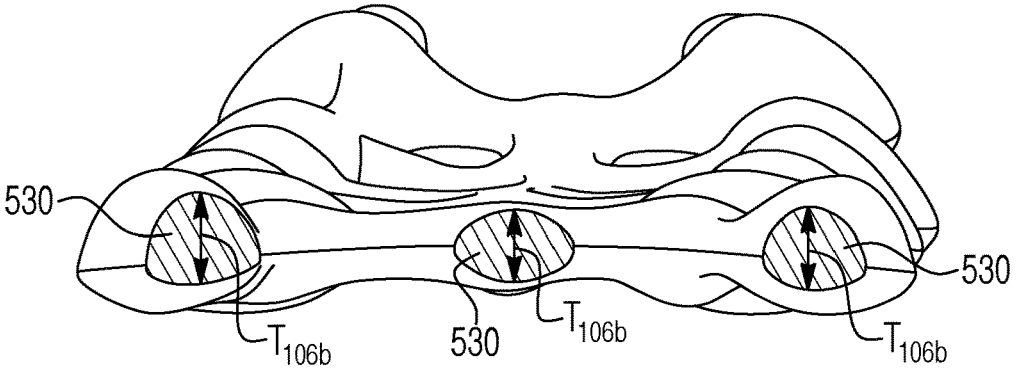
FIG. 5B is a cross-section view of the cushioning element of the article of footwear of FIG. 1 taken along line 5B-5B of FIG. 3A.

FIG. 5B shows a cross-section of the cushioning element 106 taken along axis 5B-5B of FIG. 3A. The interior void 530 shown along the cross-section 5B-5B may be substantially ovular in shape.

Figure 5C:
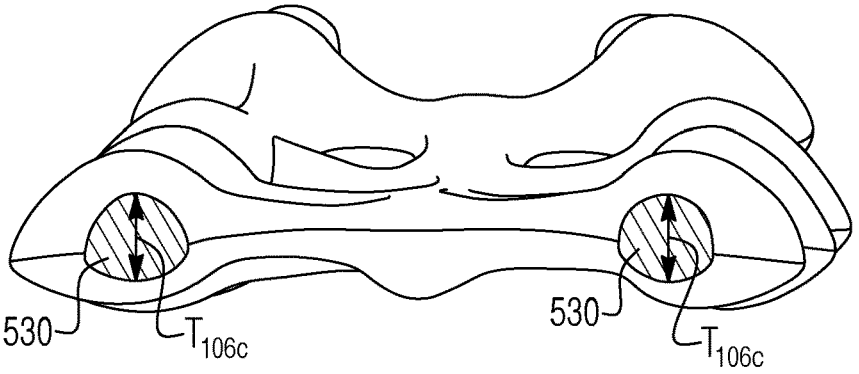
FIG. 5C is a cross-section view of the cushioning element of the article of footwear of FIG. 1 taken along line 5C-5C of FIG. 3A.

FIG. 5C shows a cross-section of the cushioning element 106 taken along axis 5C-5C of FIG. 3A. The interior void 530 shown along the cross-section 5B-5B may be, for example, substantially ovular in shape.

Figure 5D:
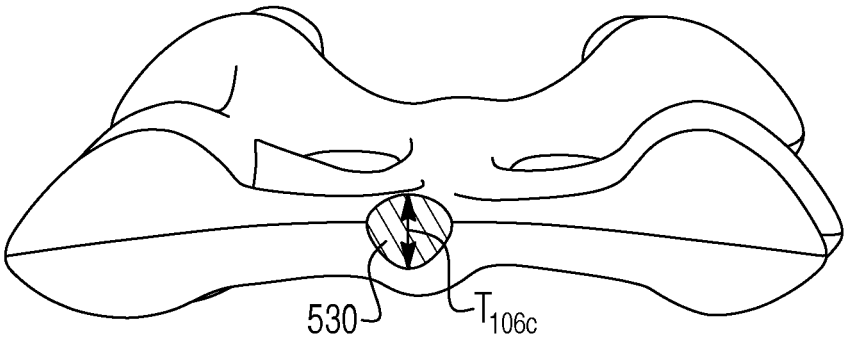
FIG. 5D is a cross-section view of the cushioning element of the article of footwear of FIG. 1 taken along line 5D-5D of FIG. 3A.

FIG. 5D shows a cross-section of the cushioning element 106 taken along axis 5D-5D of FIG. 3A. The interior void 530 shown along the cross-section 5D-5D may be, for example, substantially ovular in shape.

Figure 5E:
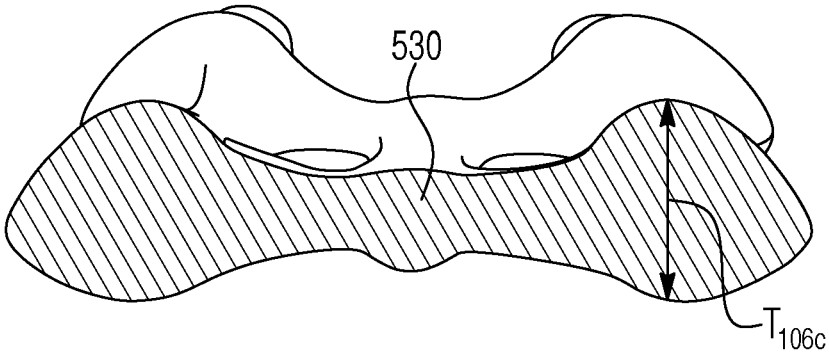
FIG. 5E is a cross-section view of the cushioning element of the article of footwear of FIG. 1 taken along line 5E-5E of FIG. 3A.

FIG. 5E shows a cross-section of the cushioning element 106 taken along axis 5E-5E of FIG. 3A. The interior void 530 shown along the cross-section 5E-5E may have, for example, an irregular elongate shape.

Figure 6A:
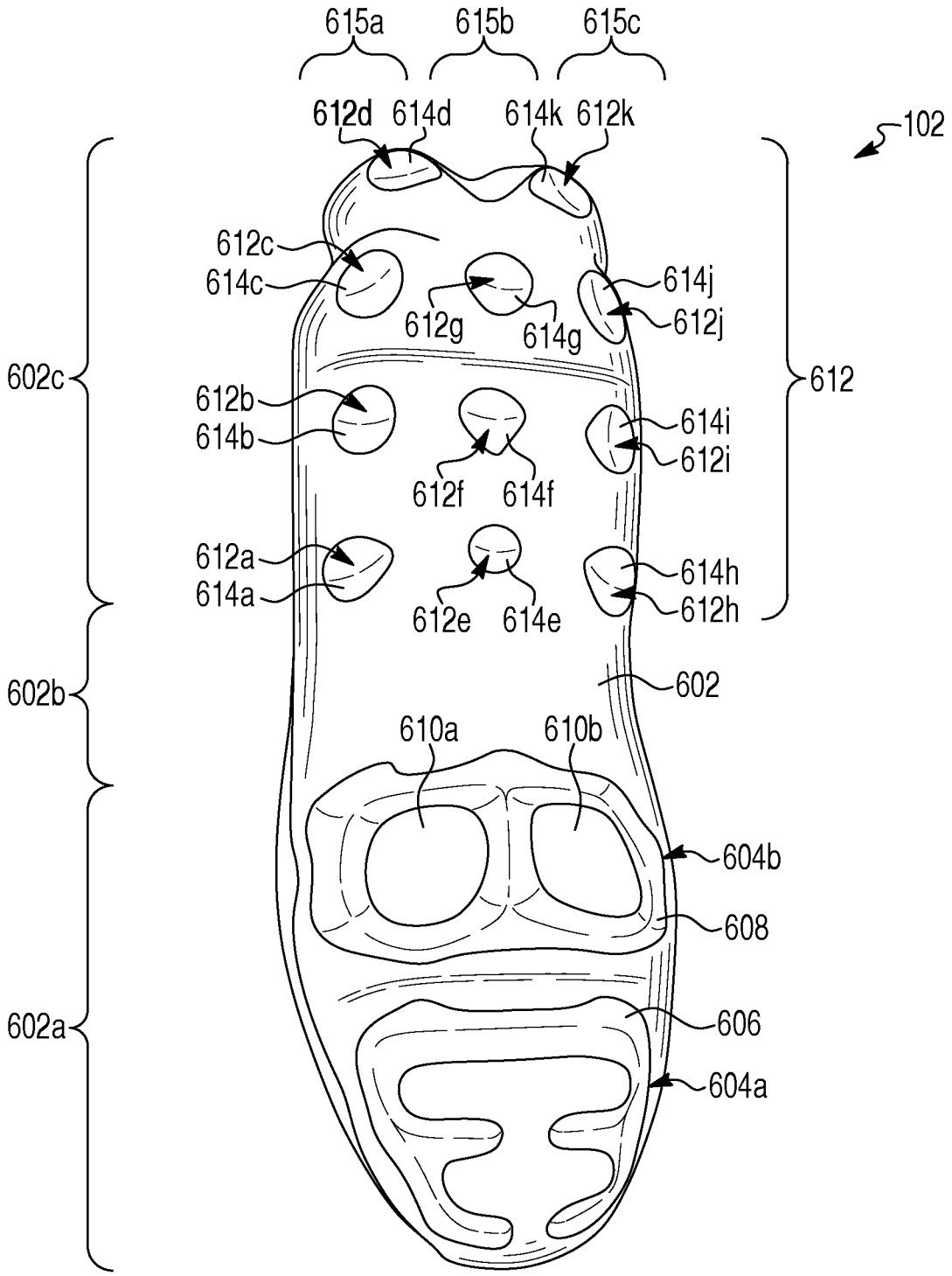
FIG. 6A is a bottom view of a midsole of the article of footwear of FIG. 1.

As disclosed herein, midsole 102 may be inserted into and/or disposed within upper 300. The midsole 102 may be formed with a pressure-mapped topography. Referring to FIG. 6A, the midsole 102 includes a first ground facing surface 602 and a second upper facing surface 603 (shown in FIG. 6B). In an example, the midsole 102 may be removably disposed within the upper 300. The first surface 602 extends from an anterior portion 602*a* of the midsole 102 to a posterior portion 602*c* of the midsole 102. A midfoot portion 602*b* is disposed between the anterior portion 602*a* and the posterior portion 602*c*. The midsole 102 may further include one or more engagement features.

The one or more engagement features includes a first engagement zone 604*a*, a second engagement zone 604*b*, and a plurality of extensions 612. The first engagement zone 604*a* is disposed entirely within the anterior portion 602*a*.

The first engagement zone 604*a* includes a depression 606. Depression 606 surrounds a portion of the first surface 602 disposed in the anterior portion 602*a*. Depression 606 may be substantially U-shaped. Depression 606 may have a corresponding shape to the third set of bulbs 126*c*.

The second engagement zone 604*b* is substantially disposed within the anterior portion 602*a*. A portion of the second engagement zone 604*b* may be disposed in the midfoot portion 602*b*. The second engagement zone 604*b* may be a rounded rectangle. The second engagement zone 604*b* includes a depression 608, a first plateau 610*a*; and a second plateau 610*b*. The depression 608 surrounds both first plateau 610*a* and second plateau 610*b*. First plateau 610*a* may be substantially circular. Second plateau 610*b* may be substantially diamond shaped. In some examples, each of first plateau 610*a* and second plateau 610*b* may have a similar shape. Second engagement zone 604*b* may have a corresponding shape to one or more of the openings 128*b*.

The plurality of extensions 612 include a first extension 612*a*, a second extension 612*b*, a third extension 612*c*, a fourth extension 612*d*, a fifth extension 612*e*, a sixth extension 612*f*, a seventh extension 612*g*, an eighth extension 612*h*, a ninth extension 612*i*, a tenth extension 612*j*, and an eleventh extension 612*k*. The plurality of extensions 612 extend away from the first surface 602 toward a ground surface when oriented with the first surface 602 facing a ground surface. The plurality of extensions 612 are divided into one or more rows along the first surface 602 of the midsole 102. A first row 615*a* of the plurality of extensions includes extensions 612*a*, 612*b*, 612*c*, and 612*d*. A second row 615*b* of the plurality of extensions includes extensions 612*e*, 612*f*, and 612*g*. A third row 615*c* of the plurality of extensions includes 612*h*, 612*i*, 612*j*, and 612*k*. The first row 615*a* is disposed at an outer portion of the midsole 102. The third row 615*c* is disposed at an outer portion of the midsole 102 opposite the first row 615*a*. The second row 615*b* is disposed between the first row 615*a* and the third row 615*c*.

Each of the plurality of extensions 612*a*, 612*b*, 612*c*, 612*d*, 612*e*, 612*f*, 612*g*, 612*h*, 612*i*, 612*j*, and 612*k* include a pocket forming a receiving area for engaging corresponding portions of the cushioning element 106. A first pocket 614*a* is disposed at an end of the first extension 612*a* furthest away from the first surface 602. A second pocket 614*b* is disposed at an end of the second extension 612*b* furthest away from the first surface 602. A third pocket 614*c* is disposed at an end of the third extension 612*c* furthest away from the first surface 602. A fourth pocket 614*d* is disposed at an end of the fourth extension 612*d* furthest away from the first surface 602. A fifth pocket 614*e* is disposed at an end of the fifth extension 612*e* furthest away from the first surface 602. A sixth pocket 614*f* is disposed at an end of the sixth extension 612*f* furthest away from the first surface 602. A seventh pocket 614*g* is disposed at an end of the seventh extension 612*g* furthest away from the first surface 602. An eighth pocket 614*h* is disposed at an end of the eighth extension 612*h* furthest away from the first surface 602. A ninth pocket 614*i* is disposed at an end of the ninth extension 612*i* furthest away from the first surface 602. A tenth pocket 614*j* is disposed at an end of the tenth extension 612*j* furthest away from the first surface 602. An eleventh pocket 614*k* is disposed at an end of the eleventh extension 612*k* furthest away from the first surface 602.

Figure 6B:
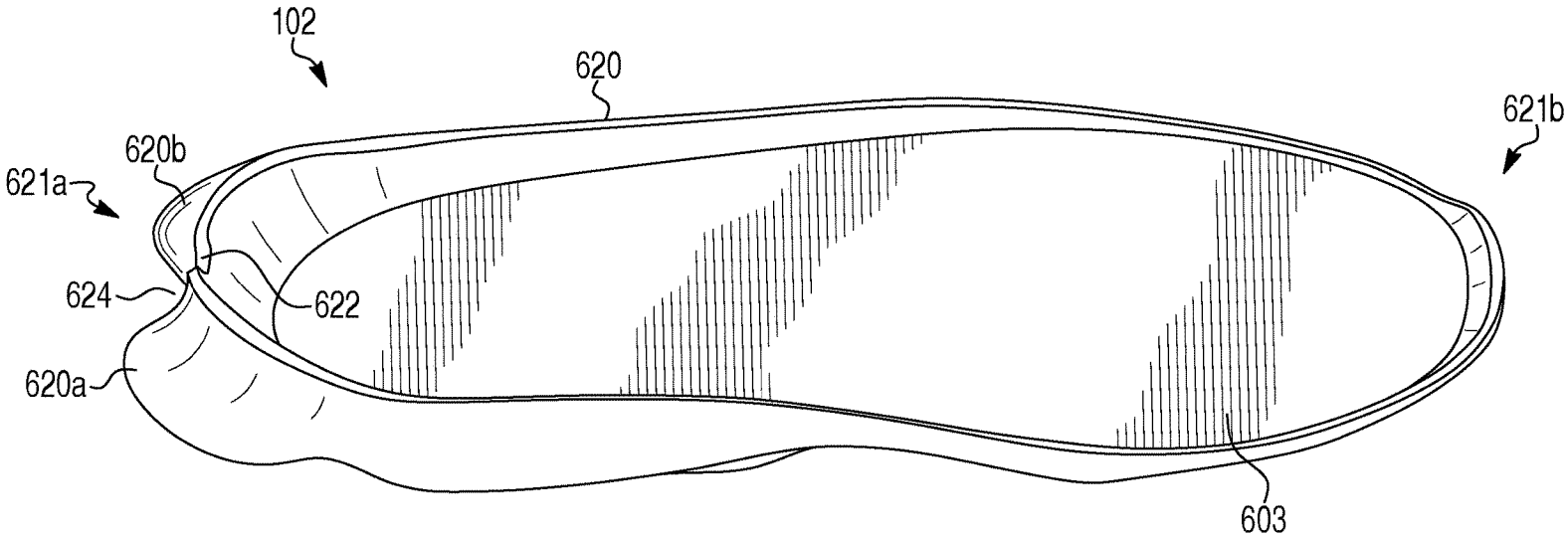
FIG. 6B is a top perspective view of the midsole of the article of footwear of FIG. 1.

Referring to FIG. 6B, the midsole 102 extends from a posterior region 621*a* to an anterior region 621*b*. The second surface 603 is circumscribed by a sidewall 620. The sidewall 620 extends away from the second surface 603 and contacts the upper 300 when assembled. Sidewall 620 extends around the second surface 603 and extends from the posterior region 621*a* to the anterior region 621*b*. The sidewall 620 includes a notch 622. The notch 622 may aid in removal of the midsole 102 when removing the midsole 102 from the upper 300. The notch 622 may also aid in securing of the midsole 102 when inserting the midsole 102 into the upper 300. The sidewall 620 further includes a first protrusion 620*a* and a second protrusion 620*b*. The first protrusion 620*a* and the second protrusion 620*b* are separated by a space 624. The first protrusion 620*a* and the second protrusion 620*b* extends away from the midsole 102 toward the posterior region 621*a*. Each of the first protrusion 620*a* and the second protrusion 620*b* aid in securing the midsole 102 to the upper 300 when inserted into the upper 300.

In some examples, the second surface 603 may be textured such that the second surface 603 includes various shaped raised elements. When textured, the second surface 603 of the midsole 102 may further aid in securing a foot of a user of the article of footwear.

The thickness of the midsole 102 may vary. For example, a thickness at the posterior region 621*a* may be greater than a thickness at the anterior region 621*b* such that the midsole 102 tapers from the posterior region 621*a* to the anterior region 621*b*. In this example, the thickness at the posterior region 621*a* may be 35 mm and the thickness at the anterior region 621*b* may be 20 mm. In another example, the thickness at the posterior region 621*a* may be less than a thickness at the anterior region 621*b* such that the midsole 102 tapers from the anterior region 621*b* to the posterior region 621*a*. In this example, the thickness at the posterior region 621*a* may be 30 mm and the thickness at the anterior region 621*b* may be 35 mm. In other examples, the midsole 102 may have a uniform thickness of about 35 mm.

Figure 6C:
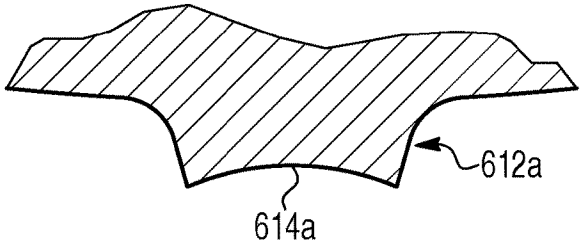
FIG. 6C is a cross-sectional view of the midsole of FIG. 6A.

As is best shown in FIG. 6C, each of the pockets 614*a*, 614*b*, 614*c*, 614*d*, 614*e*, 614*f*, 614*g*, 614*h*, 614*i*, 614*j*, and 614*k* may have a shape that is substantially circular and is generally concave, when viewed from a vantage point above the respective pocket, so as to be configured to engage a top surface of respective portions of the cushioning element 106. In some examples, each of the pockets 614*a*, 614*b*, 614*c*, 614*d*, 614*e*, 614*f*, 614*g*, 614*h*, 614*i*, 614*j*, and 614*k* may have the same shape. In other examples, each of the pockets 614*a*, 614*b*, 614*c*, 614*d*, 614*e*, 614*f*, 614*g*, 614*h*, 614*i*, 614*j*, and 614*k* may have a different shape. Each of the pockets 614*a*, 614*b*, 614*c*, 614*d*, 614*e*, 614*f*, 614*g*, 614*h*, 614*i*, 614*j*, and 614*k* may have a shape suitable for engaging a corresponding portion of the cushioning element 106.

The midsole 102 incorporates one or more materials or embedded elements that enhance the comfort, performance, and/or ground-reaction-force attenuation properties of footwear 10. These elements and materials may include, individually or in any combination, a polymer foam material, such as polyurethane or ethylvinylacetate (EVA), filler materials, moderators, air-filled bladders, plates, lasting elements, or motion control members.

Figure 7:
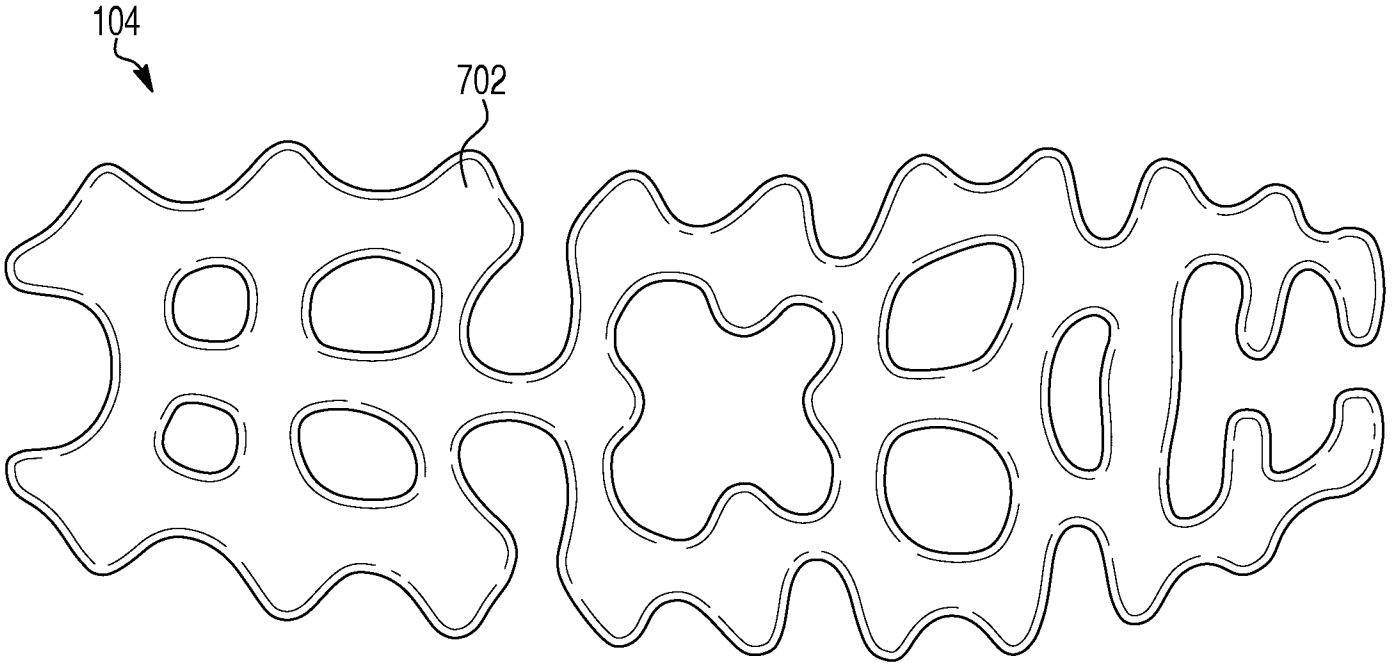
FIG. 7 is a bottom view of an outsole of the article of footwear of FIG. 1.

Referring to FIG. 7, the outsole 104 includes a ground-facing surface 702. In some examples, the ground engaging surface 702 of the outsole 104 may include traction elements or other elements for attenuating ground forces and/or providing traction to the article of footwear 10. The outsole 104 may have a corresponding shape to the cushioning element 106. In other examples, the cushioning element 106 may have a substantially ovular, rectangular, or rounded shape.

Figure 8A:
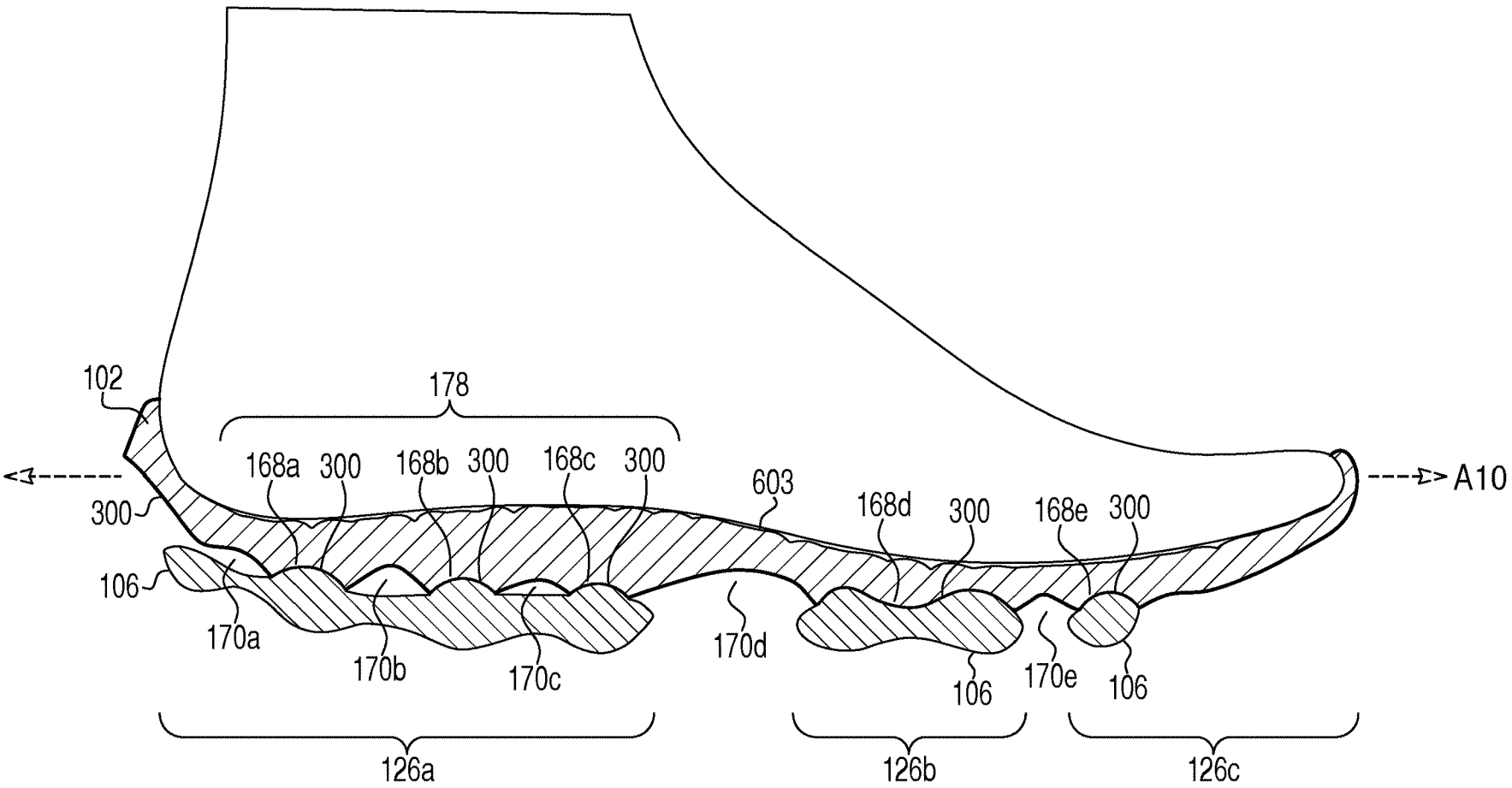
FIG. 8A is a cross-section view of the article of footwear of FIG. 1 taken along line 8A-8A of FIG. 9.
Figure 9:
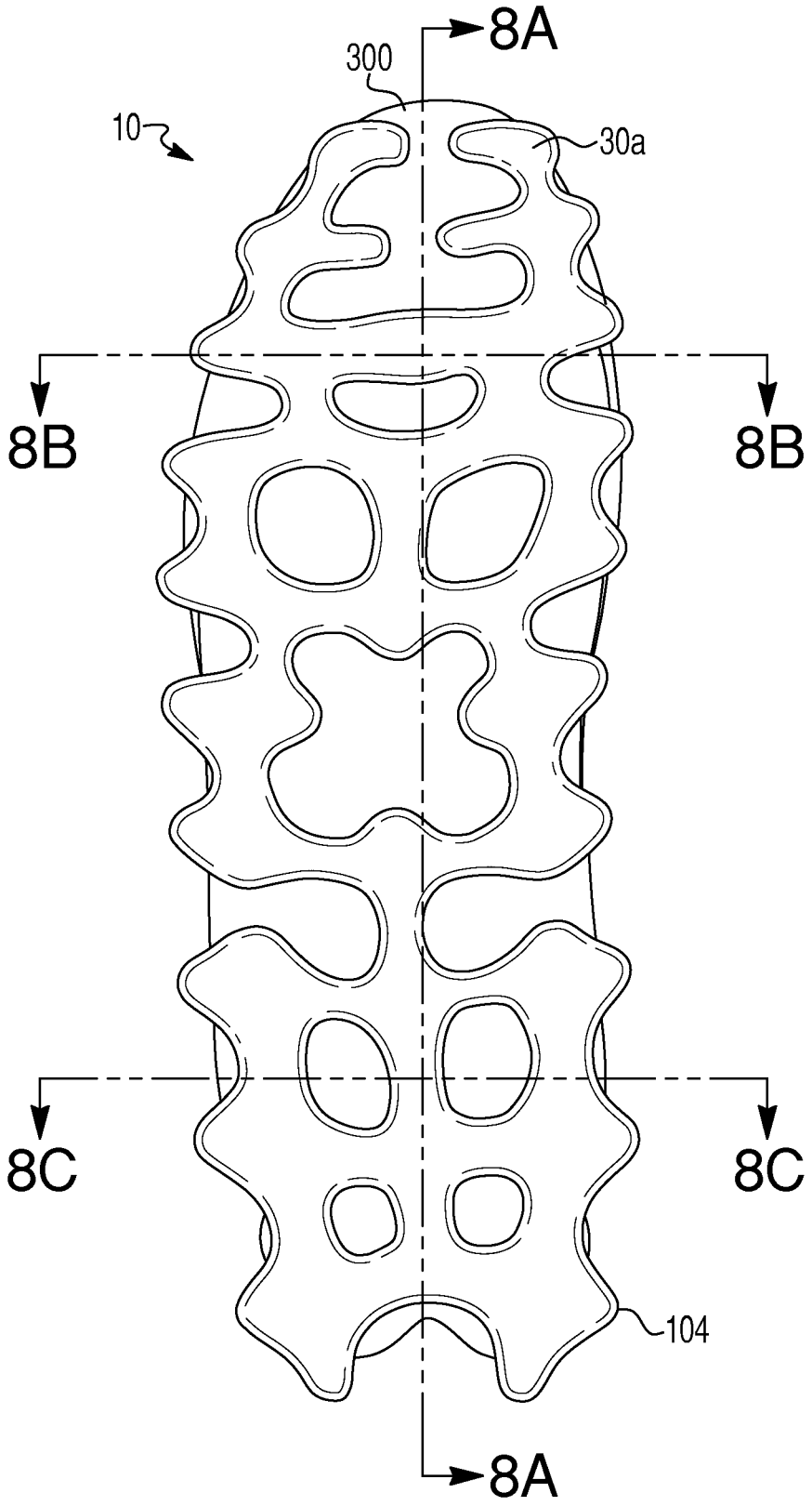
FIG. 9 is a bottom view of the article of footwear of FIG. 1.

A cross-section of the article of footwear 10 is shown in FIG. 8A taken along the axis A10 and line 8A-8A (shown in FIG. 9). The combination of the upper 300 and the midsole 102 is configured to interface with the cushioning element 106.

The combination of the midsole 102 and the upper 300 form a series of supports 168*a*, 168*b*, 168*c*, 168*d*, and 168*e* extending along a length of the combination of the midsole 102 and the upper 300. The series of supports 168*a*-168*e* alternate with a series of recesses 170*a*, 170*b*, 170*c*, 170*d*, and 170*e*, which also extend along the length of the combination of the midsole 102 and the upper 300. The series of supports 168*a*-168*e* are spaced apart from one another in both the medial-to-lateral direction and the toe-to-heel direction by the recesses 170*a*, 170*b*, 170*c*, 170*d*, and 170*e*. The recesses 170*a*, 170*b*, 170*c*, 170*d*, and 170*e* that space apart the supports 168*a*-168*e* may extend generally continuously in the medial-to-lateral direction and the toe-to-heel direction. Each of the recesses 170*a*-170*e* extend along an entirety of a width of the article of footwear 10 extending perpendicular to the axis A10 such that the recesses 170*a*-170*e* allow a user to view through one side of the article of footwear 10 to an opposing side of the article of footwear 10. Each of the recesses 170*a*-170*e* may have a substantially triangular arch profile when viewed from either the medial side 22 or the lateral side 24 of the article of footwear 10. Although only supports 168*a*-168*e* are shown in this cross-section view, it is contemplated there may any number of supports for engaging the cushioning element 106.

The series of supports 168*a*-168*e* are aligned and in contact with respective sets of bulbs 126. As such, a bottom end of each of the supports 168*a*-168*e* is generally concave when viewed from a bottom perspective of the article of footwear 10 so as to receive a top surface of a respective one of the sets of bulbs 126. The supports 168*a*-168*c* define a first series 178 of supports configured to be aligned with and contact the first set of bulbs 126*a*. The support 168*d* is configured to be aligned with and contact the second set of bulbs 126*b*. The support 168*e* is configured to be aligned with and contact the second set of bulbs 126*c*. The series of supports 168*a*-168*e* point load the cushioning element 106. This configuration of the article of footwear 10 allows for force-attenuating contact between the series of supports 168*a*-168*e* and the cushioning element 106. In other words, the combination of the midsole 102 and the upper 300 is directly attached to the cushioning element 106. This attachment may be effected by wet cement bonding, thermoplastic polyurethane (TPU) bonding, or the like.

This shape configuration of the series of supports 168*a*-168*e*, bulbs 126, and midsole 102 may facilitate toe-to-heel flexion in addition to medial-to-lateral flexion. This shape configuration may reflect a wearer's motion of both transferring weight from the ball of the foot to the heel, or vice versa, as well as the wearer's motion of transferring weight from the medial side to the lateral side, or vice versa, such as when executing side-to-side movements. Further having smaller but a greater number of discrete supports 168*a*-168*e* may provide more points for increased point loading and, therefore, increase the ability to attenuate ground forces (e.g., cushioning). In other examples, a larger but smaller number of supports 168*a*-168*e* may provide increased point loading over a larger area and, therefore, increase the ability to attenuate ground forces (e.g., cushioning).

The recesses 170*a*, 170*b*, 170*c*, 170*d*, and 170*e* may help to localize the transmitted forces to discrete areas (e.g., the plurality of bulbs 126) which may increase the number of flexion points so as to improve wearer comfort and lessen foot fatigue. As well, the recesses 170*a*, 170*b*, 170*c*, 170*d*, and 170*e* may also resiliently compress in response to a load which further enhances the cushioning/force attenuation features of the sole structure 100.

In other examples, one or more of the series of supports 168*a*-168*e* may not be directly attached to the cushioning element 106. In such an example, the one or more series of supports 168*a*-168*e* that are not contacting the cushioning element 106 do not point load the cushioning element 106.

Figure 8B:
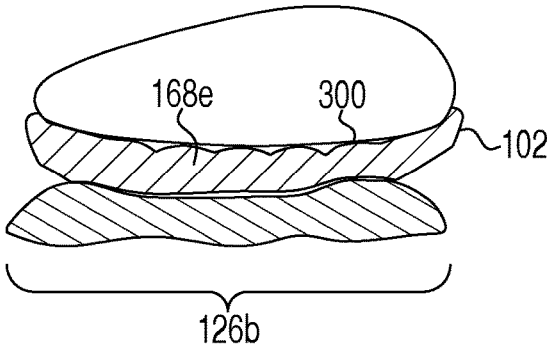
FIG. 8B is a cross-section view of the article of footwear of FIG. 1 taken along line 8B-8B of FIG. 9.

A cross-section view taken along line 8B-8B (shown in FIG. 9) is shown in FIG. 8B. The support 168*e* contacts the third set of bulbs 126*c*.

Figure 8C:
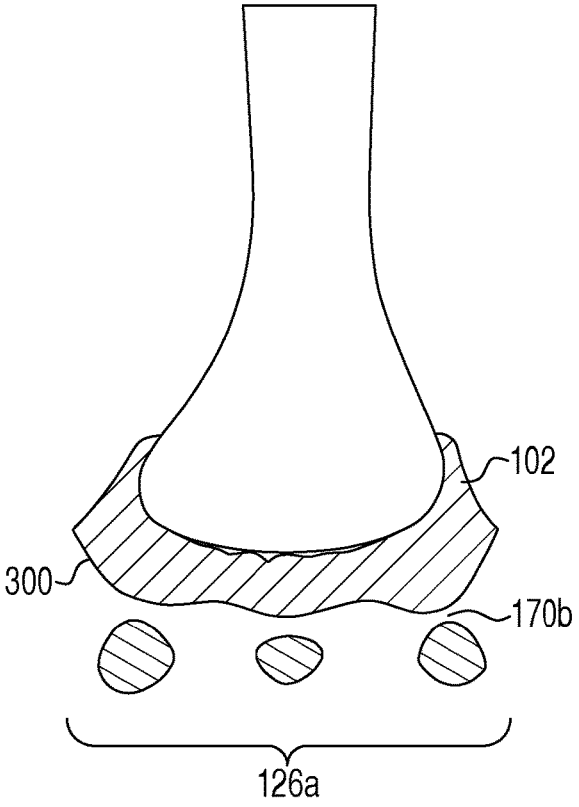
FIG. 8C is a cross-section view of the article of footwear of FIG. 1 taken along line 8C-8C of FIG. 9.

A cross-section view taken along line 8C-8C (shown in FIG. 9) is shown in FIG. 8C. The recess 170*b* is shown extending through to both sides of the article of footwear 10.

By substantially filling the respective pockets 614*a*-614*k* of the midsole 102 with the respective bulbs 126 of the cushioning element 106, respectively, the respective bulbs 126 take on the shapes and dimensions of their corresponding pockets 614*a*-614*k*.

FIG. 9 illustrates a bottom view of the article of footwear 10. The outsole 104 is formed of a material that is different from a material of the cushioning element 106. Outsole 104 may be formed of a thermoplastic elastomer (TPE). The outsole 104 may include one or more textured elements. The textured elements may provide a desired form of traction to the article of footwear 10. The material of the outsole 104 may be more durable relative to the material of the cushioning element 106. Preferably, the material of the outsole 104 is disposed on areas of the outsole 104 where the portion of the outsole 104 engages the ground surface.

Figure 10:
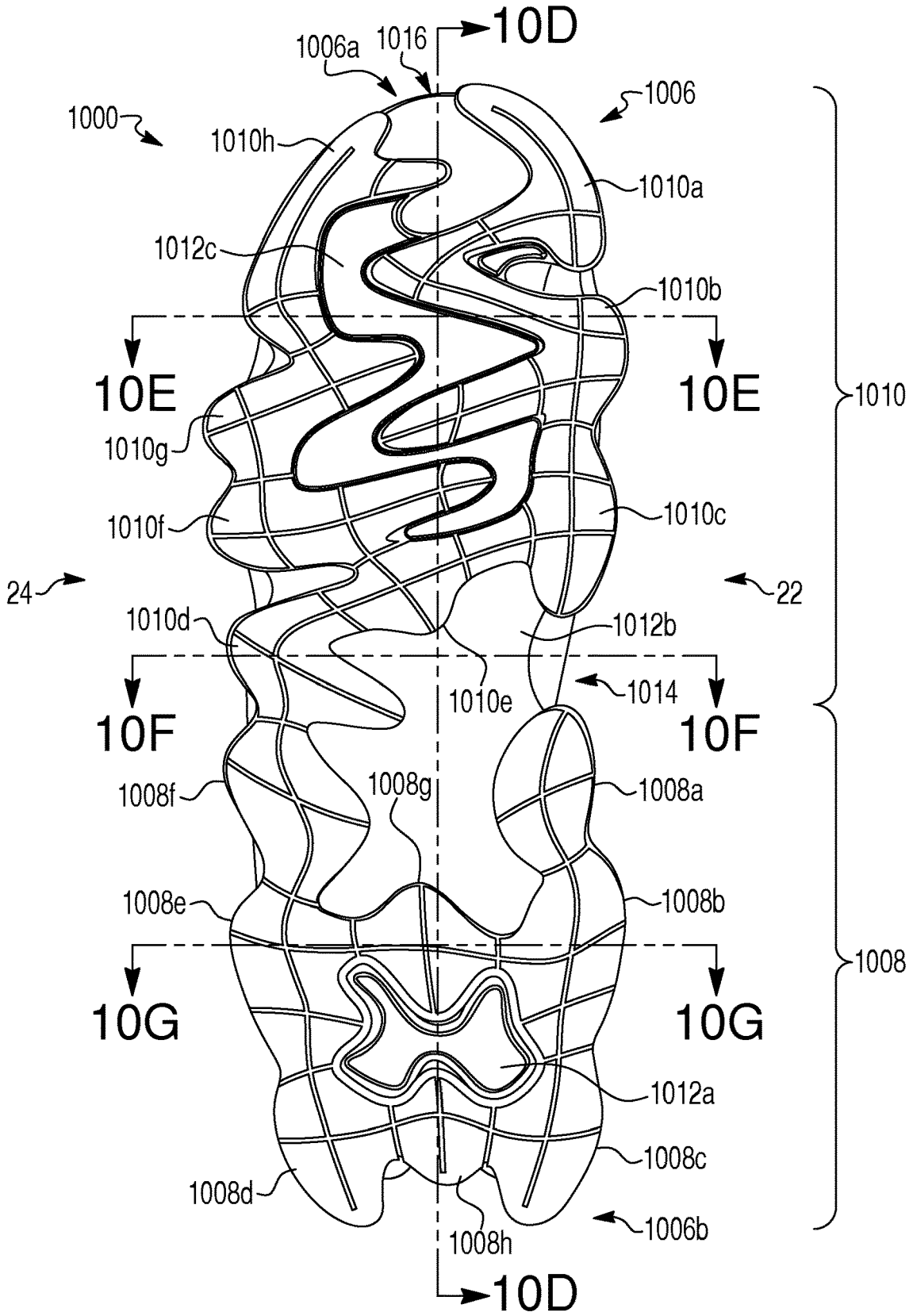
FIG. 10 is a bottom view of an alternative article of footwear.

An alternative embodiment of the cushioning element 106 is shown in FIG. 10 as cushioning element 1006 of the article of footwear 1000. The cushioning element 1006 may be similarly coupled to the article of footwear 1000 as cushioning element 106 is coupled to the article of footwear 10. The cushioning element 1006 includes an anterior end 1006*a* and a posterior end 1006*b*. The cushioning element 1006 further includes a posterior set of bulbs 1008, an anterior set of bulbs 1010, and one or more openings 1012*a*, 1012*b*, and 1012*c*. The posterior set of bulbs 1008 includes a first bulb 1008*a*, a second bulb 1008*b*, a third bulb 1008*c*, a fourth bulb 1008*d*, a fifth bulb 1008*e*, a sixth bulb 1008*f*, a first central bulb 1008*c*, a first central bulb 1008*g*, and a second central bulb 1008*h*. The anterior set of bulbs 1010 includes a first bulb 1010*a*, a second bulb 1010*b*, a third bulb 1010*c*, a fourth bulb 1010*d*, a fifth bulb 1010*e*, a sixth bulb 1010*f*, a seventh bulb 1010*g*, and an eighth bulb 1010*h*. Each of the posterior set of bulbs 1008 and the anterior set of bulbs 1010 may be substantially similar to the first set of bulbs 126*a*, the second set of bulbs 126*b*, and the third set of bulbs 126*c*. Each of the posterior set of bulbs 1008 and the anterior set of bulbs 1010 may be interconnected in a similar manner as the first set of bulbs 126*a*, the second set of bulbs 126*b*, and the third set of bulbs 126*c*.

The opening 1012*a* may be disposed near the posterior end 1006*b*. The opening 1012*a* is surrounded by the second bulb 1008*b*, the third bulb 1008*c*, the fourth bulb 1008*d*, the fifth bulb 1008*e*, the first central bulb 1008*c*, and the second central bulb 1008*g*. The opening 1012*a* may have a substantially X-shape and corresponds with a portion of the cushioning element 1006 where material has been removed, similar to openings 128*a*, 128*b*, and 128*c*.

The opening 1012*b* is bounded by the first bulb 1008*a*, the second bulb 1008*b*, the first central bulb 1008*g*, the fifth bulb 1008*e*, the sixth bulb 1008*f*, the fourth bulb 1010*d*, the fifth bulb 1010*e*, and the third bulb 1010*c*. The opening 1012*b* further includes a mouth 1014 disposed on the medial side of the article of footwear 1000. The mouth 1014 exposes inner portions of the opening 1012*b* to the external environment. The mouth 1014 extends between the third bulb 1010*c* and the first bulb 1008*a*.

The opening 1012*c* is bounded by the first bulb 1010*a*, the second bulb 1010*b*, the third bulb 101*c*, the fifth bulb 1010*e*, the sixth bulb 1010*f*, the seventh bulb 1010*g*, and the eighth bulb 1010*h*. The opening 1012*c* further includes a mouth 1016 disposed at the posterior end 1006*a* of the cushioning element 1006. The mouth 1016 exposes inner portions of the opening 1012*c* to the external environment. The mouth 1016 extends between the first bulb 1010*a* and the eighth bulb 1010*h*.

Figure 11:
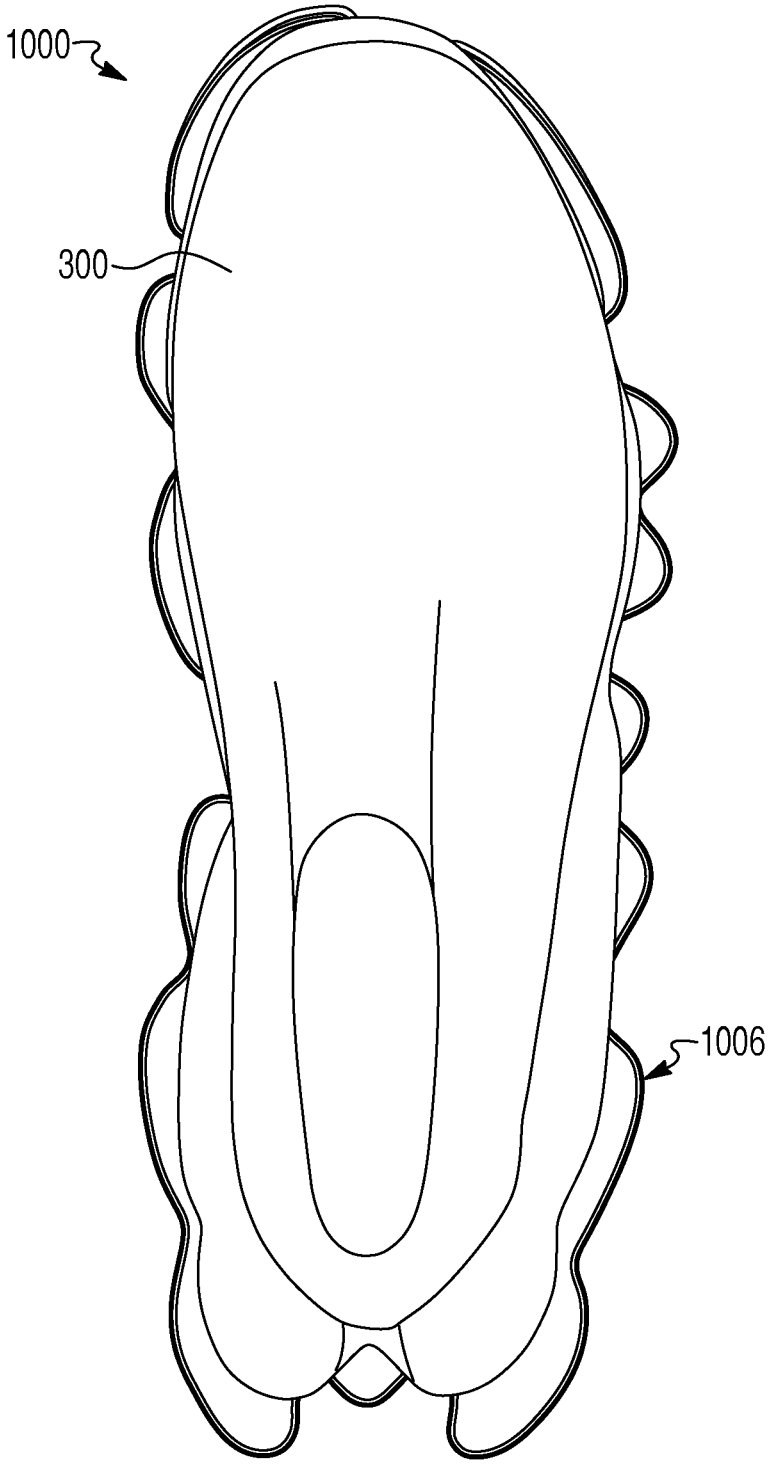
FIG. 11 is a top view of the article of footwear of FIG. 10.

FIG. 11 depicts a top view of the article of footwear 1000 with the cushioning element 1006.

Figure 12:
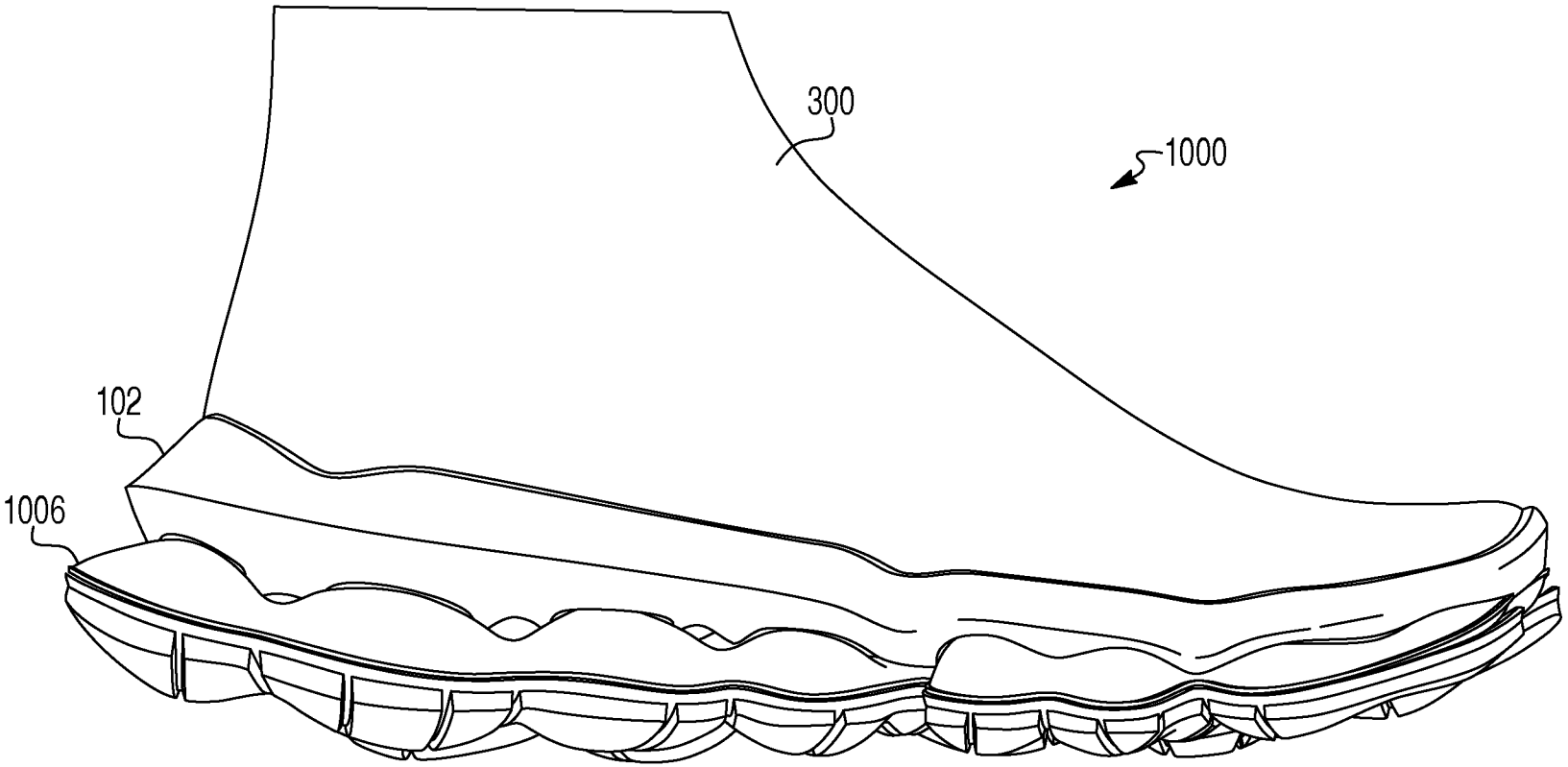
FIG. 12 is a side view of the article of footwear of FIG. 10.
Figure 13A:
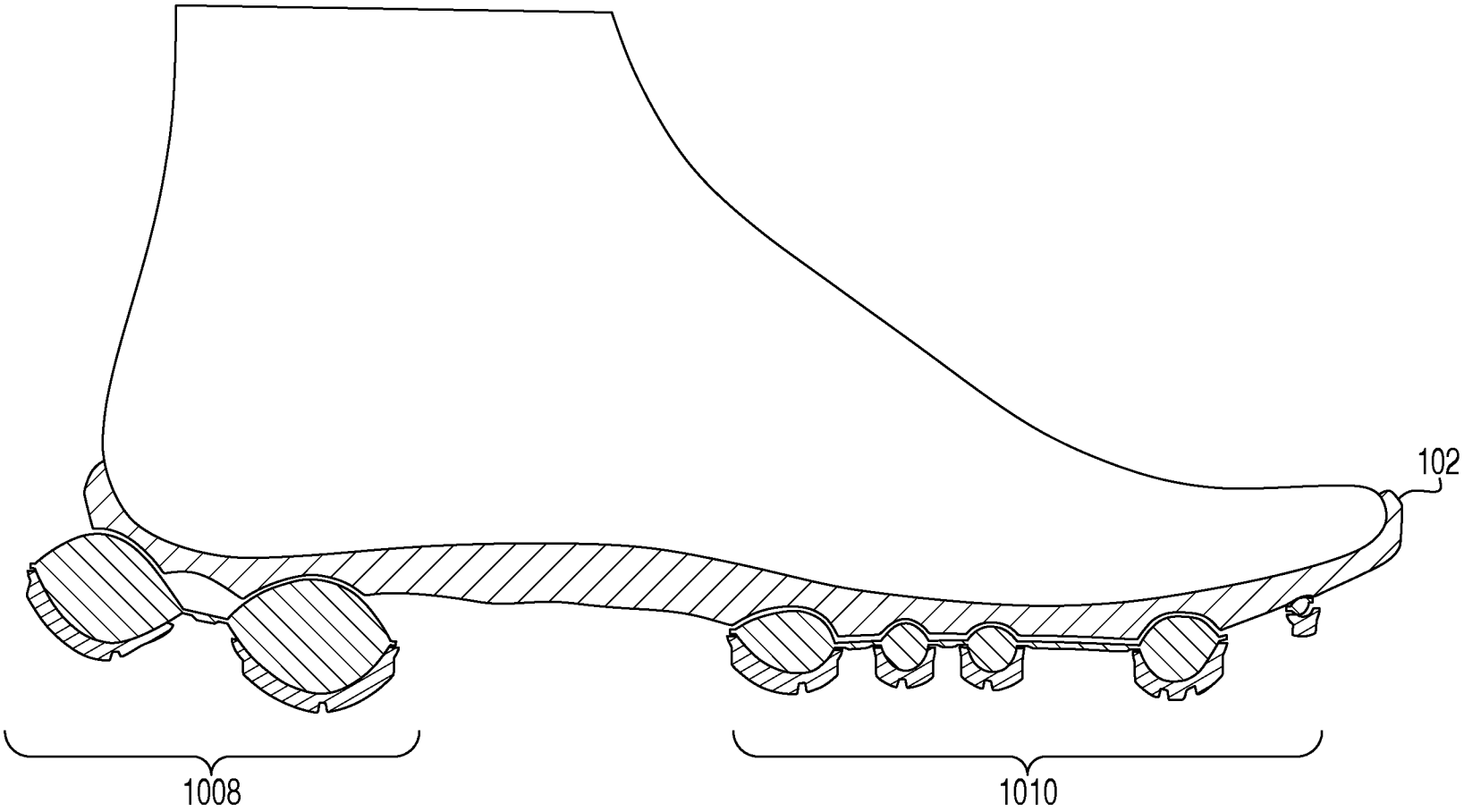
FIG. 13A is a cross-section view of the article of footwear of FIG. 10.
Figure 13D:
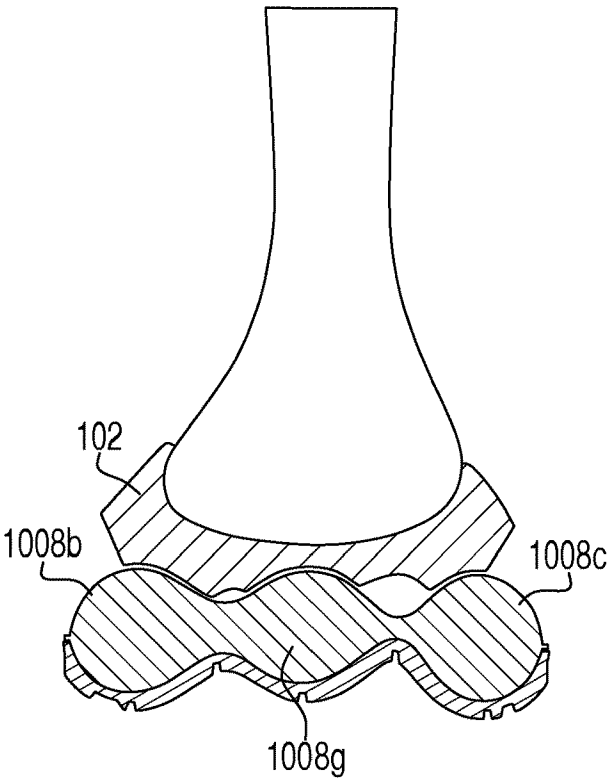
FIG. 13D is a cross-section view of the article of footwear of FIG. 10.
Figure 13C:
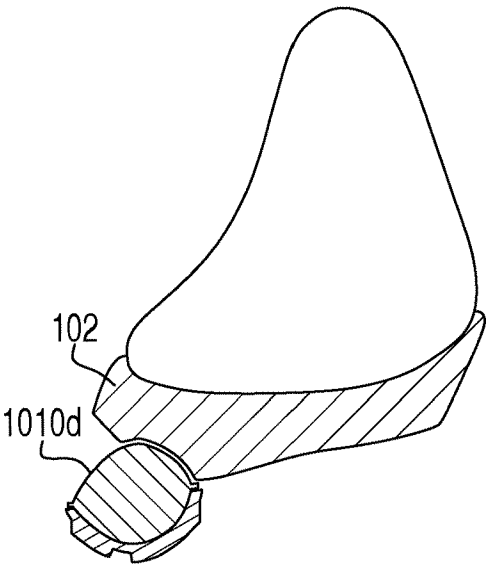
FIG. 13C is a cross-section view of the article of footwear of FIG. 10.
Figure 13B:
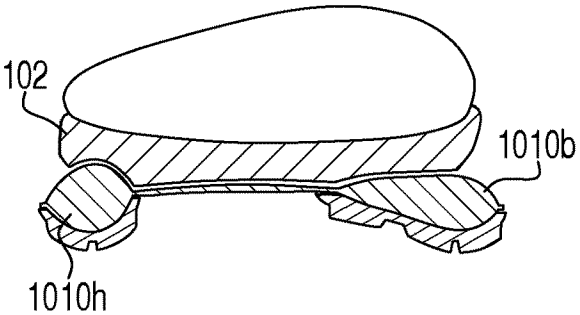
FIG. 13B is a cross-section view of the article of footwear of FIG. 10.
Figure 14A:
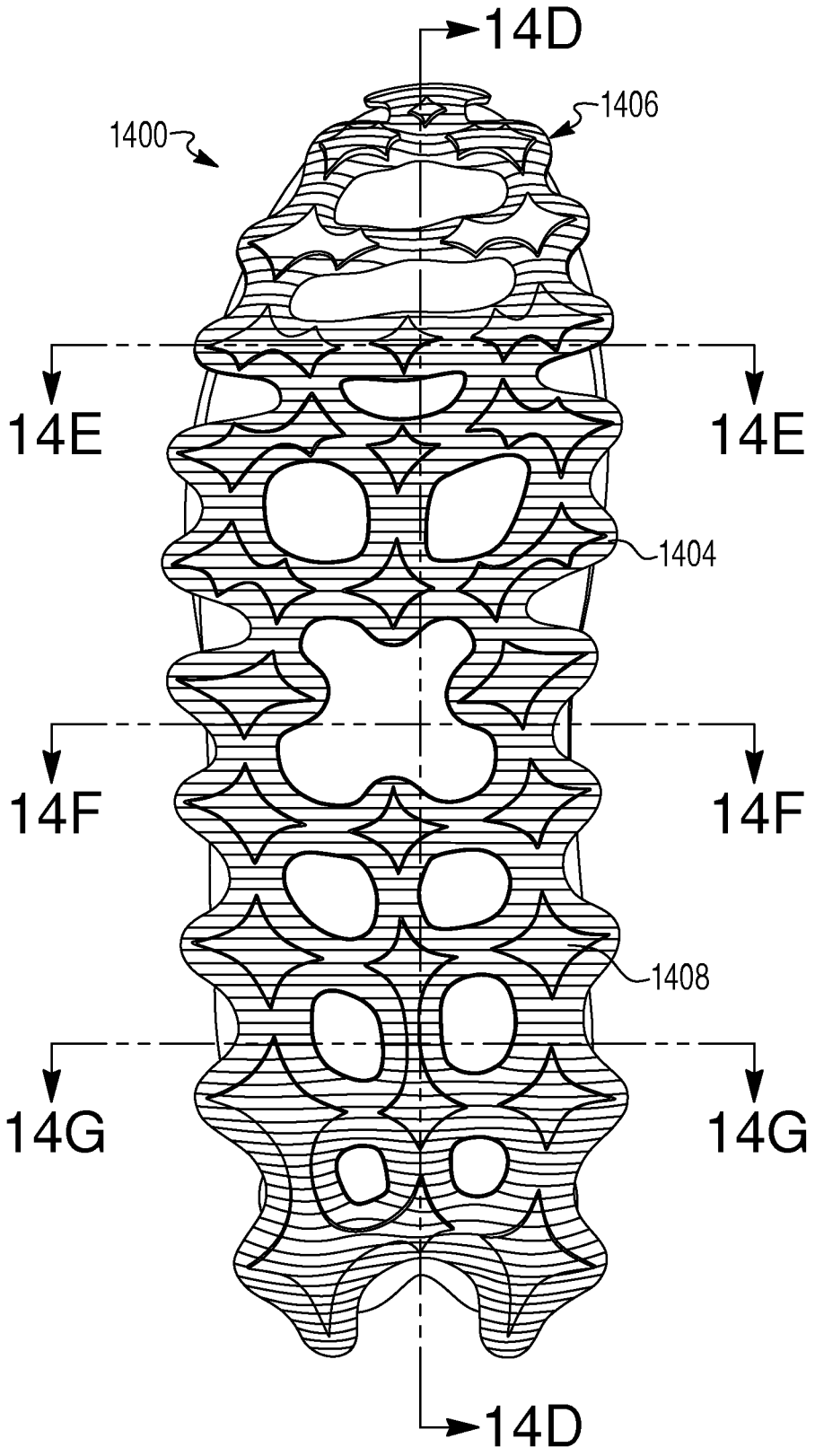
FIG. 14A is a bottom view of an alternative article of footwear.
Figure 14B:
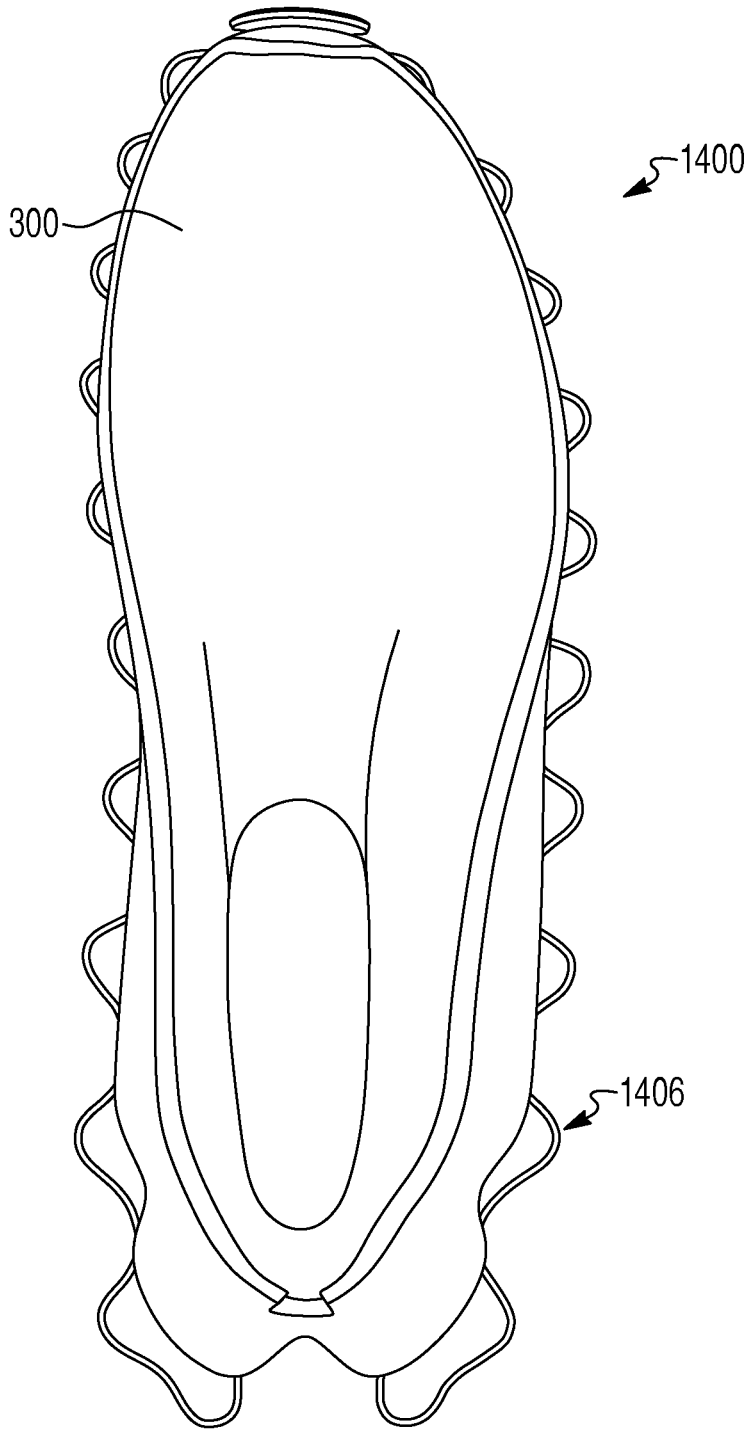
FIG. 14B is a top view of the article of footwear of FIG. 14A.
Figure 14C:
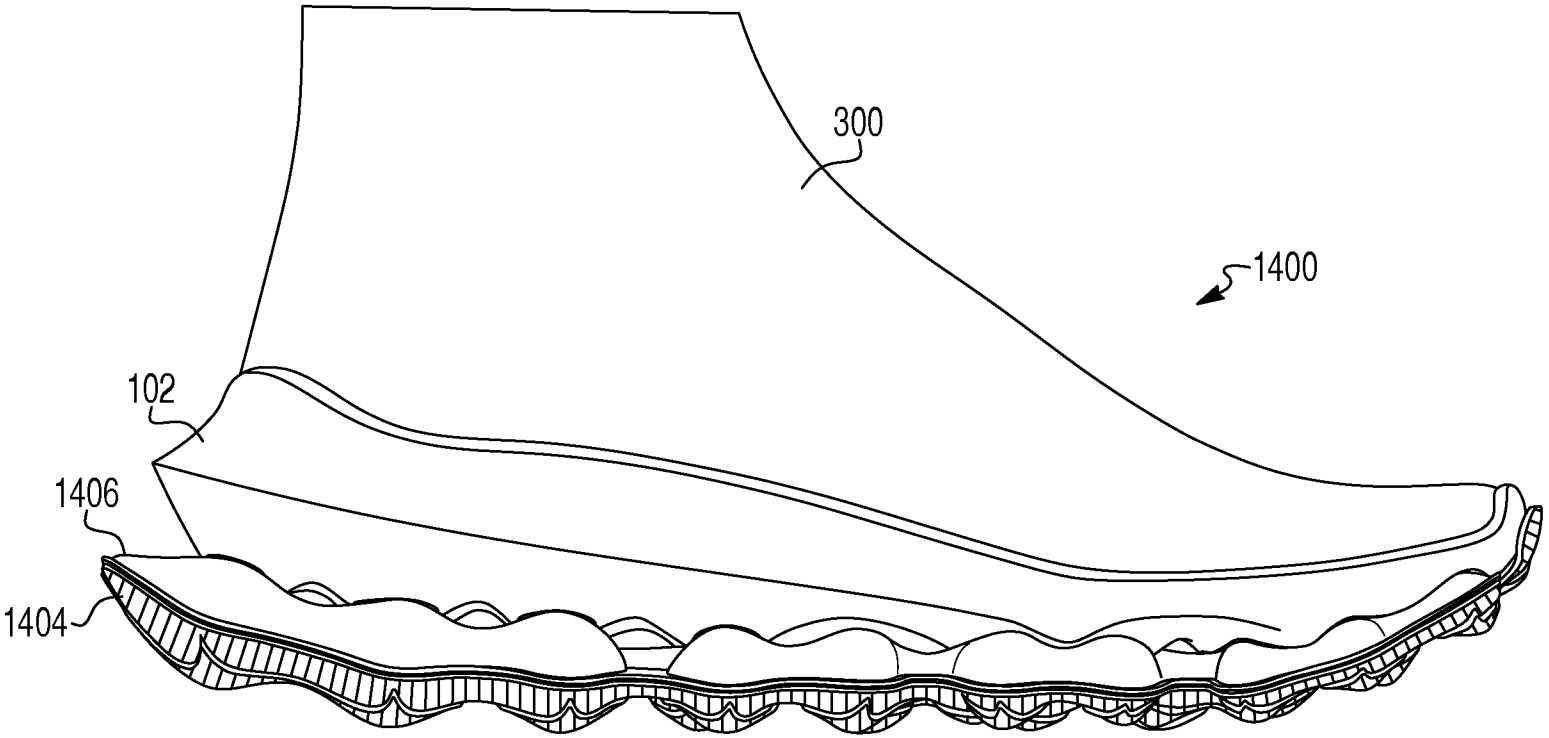
FIG. 14C is a side view of the article of footwear of FIG. 14A.
Figure 14D:
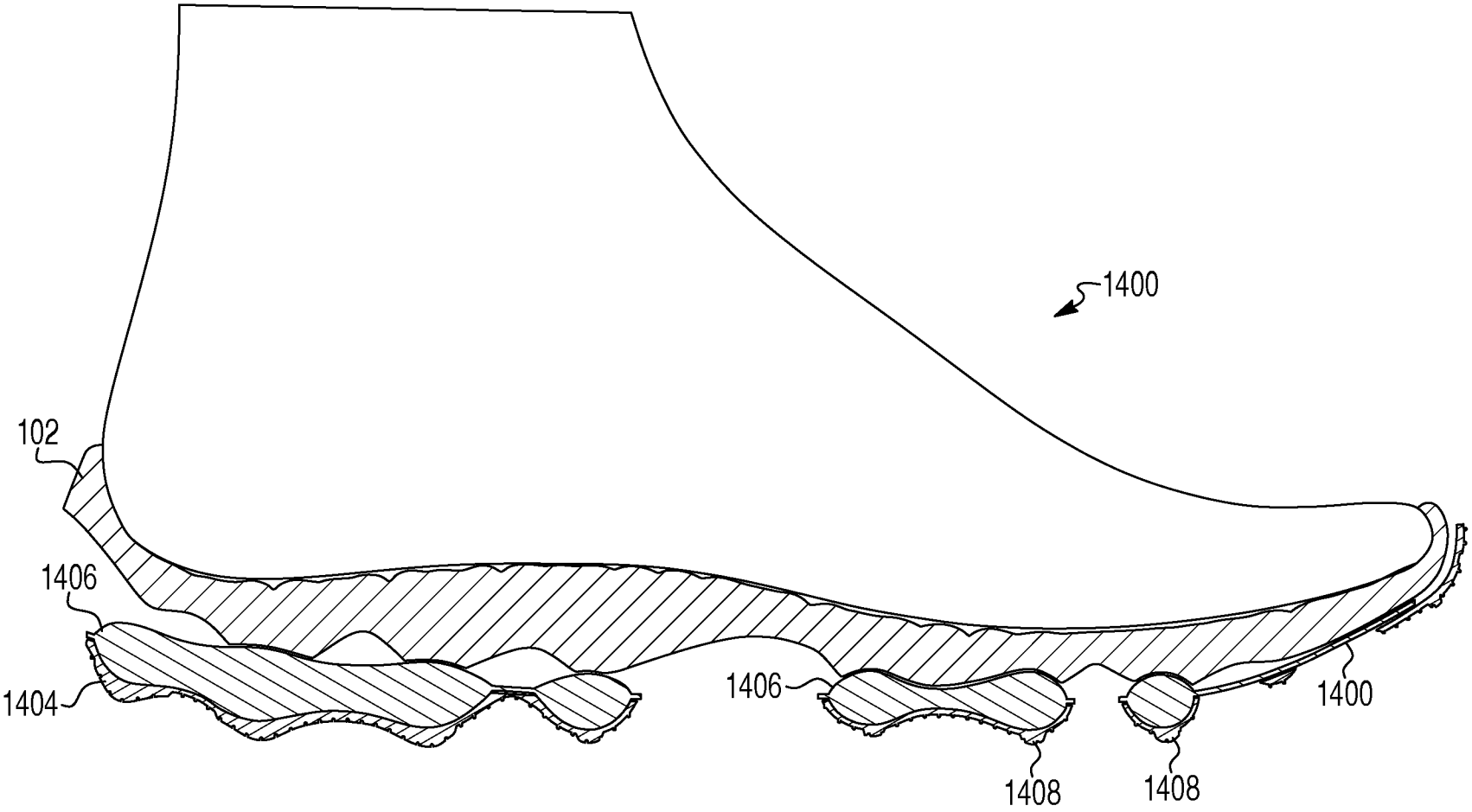
FIG. 14D is a cross-section view of the article of footwear of FIG. 14A taken along line 14D-14D.
Figure 14G:
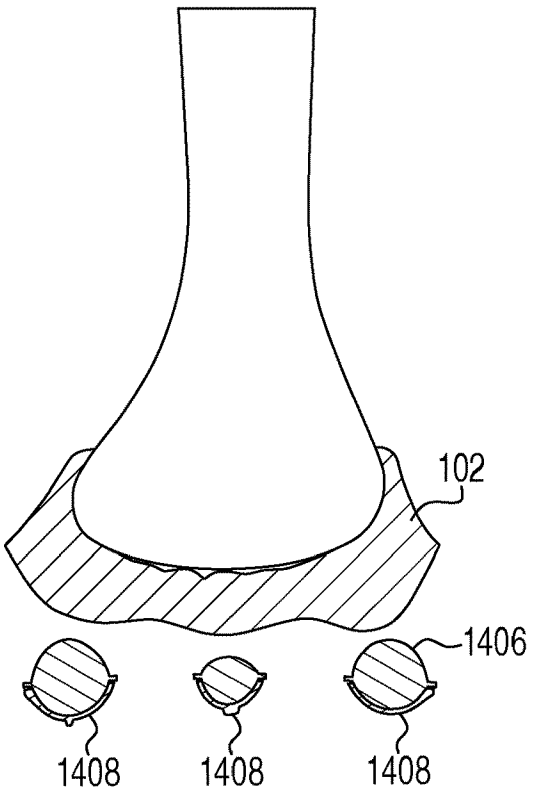
FIG. 14G is a cross-section view of the article of footwear of FIG. 14A taken along line 14G-14G.
Figure 14F:
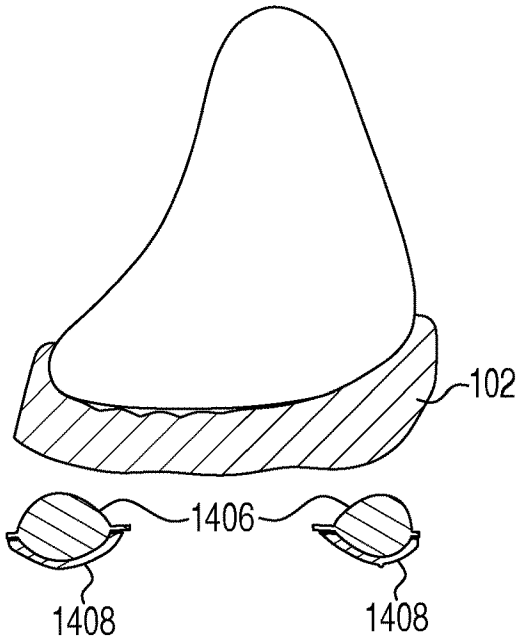
FIG. 14F is a cross-section view of the article of footwear of FIG. 14A taken along line 14F-14F.
Figure 14E:
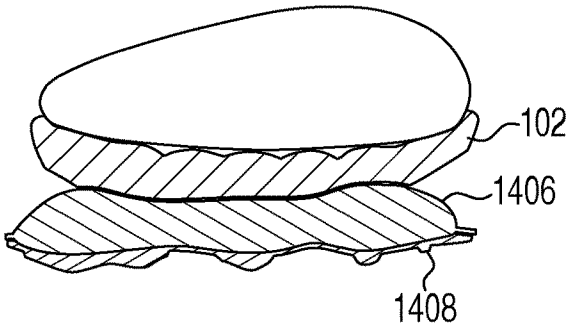
FIG. 14E is a cross-section view of the article of footwear of FIG. 14A taken along line 14E-14E.

FIG. 12 shows a side view of the article of footwear 1000 with the cushioning element 1006. The cushioning element 1006 may be formed with a textured ground-engaging surface. In some examples, the cushioning element 1006 may be coupled to an outsole similar to outsole 104.

FIGS. 13A-13D show cross-sectional views of the article of footwear 1000 taken along lines 10D, 10E, 10F, and 10G of FIG. 10, respectively. The interior of the cushioning element 1006 may be similarly formed as that of cushioning element 106.

FIGS. 14A-14G show an alternative article of footwear 1400 including an alternative cushioning element 1406 coupled with an alternative outsole 1404. The outsole 1404 includes textured elements 1408. The textured elements 1408 engage with a ground surface. The textured elements 1408 may include any shape such as star, diamond, rectangular, ovular, or any desired shape to provide a desired form of traction and/or cushioning to the article of footwear 1400. The cushioning element 1406 may be substantially similar to the cushioning element 106, and may be coupled within the article of footwear 1400 in a substantially similar manner as cushioning element 106 is coupled within the article of footwear 10.

Figure 15:
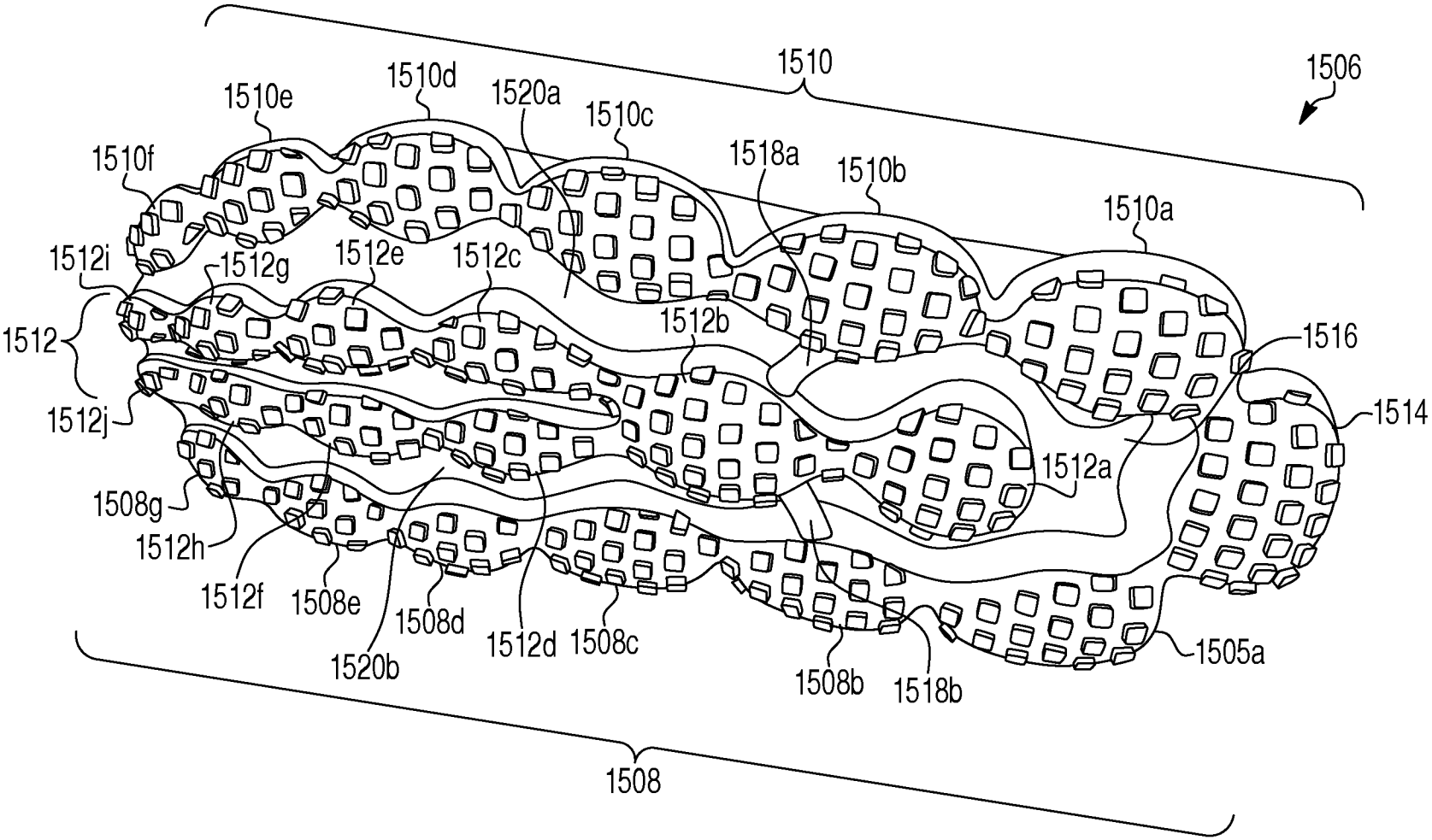
FIG. 15 is a perspective view of an alternative cushioning element.

FIG. 15 shows an alternative cushioning element 1506. The cushioning element 1506 includes a medial set of bulbs 1508, a lateral set of bulbs 1510, interior bulbs 1512, a posterior bulb 1514, a posterior web 1516, lateral bridge 1518*a*, medial bridge 1518*b*, lateral web 1520*a*, and medial web 1520*b*.

The medial set of bulbs 1508 includes a first bulb 1508*a*, a second bulb 1508*b*, a third bulb 1508*c*, a fourth bulb 1508*d*, a fifth bulb 1508*e*, and a sixth bulb 1508*f*. The lateral set of bulbs 1510 includes a first bulb 1510*a*, a second bulb 1510*b*, a third bulb 1510*c*, a fourth bulb 1510*d*, a fifth bulb 1510*e*, and a sixth bulb 1510*f*. The interior bulbs 1512 include a first bulb 1512*a*, a second bulb 1512*b*, a third bulb 1512*c*, a fourth bulb 1512*d*, a fifth bulb 1512*e*, a sixth bulb 1512*f*, a seventh bulb 1512*g*, an eighth bulb 1512*h*, a ninth bulb 1512*i*, and a tenth bulb 1512*j*.

The posterior web 1516 may separate the first bulb 1512*a* from the posterior bulb 1514, the first bulb 1510*a*, the first bulb 1508*a*, the second bulb 1510*b*, and the second bulb 1508*b*. The lateral bridge 1518*a* interconnects the second bulb 1510*b* to the second bulb 1512*b*. The medial bridge 1518*b* interconnects the second bulb 1508*b* to the second bulb 1512*b*. The lateral web 1520*a* separates the second bulb 1510*b*, the third bulb 1510*c*, the fourth bulb 1510*d*, the fifth bulb 1510*e*, and the sixth bulb 1510*f* from the second bulb 1512*b*, the third bulb 1512*c*, the fifth bulb 1512*e*, the seventh bulb 1512*g*, and the ninth bulb 1512*i*. The medial web 1520*b* separates the second bulb 1508*b*, the third bulb 1508*c*, the fourth bulb 1508*d*, the fifth bulb 1508*e*, and the sixth bulb 1508*f* from the second bulb 1512*b*, the fourth bulb 1512*d*, the sixth bulb 1512*f*, the eighth bulb 1512*h*, and the ninth bulb 1512*i*.

Figure 16:
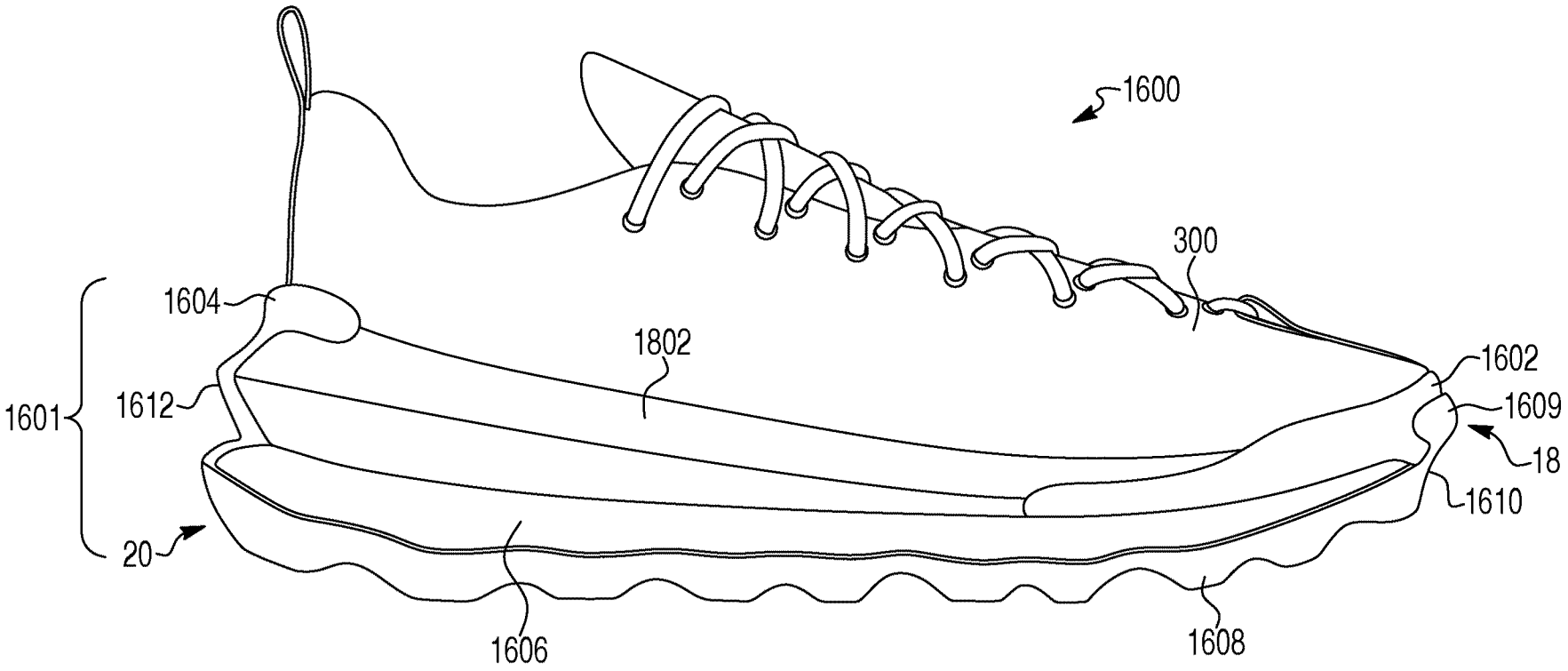
FIG. 16 is a side view of an alternative article of footwear.

FIG. 16 shows an alternative article of footwear 1600 with an alternate sole structure 1601 including a toe cap 1602, a heel cap 1604, a cushioning element 1606, and an outsole 1608. The article of footwear 1600 is similar to article of footwear 10. The article of footwear 1600 includes a midsole 1802 and upper 300. The toe cap 1602 is disposed at the anterior end 18 of the article of footwear 1600. The toe cap 1602 may extend around an entirety of the anterior end 18 from the medial side 22 to the lateral side 24. The toe cap 1602 may extend along the lateral and/or medial side of the article of footwear 1600 for about 10% to about 40% of the longitudinal length of the article of footwear 1600. The toe cap 1602 may extend along the lateral and/or medial side of the article of footwear 1600 for about 15% to about 35% of the longitudinal length of the article of footwear 1600. The toe cap 1602 may extend along the lateral and/or medial side of the article of footwear 1600 for about 20% to about 30% of the longitudinal length of the article of footwear 1600. The toe cap 1602 may extend along the lateral and/or medial side of the article of footwear 1600 for about 25% to about 27% of the longitudinal length of the article of footwear 1600.

In some embodiments, the toe cap 1602 is integrally formed with the cushioning element 1606. In other embodiments, the toe cap 1602 is integrally formed with the upper 300. In other embodiments, the toe cap 1602 may be attached or otherwise connected to either or both of the cushioning element 1606 and the upper 300. In an example, the toe cap 1602 is attached by adhesive, cement bonding, or any other suitable means for attaching the toe cap 1602 to either or both of the cushioning element 1606 and the upper 300.

Figure 17:
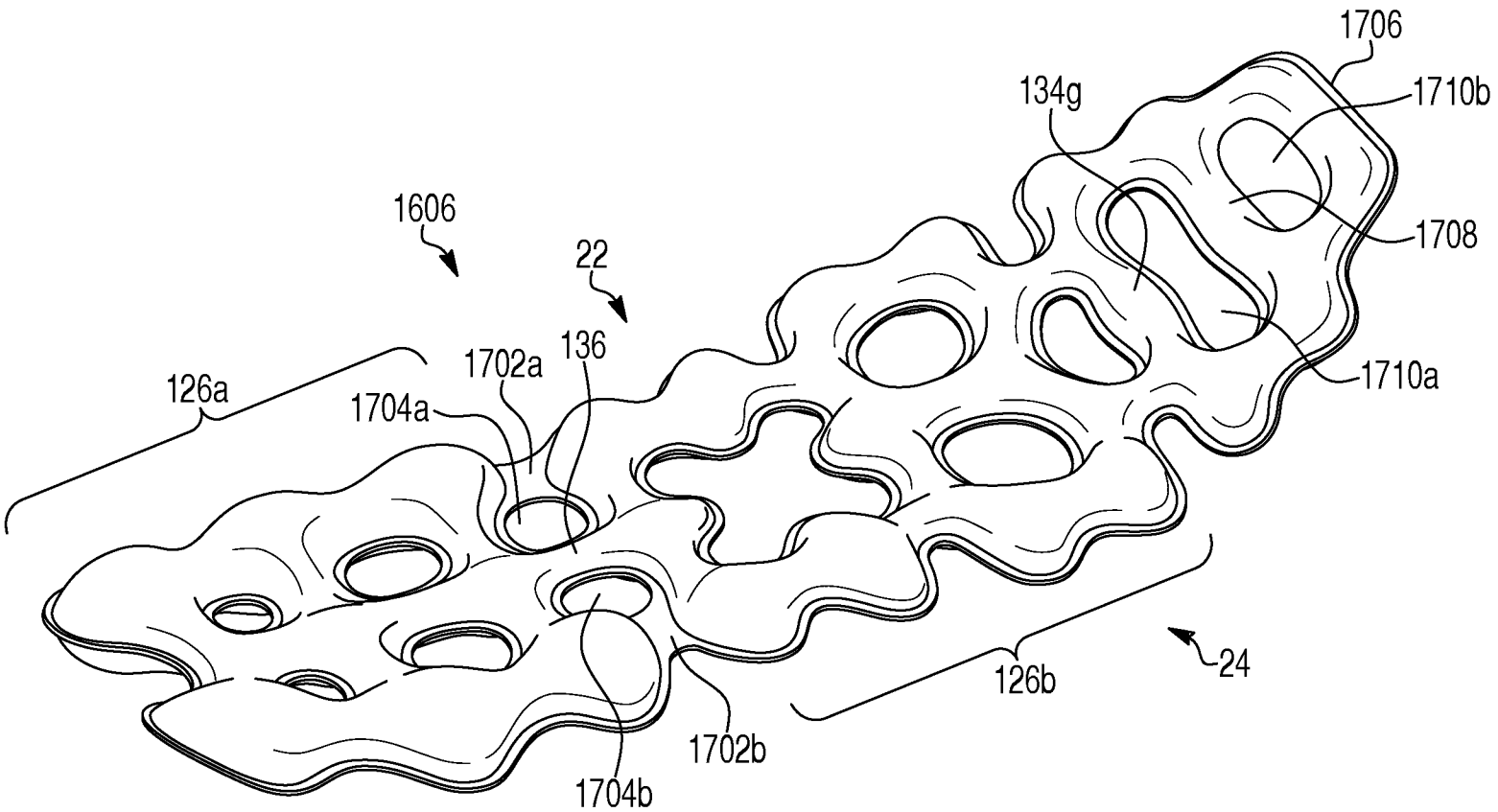
FIG. 17 is a top perspective view of a cushioning element of the alternative article of footwear of FIG. 16.

FIG. 17 depicts the cushioning element 1606, which is substantially similar to the cushioning element 106, except as indicated. The cushioning element 1606 includes webbing 1702*a* and webbing 1702*b*. Webbing 1702*a* is disposed on a medial side of the cushioning element 1606. Webbing 1702*b* is disposed on a lateral side of the cushioning element 1606. The webbing 1702*a* extends between the first set of bulbs 126*a* and the second set of bulbs 126*b*. The webbing 1702*b* extends between the first set of bulbs 126*a* and the second set of bulbs 126*b*. As is described in greater detail below, the webbings 1702*a* and 1702*b* are portions of the cushioning element 1606 where the films 216 and 218 are joined together.

Webbing 1702*a* and neck 136 enclose an opening 1704*a*. Webbing 1702*b* and neck 136 enclose an opening 1704*b*. Both of openings 1704*a* and 1704*b* are substantially similar in shape to the plurality of openings 128*a*.

The cushioning element 1606 further includes an anterior bulb 1706 and a central bulb 1708 posterior to the anterior bulb 1706. The central bulb 1708, and central bulb 134*g* fully enclose an opening 1710*a*. The opening 1710*a* is similarly formed as third opening 128*c*. The opening 1710*a* has a first width. The anterior bulb 1706 and the central bulb 1708 fully enclose an opening 1710*b*. The opening 1710*b* is similarly formed as opening 1710*a*. The opening 1710*b* has a second width different from the first width. In an example, the first width is greater than the second width. In another example, the first width is less than the second width. In yet another example, the first width is equal to the second width.

The anterior bulb 1706, the central bulb 1708, the opening 1710*a*, and the opening 1710*b* replace the mouth 129 and the exposed portions 127*a*, 127*b*, and 127*c* of cushioning element 106.

The cushioning element 1606 is a fluid-filled cushioning element, such as an airbag or bladder. The cushioning element 1606 may comprise a barrier material, similar to cushioning element 106. The cushioning element 1606 may be used in any of the articles of footwear 10, 1000, or 1400.

Figure 18:
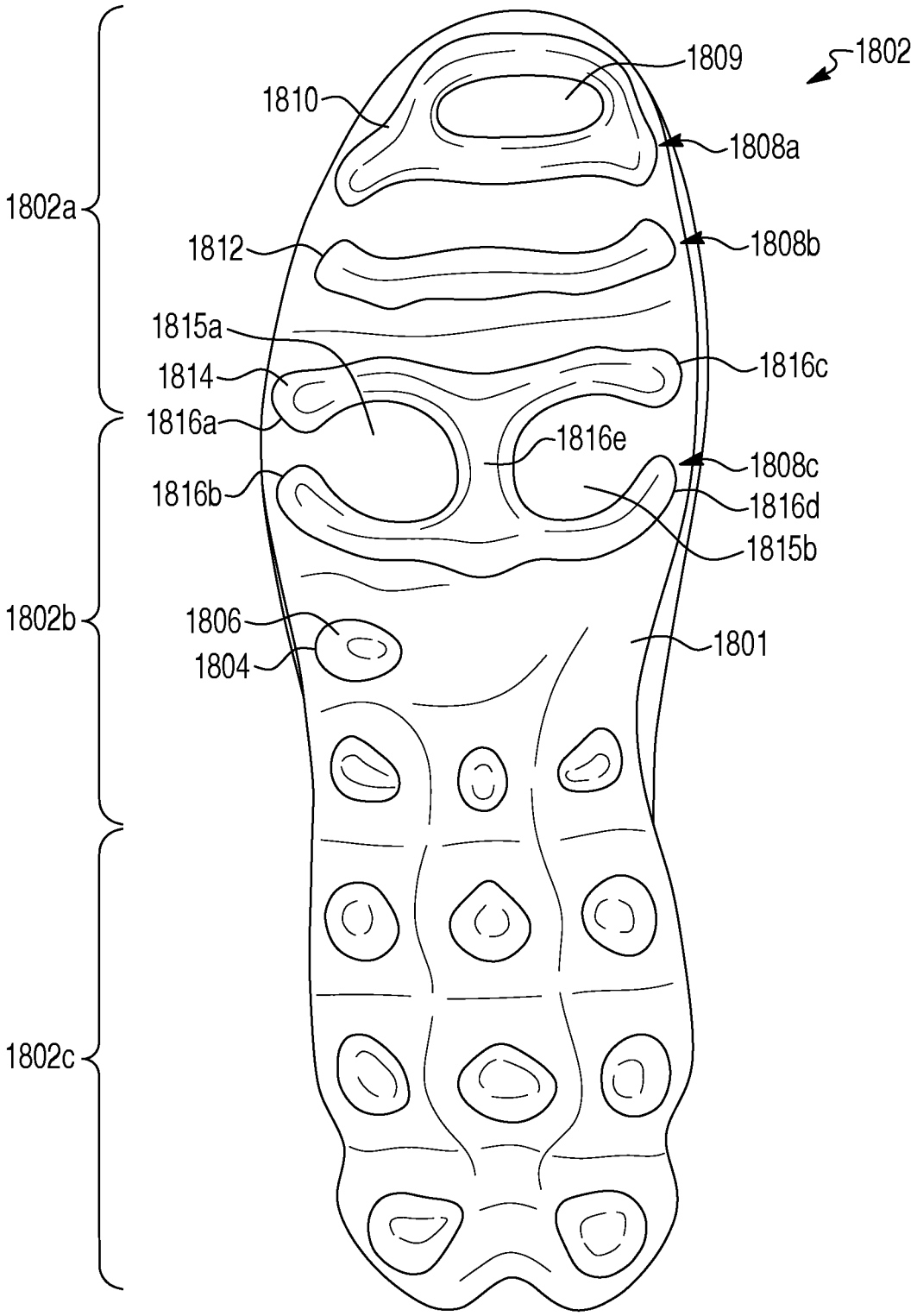
FIG. 18 is a bottom view of a cushioning element of the alternative article of footwear of FIG. 16.

FIG. 18 depicts the alternative midsole 1802. Midsole 1802 is similar to midsole 102, except as indicated below. The midsole 1802 comprises a first surface 1801. Midsole 1802 includes an additional extension 1804 with a pocket 1806. The midsole 1802 further includes one or more engagement features.

The one or more engagement features includes a first engagement zone 1808*a*, a second engagement zone 1808*b*, and a third engagement zone 1808*c*. The first engagement zone 1808*a* is disposed entirely within an anterior portion 1802*a* of the midsole 1802. The second engagement zone 1808*b* is disposed entirely within the anterior portion of the midsole 1802. The second engagement zone 1808*b* may be positioned nearer a posterior portion 1802*c* of the midsole than the first engagement zone 1808*a*. The third engagement zone 1808*c* is disposed between the anterior portion and a midfoot portion 1802*b* of the midsole 1802.

The first engagement zone 1808*a* includes a depression 1810.

Depression 1810 surrounds a portion of the first surface 1801 disposed in the anterior portion 1802*a* of the midsole 1802. This portion of the first surface 1801 is plateau 1809. Plateau 1809 may be substantially ovular in shape. Depression 1810 may be substantially circular in shape. Depression 1810 may be irregular in shape. Depression 1810 may have a corresponding shape to engage respective portions of the cushioning element 1606.

The second engagement zone 1808*b* is disposed within the anterior portion 1802*a* of the midsole 1802. The second engagement zone 1808*b* includes a depression 1812. The depression 1812 is substantially semi-circular in shape. The second engagement zone 1808*b* and the depression 1812 may include any shape suitable for engaging respective portions of the cushioning element 1806.

The third engagement zone 1808*c* is disposed between the anterior portion 1802*a* of the midsole 1802 and the midfoot portion 1802*b* of the midsole 1802. The third engagement zone 1808*c* may substantially resemble a sideways H. The third engagement zone 1808*c* includes a depression 1814. The depression 1814 includes a plurality of branches surrounding portions of the first surface 1801. For example, the plurality of branches may be separated by a first portion 1815*a* of the first surface 1801 at a first side of the midsole 1802. The plurality of branches may be separated by a second portion 1815*b* of the first surface 1801.

The plurality of branches includes a first branch 1816*a*, a second branch 1816*b*, a third branch 1816*c*, and a fourth branch 1816*d*. The first branch 1816*a* and the second branch 1816*b* are disposed on a first side of the depression 1814. The third branch 1816*c* and the fourth branch 1816*d* are disposed on a second side of the depression 1814. The first branch 1816*a*, the second branch 1816*b*, the third branch 1816*c*, and the fourth branch 1816*d* are in fluid communication with one another and connect at a connecting area 1816*e*. The first branch 1816*a* and the second branch 1816*b* extend from the connecting area 1816*e* towards an outer portion of the midsole 1802 in a lateral-medial direction. The third branch 1816*c* and the fourth branch 1816*d* extend from the connecting area 1816*e* towards an outer portion of the midsole 1802 in the lateral-medial direction opposite the outer portion of the midsole 1802 with the first branch 1816*a* and the second branch 1816*b*. The connecting area 1816*e* extends in a posterior-anterior direction.

Figure 19:
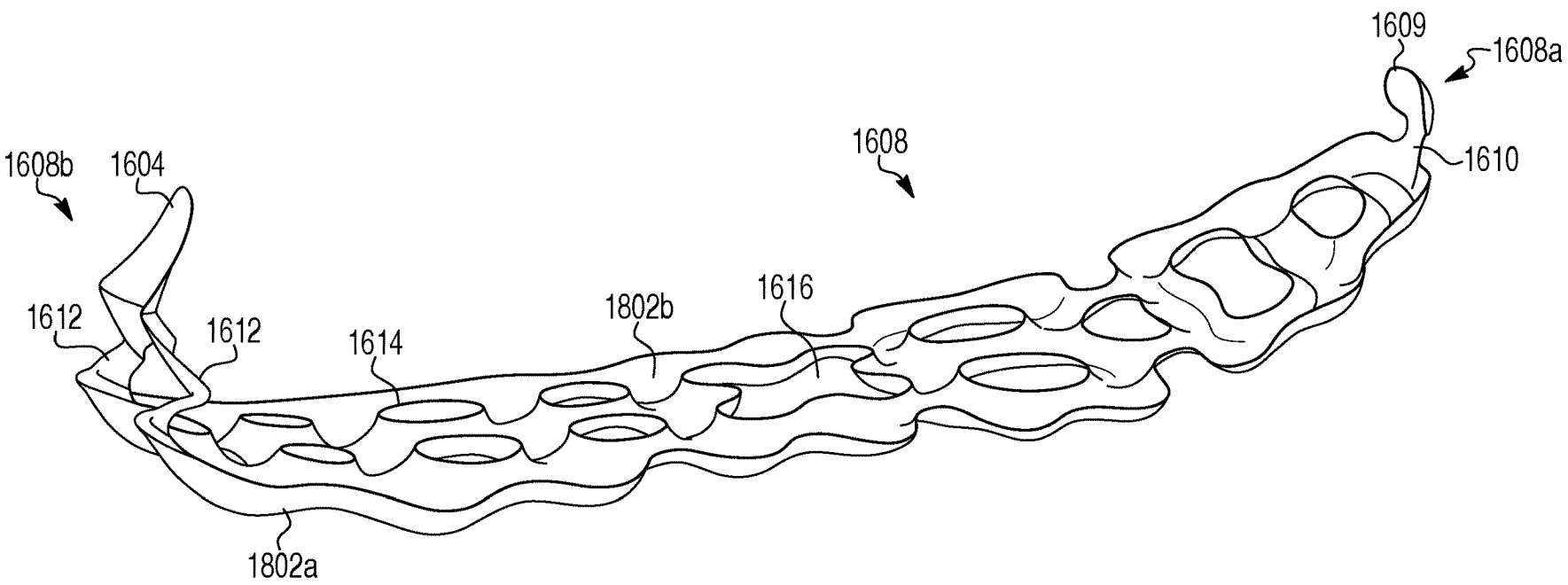
FIG. 19 is a perspective view of an outsole of the alternative article of footwear of FIG. 16.

FIG. 19 illustrates a perspective view of the outsole 1608. The outsole 1608 includes an anterior end 1608*a* and a posterior end 1608*b*. The outsole 1802 includes a first surface 1802*a* (best shown in FIG. 21) disposed facing a ground surface, and a second surface 1802*b* disposed facing the upper 300. The outsole 1608 further includes a toe portion 1609. Toe portion 1609 is disposed at the anterior end 1608*a* of the outsole 1608. The toe portion 1609 includes a connecting portion 1610. The connecting portion 1610 extends between the toe portion 1609 and the cushioning element 1606. The heel cap 1604 is disposed at the posterior end 1608*b* of the outsole 1608.

The heel cap 1604 is disposed at the posterior end 20 of the article of footwear 1600. The heel cap 1604 may extend around a portion of the posterior end 20 from the medial side 22 to the lateral side 24. When integrally formed with the cushioning element 1606, the heel cap 1604 includes a connecting portion 1612. The connecting portion 1612 extends between the heel cap 1604 and the cushioning element 1606. In some embodiments, the heel cap 1604 is integrally formed with the cushioning element 1606. In other embodiments, the heel cap 1604 is integrally formed with the upper 300. In other embodiments, the heel cap 1604 may be attached or otherwise connected to either or both of the cushioning element 1606 and the upper 300.

The second surface 1802*b* includes a plurality of raised portions 1614. Each respective raised portion 1614 includes a cavity 1616. The plurality of raised portions 1614 and their respective cavities 1616 have a corresponding shape to respective portions of the cushioning element 1606. For example, the plurality of raised portions may be a circular shape, a rectangular shape, an X-shape, an irregular shape, or any other shape suitable for engaging adjacent portions of the cushioning element 1606.

Figure 20:
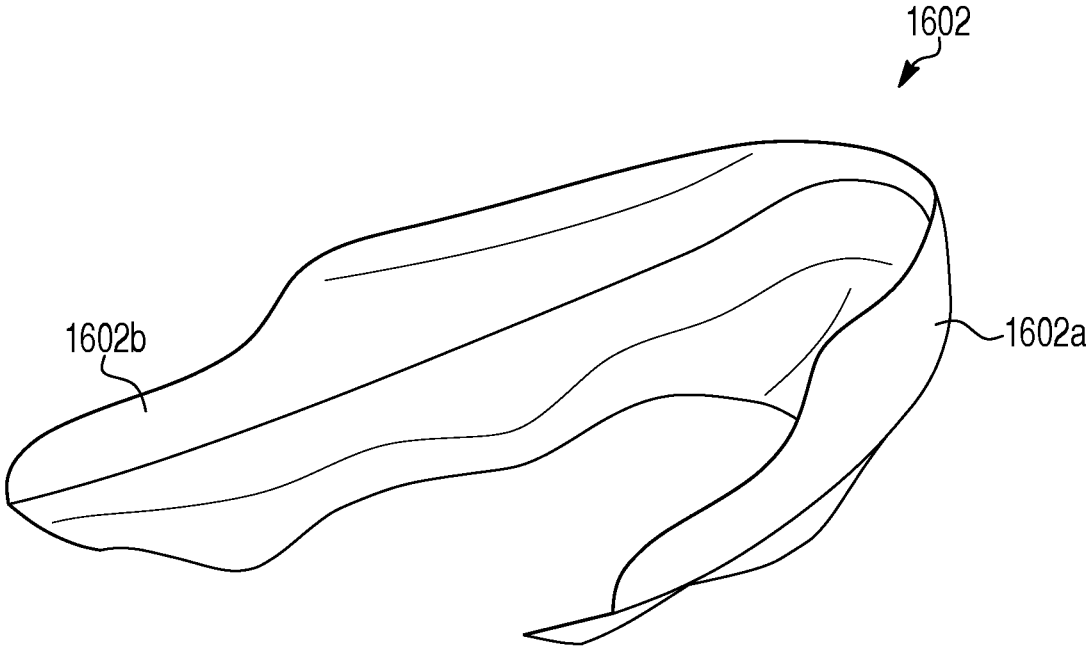
FIG. 20 is a perspective view of a toe cap of the alternative article of footwear of FIG. 16.

As shown in FIG. 20, the toe cap 1602 includes a first (outer) surface 1602*a* and a second (inner) surface 1602*b*. The toe cap 1602 may be comprised of material that is similar to a material of the upper 300. In some embodiments, the toe cap 1602 is comprised of a woven material. In other embodiments, the toe cap 1602 is comprised of a material that is transparent. In other embodiments, the toe cap 1602 is comprised of a material that is translucent. In other embodiments, the toe cap 1602 is comprised of a material that is opaque.

Figure 21:
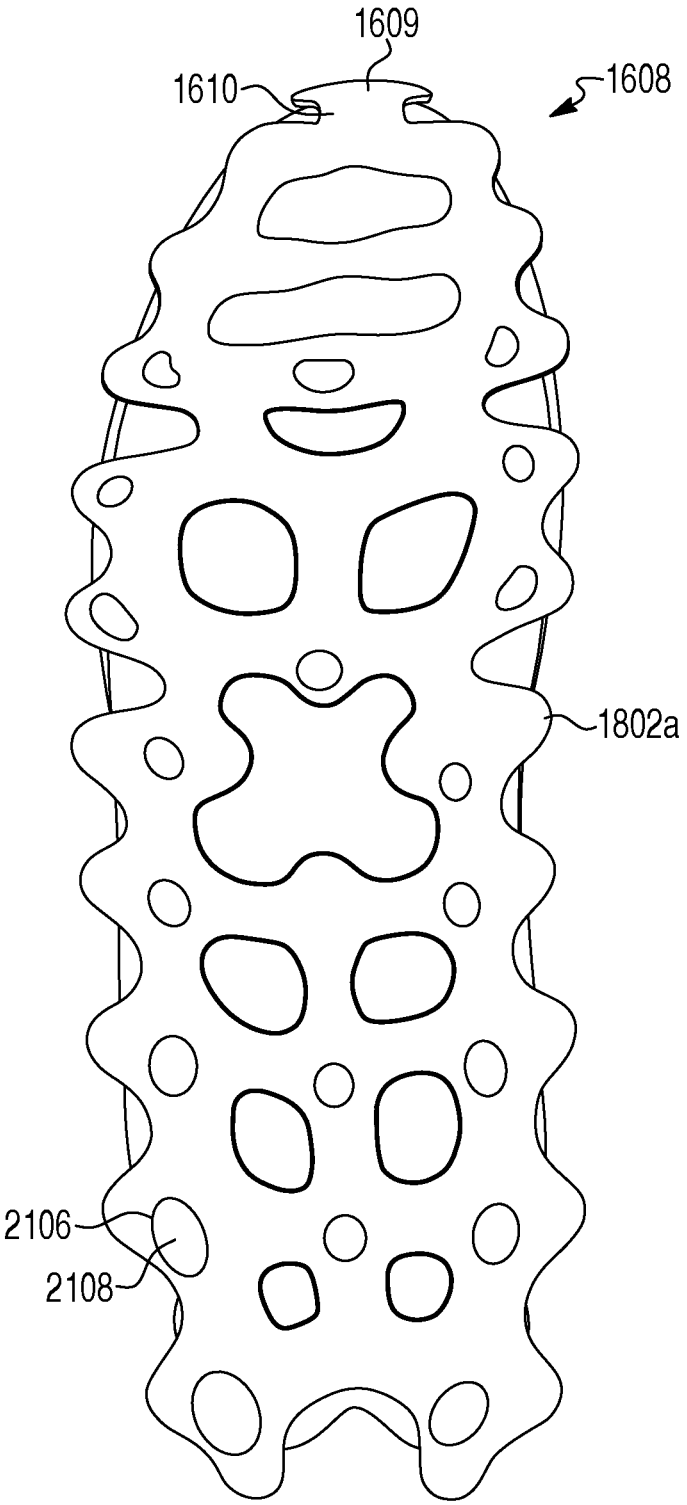
FIG. 21 is a bottom view of the alternative article of footwear of FIG. 16.

FIG. 21 depicts a bottom view of the alternative outsole 1608 of the article of footwear 1600. The outsole 1802 includes a plurality of lugs 2106. The plurality of lugs 2106 are disposed on the first surface 1802*a* and positioned directly opposite a central portion of a respective bulb of the cushioning element 1606. The plurality of lugs 2106 include a face 2108. The face 2108 faces a ground surface. The plurality of lugs 2106 extend past the first surface 1802*a* such that when the article of footwear 1600 contacts a ground surface, the plurality of lugs 2106 and face 2108 contact the ground prior to other portions of the outsole 1608 contacting the ground. In other words, the face 2108 of the lug 2106 is disposed on a plane that is horizontally offset and disposed closer to a ground surface than is disposed a plane of the outsole 1608. In this way, the lugs 2106 are configured to compress and impart force upon respective portions of the cushioning element 1606.

Figure 22:
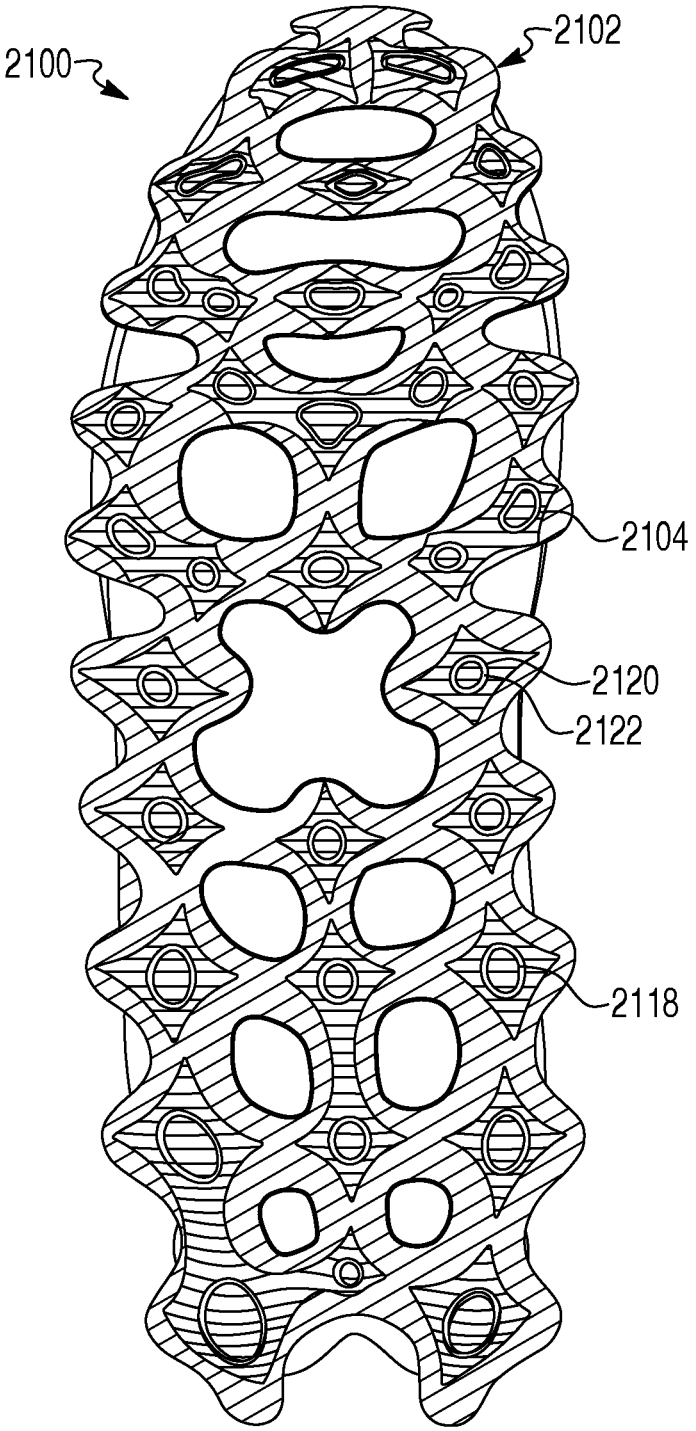
FIG. 22 is a bottom view of an outsole of an alternative article of footwear.

FIG. 22 depicts a bottom view of an alternative outsole 2102 of an article of footwear 2100. The outsole 2102 includes a plurality of lugs 2118, similar to the plurality of lugs 2106 of FIG. 21. The outsole 2102 further includes textured elements 2104 configured to engage a ground surface. The textured elements 2104 may include any shape such as star, diamond, rectangular, ovular, or any desired shape to provide a desired form of traction and/or cushioning to the article of footwear 2100. The textured elements 2104 include a well 2122. The well 2122 is formed centrally within a respective textured element 2104. The plurality of lugs 2118 are disposed within each well 2122 of the respective textured elements 2104. The plurality of lugs 2118 and the textured elements 2104 protrude away from the outsole 2102, toward the ground surface. In this way, the lugs 2118 and textured elements 2104 are configured to compress and impart force upon respective portions of a cushioning element (e.g., cushioning element 1606).

Figure 22A:
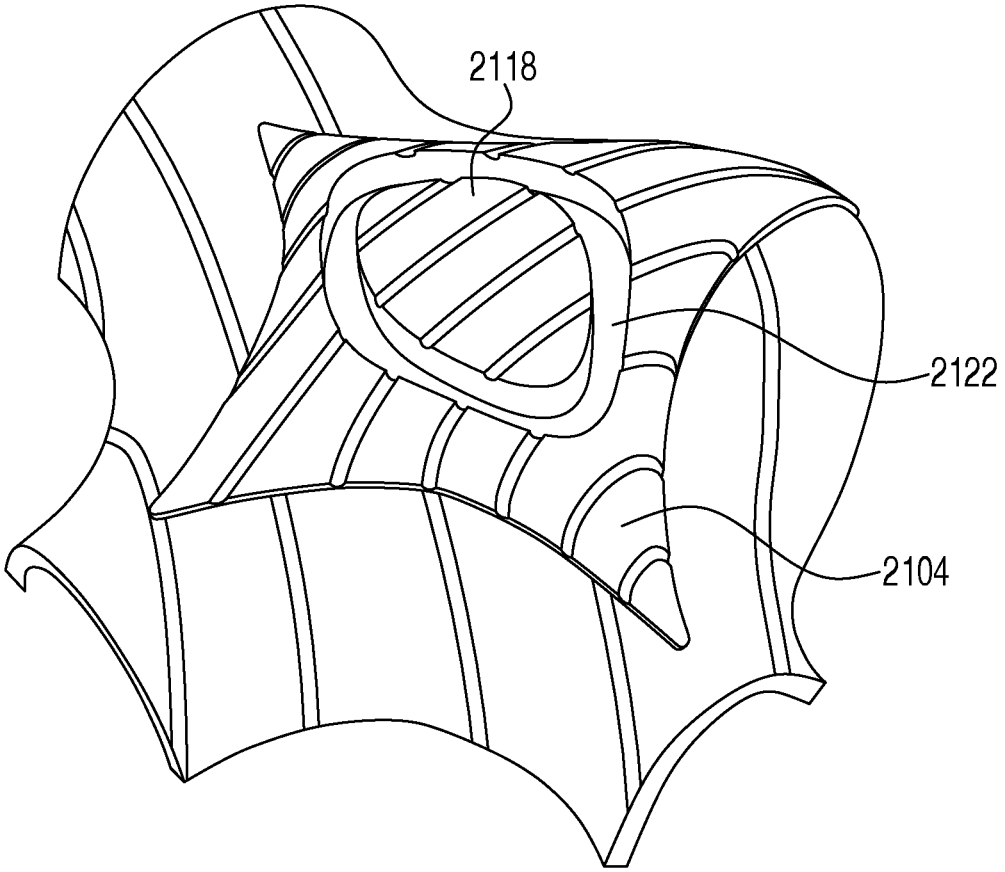
FIG. 22A is a zoomed in perspective view of a portion of the outsole of FIG. 22.

FIG. 22A depicts a zoomed in perspective view of the outsole 2102 and the textured elements 2104.

Figure 23:
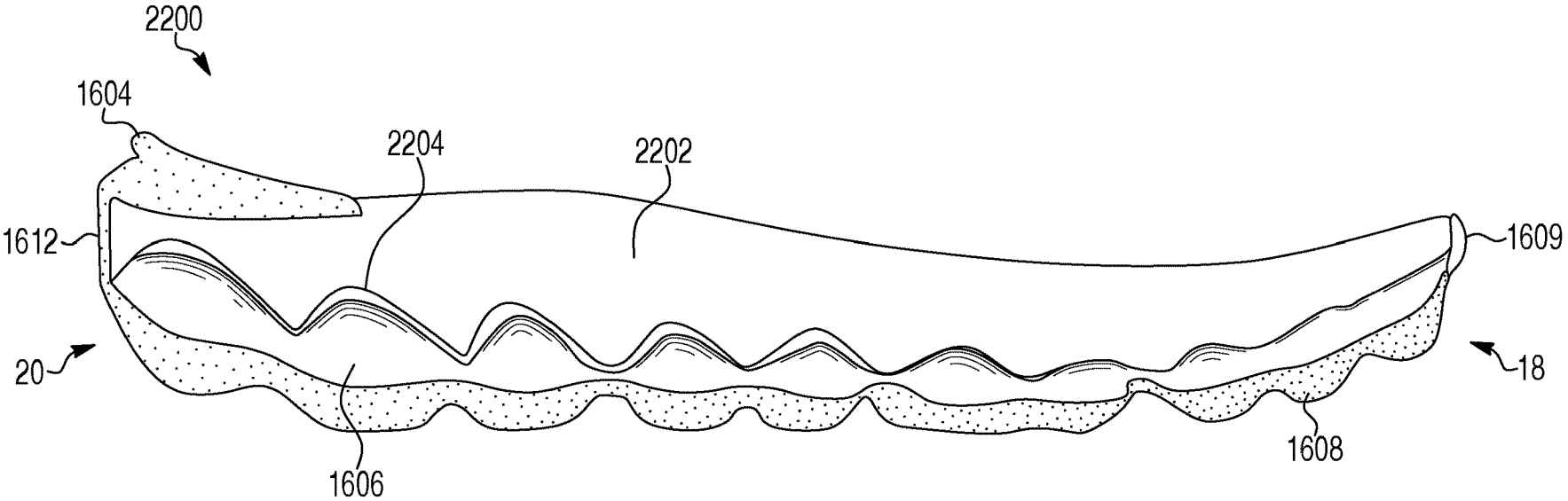
FIG. 23 is a side view of an alternative article of footwear.

FIG. 23 depicts a side view of an alternative sole structure 2200. The sole structure 2200 is substantially similar to sole structure 1601, except that a midsole 2202 includes flanges 2204 and the midsole 2202 is attached to outer portions of the upper 300. In other words, midsole 1802 is not removably disposed within the upper 300 and midsole 2202 is permanently affixed to outer portions of the upper 300. Radial outermost surface of the midsole 1802 are exposed to the external environment. Flanges 2204 hood portions of the cushioning element 1606. In other words, flanges 2204 extend above a portion of the cushioning element 1606 such that a gap is formed between the flanges 2204 and the cushioning element 1606. Flanges 2204 continuously extend from the anterior end 18 to the posterior end 20. Flanges 2204 form a wave pattern. Flanges 2204 may form any pattern as desired to provide protection to portions of the cushioning element 1606.

Figure 24:
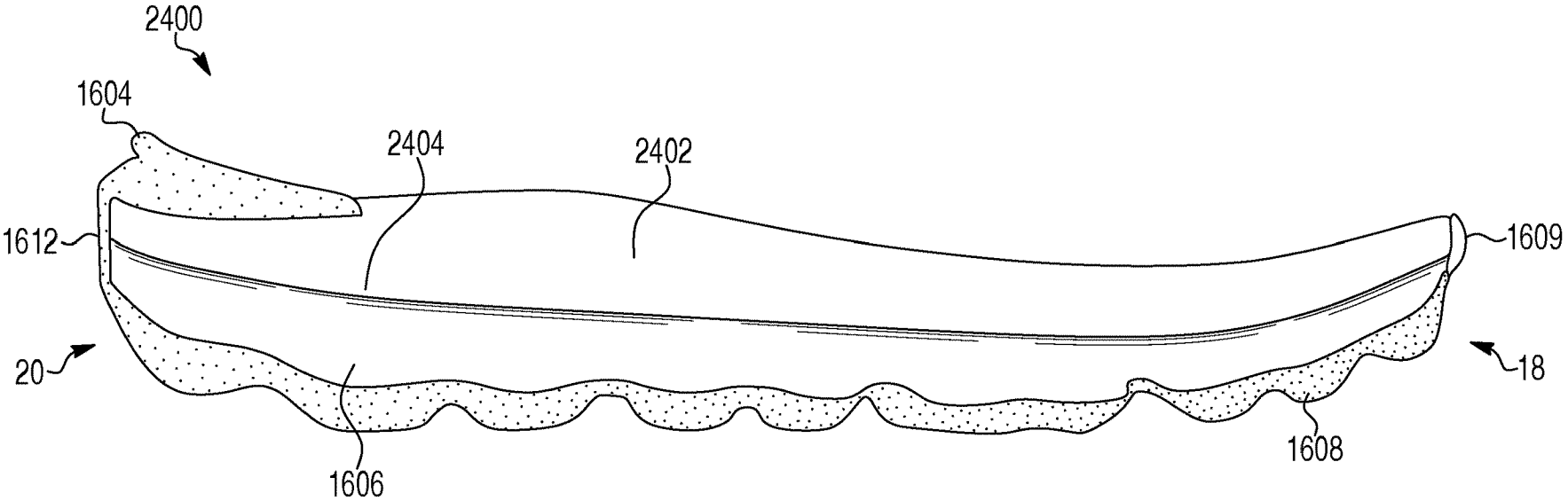
FIG. 24 is a side view of an alternative article of footwear.

FIG. 24 depicts a side view of an alternative article of footwear 2400. Article of footwear 2400 includes a midsole 2402 not including any flanges 2204. Midsole 2400 and cushioning element 1606 are continuously coupled from the anterior end 18 to the posterior end 20.

In some examples, portions of the cushioning element 106 formed by the upper and lower films 216, 218 may be formed by respective mold portions during a thermoforming process. Each mold portion may define various surfaces for forming depressions and pinched surfaces corresponding to locations where the peripheral seam 122 are formed when the upper film 216 and the lower film 218 are joined and bonded together. In some examples, adhesive bonding may join the upper film 216 and the lower film 218 to form the peripheral seam 122. In other examples, the upper film 216 and the lower film 218 may be joined to form the peripheral seam 122 by thermal bonding. In some examples, one or both of the films 216, 218 may be heated to a temperature that facilitates shaping and melding. In some examples, the films 216, 218 may be heated prior to being located between their respective molds. In other examples, the mold may be heated to raise the temperature of the films 216, 218. In some implementations, a molding process used to form the cushioning element 106 may incorporate vacuum ports within mold portions to remove air such that the upper and lower films 216, 218 are drawn into contact with respective mold portions. In other examples, fluids such as air may be injected into areas between the upper and lower films such that pressure increases cause the films to engage with surfaces of their respective mold portions. The fluid may be injected into cushioning element 106 until a desired pressure is achieved.

As used herein, the term "barrier film" (e.g., barrier films) encompasses both monolayer and multilayer films. In some examples, one or both of barrier films 216, 218 are each produced (e.g., thermoformed or blow molded) from a monolayer film (a single layer). In other examples, one or both of barrier films 216, 218 are each produced (e.g., thermoformed or blow molded) from a multilayer film (multiple layers).

The multi-layered film 216, 218 may comprise a plurality of layers. The plurality of layers may comprise one or more barrier layers. The one or more barrier layers may comprise a barrier material. The barrier material may comprise or consist essentially of one or more gas barrier compounds. The multi-layered film may comprise at least 5 layers or at least 10 layers. In other embodiments, the multi-layered film may comprise from about 5 layers to about 400 layers. In one aspect of a multi-layered film, the plurality of layers may include a series of alternating layers, in which the alternating layers include two or more barrier layers. Each of the two or more barrier layers may individually comprise a barrier material, the barrier material comprising or consisting essentially of one or more gas barrier compounds. In the series of alternating layers, adjacent layers may be individually formed of materials which differ from each other at least in their chemical compositions based on the individual components present (e.g., the materials of adjacent layers may differ based on whether or not a gas barrier compound is present, or differ based on class or type of gas barrier compound present), the concentration of the individual components present (e.g., the materials of adjacent layers may differ based on the concentration of a specific type of gas barrier compound present), or may differ based on both the components present and their concentrations.

The barrier film may be a multi-layered film comprising a plurality of layers, the plurality of layers including one or more layers comprising, consisting essentially of, or consisting of one or more barrier materials, the one or more barrier materials comprising, consisting essentially of, or consisting of one or more gas barrier compounds. The one or more gas barrier compounds may comprise, consist essentially of, or consist of one or more gas barrier polymers. The multi-layered film may comprise a total of at least 5 layers or at least 10 layers. The multi-layered film may comprise at least 5 barrier layers or at least 10 barrier layers. The multi-layered film may comprise a total of from about 5 to about 200 layers, from about 10 to about 100 layers, from about 20 to about 80 layers, from about 20 to about 50 layers, or from about 40 to about 90 layers. The multi-layered film may comprise from about 5 to about 200 barrier layers, from about 10 to about 100 barrier layers, from about 20 to about 80 barrier layers, from about 20 to about 50 barrier layers, or from about 40 to about 90 barrier layers.

The plurality of layers of the multi-layered film may include a series of alternating layers, wherein the alternating layers include two or more barrier layers, each of the two or more barrier layers individually comprising a barrier material, the barrier material comprising, consisting essentially of, or consisting of one or more gas barrier compounds. Optionally, the one or more gas barrier compounds may comprise, consist essentially of, or consist of one or more gas barrier polymers, one or more non-polymeric gas barrier compounds, or a mixture of one or more gas barrier polymers and one or more non-polymeric gas barrier compounds. In the series of alternating layers, adjacent layers are individually formed of materials which differ from each other at least in their chemical compositions based on the individual components present in the materials forming the adjacent layers. For example, the materials of adjacent layers may differ based on whether or not a gas barrier compound is present, or may differ based on a class or type of gas barrier compound present (e.g., may differ based on whether or not a gas barrier polymer is present, or whether or not a non-polymeric gas barrier compound is present), or may differ based on a concentration of an individual compound present (e.g., may differ based on the concentration of a gas barrier compound present), or any combination thereof. In one example, the series of alternating layers of a multi-layer barrier film may include barrier layers comprising, consisting essentially of, or consisting of a polymeric barrier compound, and layers which are substantially free of the polymeric barrier compound. In another example, the series of alternating layer of a multi-layer barrier film may include barrier layers consisting essentially of a polymeric barrier compound, and layers of a polymeric material comprising a mixture of one or more non-barrier polymers and less than about 20 weight percent of the polymeric barrier compound based on the total weight of the polymeric material. The multi-layered film may have a gas transmittance rate as described herein.

The plurality of layers of the multi-layered film may include first barrier layers comprising a first barrier material and second barrier layers comprising a second barrier material, wherein the first and second barrier materials comprise first and second gas barrier compounds which differ from each other either based on their chemical structures or based on their concentration in the barrier material or based on both their chemical structures and their concentrations in the barrier material. The first barrier material may comprise, consist essentially of, or consist of a first gas barrier component, the first gas barrier component consisting of all the gas barrier compounds present in the first barrier material. Similarly, the second barrier material may comprise, consist essentially of, or consist of a second gas barrier component, the second barrier material component consisting of all the gas barrier compounds present in the second barrier material. In a first example, the first barrier component may consist of one or more one gas barrier polymers, and the second barrier component may consist of one or more inorganic gas barrier compounds. In a second example, the first barrier component may consist of a first gas barrier polymer, and the second component may consist of a second gas barrier polymer, wherein the first gas barrier polymer differs from the second gas barrier polymer based on its chemical structure, for example, based on the chemical structures of the monomers or oligomers used to make the polymers, or based on molecular weight of the polymers, or based on both. In a third example, the first barrier component and the second barrier component may both include one or more of the same gas barrier compounds, but the concentration of the gas barrier compounds in the first barrier material and the second barrier material may differ, optionally the concentrations may differ by at least 5 weight percent based on the weight of the barrier material. In the multi-layered film, the first barrier layers and the second barrier layers may alternate with each other, or may alternate with additional barrier layers (e.g., third barrier layers comprising a third barrier material, fourth barrier layers comprising a fourth barrier material, etc., wherein each of the first, second, third, and fourth, etc., barrier materials differ from each other as described above). The multi-layer film may have a gas transmittance rate as described herein.

In addition to the one or more barrier layers (e.g., one or more first barrier layers, one or more second barrier layers, etc.), the multi-layered film may further comprise one or more second layers, the one or more second layers comprising a second material. The one or more second layers may comprise or consist of non-barrier layers, i.e., layers which do not include a barrier material, and which may have a relatively high gas permeation rate. The second layers, including the non-barrier layers, may comprise a polymeric material, such as a thermoplastic material, an elastomeric material, or a thermoplastic elastomeric material. The second material of the second layers may comprises one or more polymers. In one such configuration of the multi-layered film, the one or more barrier layers comprise or consist of a plurality of barrier layers alternating with a plurality of second layers. Each of the one or more barrier layers may be positioned between two second layers (e.g., with one second layer positioned on a first side of the barrier layer, and another second layer on a second side of the barrier layer, the second side opposing the first side). Optionally the concentrations may differ by at least 5 weight percent based on the weight of the barrier material. In these multi-layered films, the first barrier layers and the second barrier layers may alternate with each other, or may alternate with additional barrier layers (e.g., third barrier layers comprising a third barrier material, fourth barrier layers comprising a fourth barrier material, etc., wherein each of the first, second, third and fourth, etc., barrier materials differ from each other as described above).

In either example, each layer can have a film thickness ranging from about 0.2 micrometers to about 1 millimeter. In further examples, the film thickness for each layer can range from about 0.5 micrometers to about 500 micrometers. In yet further examples, the film thickness for each layer can range from about 1 micrometer to about 100 micrometers.

The lower barrier film 218 may have a greater thickness than the upper barrier film 216. It is contemplated that the upper barrier film may have a greater thickness than the lower barrier film. It is also contemplated that the lower barrier film may have a thickness that is equal to the upper barrier film.

One or both of barrier films may independently be transparent, translucent, and/or opaque. For example, the upper barrier film may be transparent, while the lower barrier film is opaque. It is contemplated that upper barrier film may be transparent or translucent, while lower barrier film is opaque, or upper barrier film may be opaque, while lower barrier film is transparent or translucent, etc. As used herein, the term "transparent" for a barrier film and/or a fluid-filled chamber means that light passes through the barrier film in substantially straight lines and a viewer can see through the barrier film. In comparison, for an opaque barrier film, light does not pass through the barrier film and one cannot see clearly through the barrier film at all. A translucent barrier film falls between a transparent barrier film and an opaque barrier film, in that light passes through a translucent film but some of the light is scattered so that a viewer cannot see clearly through the film.

The cushioning element 106 may be produced from barrier films using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an example, barrier films may be produced by co-extrusion followed by vacuum thermoforming to produce an inflatable cushioning element of the one or more cushioning element, which may optionally include one or more valves (e.g., one way valves) that allows the cushioning element to be filled with a fluid (e.g., gas) and formed as a fluid-filled barrier.

Barrier films may each be produced from an elastomeric material that includes one or more thermoplastic polymers and/or one or more cross-linkable polymers. In an example, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C—O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular examples, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another example, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials as well as with the TPU copolymers described herein and optionally including combinations of polyimides and crystalline polymers, are also suitable.

The barrier films may be multi-layer films including two or more layers. Barrier films may each independently include alternating layers of one or more TPU copolymer materials and one or more EVOH copolymer materials, where the total number of layers in each of barrier films includes at least four (4) layers, at least ten (10) layers, at least twenty (20) layers, at least forty (40) layers, and/or at least sixty (60) layers.

The cushioning elements described herein are resilient structures configured to retain a fluid, particularly a gas. Typically, the fluid needs to be retained over an intended lifetime of the cushioning element, including when the cushioning element is exposed to repeated cycles of applying and releasing force or pressure, as would be encountered when the cushioning element is used in an article of footwear. As many of the polymeric materials conventionally used to manufacture consumer goods are relatively impermeable to water and aqueous solutions but are permeable to small gas molecules such as air, oxygen ($O_2$) gas and nitrogen ($N_2$) gas and inert gasses, barrier materials, i.e., materials which have relatively low rates of fluid transmittance, and so provide relatively high levels of liquid and gas retention to the cushioning element, may be used alone or in combination with conventional polymeric materials. Thus, the cushioning elements described herein, including the various structures forming the cushioning elements, may comprise, consist essentially of, or consist of a barrier material. The inclusion of the barrier material in the cushioning element may allow the cushioning element to retain a fluid, such as small gas molecules, over the lifetime of the cushioning element. The inclusion of the barrier material in the cushioning element may allow the cushioning element to remain adequately pressurized over its lifetime. The cushioning element may retain a minimum pressure of about 2 PSI (14 kPA) to about 40 PSI (276 kPA) over a minimum duration of about 5 years to about 30 years.

As used herein, a barrier material refers to a material comprising, consisting essentially of, or consisting of one or more gas barrier compounds. The gas barrier compound may be a polymeric gas barrier compound (i.e., a gas barrier polymer), or may be a non-polymeric gas barrier compound, such as an inorganic gas barrier compound. The barrier material may be a polymeric barrier material comprising, consisting essentially of, or consisting of one or more gas barrier polymers. The barrier material may be a polymeric barrier material comprising, consisting essentially of, or consisting of a mixture of one or more non-gas barrier polymers and one or more gas barrier polymers, or a barrier material comprising, consisting essentially of, or consisting of a mixture of one or more non-gas barrier polymers and one or more non-polymeric gas barrier compounds. The barrier material may comprise, consist essentially of, or consist of a non-polymeric barrier material, i.e., a material comprising, consisting essentially of, or consisting of a non-polymeric gas barrier compound. The barrier material may be present in a structure which includes regions of polymeric materials and non-polymeric barrier materials, such as a polymeric film coated with one or more layers of a non-polymeric barrier material. The gas transmission rate of the portion of the cushioning element comprising the barrier material may be less than 4 or less than 3 or less than 2 cubic centimeters per square meter per atmosphere per day per day. The portion of the cushioning element comprising the barrier material may be a portion of a cushioning element, an entire cushioning element, a portion of a web area, an entire web area, or any combination thereof. The cushioning element may comprise a barrier film comprising the barrier material. The portion of the cushioning element comprising the barrier film may be a portion of a cushioning element, an entire cushioning element, a portion of a web area, an entire web area, or any combination thereof. The gas transmission rate of the barrier film may be less than 4 or less than 3 or less than 2 cubic centimeters per square meter per atmosphere per day per day for a barrier film having a thickness of from about 72 micrometers to about 320 micrometers, as measured at 23 degrees Celsius and 0 percent relative humidity. The gas transmission rate of the barrier film may be from about 0.1 to about 3, or from about 0.5 to about 3, or from about 0.5 to about 3 cubic centimeters per square meter per atmosphere per day per day, including from about 0.1 to about 3, or from about 0.5 to about 3, or from about 0.5 to about 3 cubic centimeters per square meter per atmosphere per day per day for a film having a thickness of from about 72 micrometers to about 320 micrometers, as measured at 23 degrees Celsius and 0 percent relative humidity. The gas transmission rate, such as the oxygen gas or nitrogen gas transmission rate, may be measured using ASTM D1434.

The barrier material may comprise, consist essentially of, or consist of one or more non-polymeric gas barrier compounds, including one or more inorganic gas barrier compounds. The one or more inorganic gas barrier compounds may be chosen from a form of carbon, silica, silicate, clay, a metal, an any combination thereof. The metal may include a metal oxide or a metal alloy. The one or more inorganic gas barrier compounds may take the form of fibers, particulates, platelets, or combinations thereof. The fibers, particulates, or platelets may be nanoscale structures, including nanoscale fibers, nanoscale particulates, nanoscale platelets, and combinations thereof. Examples of inorganic barrier compounds include carbon fibers, glass fibers, glass flakes, silica particles, silica platelets, silica flakes, silicate particles, silicate platelets, silicate flakes, calcium carbonate particles, clay particles, clay platelets, mica platelets, talc particles, carbon black particles, graphite particles, graphite platelets, graphite flakes, metallic particles, metallic platelets, metallic flakes, and the like. The barrier material may comprise an inorganic gas barrier component consisting of all the inorganic gas barrier compounds present in the barrier material. The inorganic gas barrier component may consist of one or more clays. Suitable clays include bentonite, montmorillonite, kaolinite, and mixtures thereof. Optionally, in addition to the one or more non-polymeric gas barrier compounds, the barrier material may further comprise one or more additional ingredients, such as a polymer, processing aid, colorant, or any combination thereof. When one or more inorganic gas barrier compounds are included in the barrier material, the total concentration of the inorganic gas barrier component present in the barrier material may be less than 60 weight percent, or less than 40 weight percent, or less than 20 weight percent of the barrier material.

The one or more gas barrier compounds of the barrier material may comprise, consist essentially of one, or consist of one or more gas barrier polymers. The barrier material may be a thermoplastic material, meaning that the polymeric component of the barrier material consists of one or more thermoplastic polymers, optionally including thermoplastic polymers which are not gas barrier polymers. The barrier material may comprise, consist essentially of, or consist of one or more thermoplastic gas barrier polymers. The barrier material comprises a gas barrier polymer component consisting of all gas barrier polymers present in the barrier material. The gas barrier polymer component of the barrier material may consist of one or more gas barrier polymer of a single class of polymers such as, for example, one or more polyolefins. The gas barrier polymer component may consist of gas barrier polymers having similar or the same chemical structures, such as one or more ethylene-vinyl alcohol copolymers. Optionally, the barrier material may further comprise one or more non-polymeric additives, such as one or more fillers, processing aids, colorants, or any combination thereof; or one or more non-polymeric barrier compounds, such as one or more inorganic barrier compounds. Many gas barrier polymers are known in the art. Examples of gas barrier polymers include vinyl polymers such as vinylidene chloride polymers, acrylic polymers such as acrylonitrile polymers, polyamides, epoxy polymers, amine polymers, polyolefins such as polyethylenes and polypropylenes, copolymers thereof, such as ethylene-vinyl alcohol copolymers, and mixtures thereof. When the barrier material comprises, consists essentially of, or consists of one or more gas barrier polymers, the one or more gas barrier polymers may be chosen from a vinyl polymer, an acrylic polymer, an amide polymer, an imide polymer, an epoxy polymer, an olefin polymer, any homopolymer thereof, any copolymer thereof, and any mixture thereof. The one or more gas barrier polymer may comprise, consist essentially of, or consist of one or more thermoplastic gas barrier polymers. Examples of thermoplastic gas barrier polymers include thermoplastic vinyl homopolymers and copolymers, thermoplastic acrylic homopolymers and copolymers, thermoplastic amine homopolymers and copolymers, thermoplastic polyolefin homopolymers and copolymers, and mixtures thereof. The one or more gas barrier polymers may comprise, consist essentially of, or consist of one or more thermoplastic polyethylene copolymers. The one or more gas barrier polymers may comprise, consist essentially of, or consist of one or more thermoplastic ethylene-vinyl alcohol copolymers. The thermoplastic ethylene-vinyl alcohol copolymer may be an ethylene-vinyl alcohol copolymer having from about 28 mole percent to about 44 mole percent ethylene content, or from about 32 mole percent to about 44 mole percent ethylene content. The one or more gas barrier polymers may comprise, consist essentially of, or consist of one or more one or more polyethyleneimine, polyacrylic acid, polyethyleneoxide, polyacrylamide, polyamidoamine, or any combination thereof.

The barrier material (including a first barrier material, a second barrier material, etc.) may have a low gas transmittance rate. For example, when formed into a single-layer film consisting essentially of the barrier material, the single-layer film may have a low gas transmittance rate of less than 4 cubic centimeters per square meter per atmosphere per day per day for a film having a thickness of from about 72 micrometers to about 320 micrometers, as measured at 23 degrees Celsius and 0 percent relative humidity, and may be measured using ASTM D1434. The barrier material may comprise, consists essentially of, or consist of one or more gas barrier compounds. The one or more gas barrier compounds may comprise, consist essentially of, or consist of one or more gas barrier polymers, or may comprise one or more non-polymeric gas barrier compounds, including one or more inorganic gas barrier compounds. The barrier material may comprise, consist essentially of, or consist of a combination of at least one gas barrier polymer and at least one inorganic gas barrier compound. The combination of at least one gas barrier polymer and at least one inorganic gas barrier compound may comprise a blend or mixture, or may comprise a composite in which fibers, particles, or platelets of the inorganic gas barrier compound are surrounded by the gas barrier polymer.

The cushioning elements disclosed herein may comprise or consist of a barrier film comprising one or more barrier materials. The barrier film may be a thermoformed, welded or molded barrier film. The barrier film may be thermoformed, welded or molded into the shape of a portion of a cushioning element or into an entire cushioning element, or into the shape of a portion of a web or into an entire web, or both into the shape of a portion of a cushioning element or an entire cushioning element and into the shape of a portion of a web or an entire web of a cushioning element. The barrier film comprises a barrier material as described herein. The barrier material of the barrier film may comprise, consist essentially of, or consist of a polymeric gas barrier compound (i.e., a gas barrier polymer); or the barrier material of the barrier film may comprise, consist essentially of, or consist of a non-polymeric gas barrier compound; or the barrier material of the barrier film may comprise, consist essentially of, or consist of or a mixture of a polymeric gas barrier compound and a non-polymeric gas barrier compound. The barrier film may have a gas transmission rate as described above. When used alone or in combination with other materials in a cushioning element, the barrier film resiliently retains the fluid. Depending upon the structure and use of the cushioning element, the barrier film may retain the fluid at a pressure which is above, at, or below atmospheric pressure. The fluid may be a liquid or a gas, such as air, oxygen gas, or nitrogen gas. The barrier film may comprise a polymeric barrier material which is a nitrogen gas barrier material having a nitrogen gas transmission rate as described above.

Depending upon the gas barrier compounds used and the intended use of the multi-layered film, the second material may have a higher gas transmittance rate than the barrier material, meaning that the second material is a poorer gas barrier than the barrier material. The one or more second layers may act as substrates for the one or more barrier layers, and may serve to increase the strength, elasticity, and/or durability of the multi-layered film. The one or more second layers may serve to decrease the amount of gas barrier material(s) needed, thereby reducing the overall material cost. Even when the second material has a relatively high gas transmittance rate, the presence of the one or more second layers, particularly when the one or more second layers are positioned between one or more barrier layers, may help maintain the overall barrier properties of the film by increasing the distance between cracks in the barrier layers, thereby increasing the distance gas molecules must travel between cracks in the barrier layers in order to pass through the multi-layered film. While small fractures or cracks in the barrier layers of a multi-layered film may not significantly impact the overall barrier properties of the film, using a larger number of thinner barrier layers may avoid or reduce visible cracking, crazing, or hazing of the multi-layered film. The one or more second layers may include, but are not limited to, a tie layer located between and promoting adhesion between two different layers of the multi-layered film, a structural layer providing mechanical support to the multi-layered film, a bonding layer including a bonding material such as a hot melt adhesive material, on an exterior surface of the multi-layered film, a cap layer providing protection to an exterior surface of the multi-layered film, and any combination thereof.

The second material may be an elastomeric material comprising, consisting essentially of, or consist of one or more elastomers. The one or more elastomers may consist of one or more thermoplastic elastomers. Many gas barrier compounds (including gas barrier polymers) are brittle and/or relatively inflexible, and so the one or more barrier layers may be susceptible to cracking when subjected to repeated, excessive stress loads, such as those potentially generated during when a multi-layered film is exposed to repeated flexing and releasing cycles. A multi-layered film which includes one or more barrier layers alternating with second layers, wherein the second layers consist of one or more elastomeric materials, may produce a multi-layered film which is better able to withstand repeated flexing and releasing cycles while maintaining its gas barrier properties, as compared to a film comprising the same materials except without the elastomeric second layers.

The second material may comprise, consist essentially of, or consist of one or more polymers. As used herein, the one or more polymers present in the second material are referred to as "second polymers" or a "second polymer", as these polymers are present in the second material. References to "second polymer(s)" are not intended to indicate that a "first polymer" necessarily is present, either in the second material, or in the multi-layered film as a whole, although multiple polymers may be present. The second material may comprise, consist essentially of, or consist of one or more thermoplastic polymers. The second material may comprise, consist essentially of, or consist of one or more elastomeric polymers. The second material may comprise, consist essentially of, or consist of one or more thermoplastic elastomers. The second material may include a polymeric component consisting of all polymers present in the second material. The polymeric component of the second material may comprise, consist essentially of, or consist of one or more elastomers, such as one or more thermoplastic elastomers. Alternatively, the polymeric component may comprise, consist essentially of, or consist of one or more thermoset elastomers, or thermosetting elastomers which react to become thermoset in the finished cushioning element. Examples of thermoset and thermosetting elastomers include natural and synthetic rubbers such as a butadiene rubber, an isoprene rubber, a silicone rubber, and the like. Optionally, the second material may further comprise one or more non-polymeric additives, such as fillers, processing aids, and/or colorants. Many polymers which are suitable for use in the second material are known in the art. Exemplary polymers which may be included in the second material (e.g., second polymers) include a polymer chosen from a polyolefin, a polyamide, a polyimide, a polycarbonate, a polyester, a polyether, a polyacrylate, a polystyrene, a polyvinyl, a polyurea, a polyurethane, a polysilane, a polysiloxane, any copolymer thereof, and any mixture thereof. The one or more second polymers of the second material may comprise, consist essentially of, or consist of a polymer chosen from a polyolefin, a polyamide, a polyester, a polystyrene, and a polyurethane.

The second material may comprise one or more polyolefin. The polymeric component of the second material may comprise, consist essentially of, or consist of one or more polyolefin, including a thermoplastic polyolefin, for example a thermoplastic polyolefin elastomer. Polyolefins are a class of polymers which include monomeric units derived from simple alkenes, such as ethylene, propylene, and butene. The one or more polyolefin may be a polyolefin homopolymer, a polyolefin copolymer, or any mixture thereof. Examples of polyolefins include ethylene homopolymers, propylene homopolymers, propylene copolymers (including polyethylene-polypropylene copolymers), polybutene, ethylene-octene copolymers, olefin block copolymers, propylene-butane copolymers, and combinations thereof, including blends of ethylene homopolymers and propylene homopolymers. Ethylene-vinyl acetate (EVA) is an example of an ethylene copolymer. Examples of polyolefin elastomers include polyisobutylene elastomers, poly (alpha-olefin) elastomers, ethylene propylene elastomers, ethylene propylene diene monomer elastomers, and combinations thereof.

The second material may comprise one or more polyamide. The polymeric component of the second material may comprise, consist essentially of, or consist of one or more polyamide, including a thermoplastic polyamide, for example a thermoplastic polyamide elastomer. Polyamides are a class of polymers which include monomeric units linked by amide bonds. Naturally-occurring polyamides include proteins such as wool and silk, while synthetic amides include polymers such as nylons and aramids. The one or more second polymers may include thermoplastic polyamides such as nylon 6, nylon 6-6, and/or nylon-11, as well as thermoplastic amide copolymers and thermoplastic amide copolymer elastomers, such as a polyether block amide (PEBA) copolymer.

The second material may comprise one or more polyester. The polymeric component of the second material may comprise, consist essentially of, or consist of one or more polyester, including a thermoplastic polyester, for example a thermoplastic polyester elastomer. Polyesters are a class of polymers which include monomeric units derived from an ester functional group, and are commonly made by condensing dibasic acids such as, for example, terephthalic acid, with one or more polyols. The one or more polyesters may include polyesters such as polyethylene terephthalate (PET), polybutylene terephthalate (PBT), and poly-1,4-cyclohexylene-dimethylene terephthalate, as well as copolymers such as polyester-ether copolymers and polyester-polyurethane copolymers.

The second material may comprise one or more polystyrene. The polymeric component of the second material may comprise, consist essentially of, or consist of one or more polystyrene, including a thermoplastic polystyrene, for example a thermoplastic polystyrene elastomer. Polystyrenes are a class of polymers which include monomeric units derived from styrene. The one or more polymers may include a polystyrene homopolymer, a styrenic random copolymer, a styrenic block copolymer, such as a acrylonitrile-butadiene-styrene (ABS) block copolymer, a styrene acrylonitrile block copolymer, a styrene-ethylene-butylene-styrene (SEBS) block copolymer, a styrene-butadiene-styrene (SBS) block copolymer, a styrene-ethylene-propylene-styrene (SEPS) block copolymer, or a mixture thereof.

The second material may comprise one or more polyurethane. The polymeric component of the second material may comprise, consist essentially of, or consist of one or more polyurethane, including a thermoplastic polyurethane (often referred to as a thermoplastic polyurethane (TPU), for example a thermoplastic polyurethane elastomer. Polyurethanes are a class of polymers which include monomeric units joined by carbamate linkages. Polyurethanes are commonly formed by reacting a polyisocyanate (e.g., a diisocyanate or a triisocyanate) with a polyol (e.g., a diol or triol), optionally in the presence of a chain extender. The monomeric units derived from the polyisocyanate are often referred to as the hard segments of the polyurethane, while the monomeric units derived from the polyols are often referred to as the soft segments of the polyurethane. The hard segments may be derived from aliphatic polyisocyanates, or from organic isocyanates, or from a mixture of both.

The soft segments may be derived from saturated polyols, or from unsaturated polyols such as polydiene polyols, or from a mixture of both. When the second material is to be bonded to natural or synthetic rubber, the presence of soft segments derived from one or more polydiene polyols may facilitate bonding between the rubber and the second material when the rubber and the second material are crosslinked in contact with each other, such as in a vulcanization process. Examples of suitable polyisocyanates from which the hard segments of the polyurethane may be derived include hexamethylene diisocyanate (HDI), isophorone diisocyanate (IPDI), butylenediisocyanate (BDI), bisisocyanatocyclohexylmethane (HMDI), 2,2,4-trimethylhexamethylene diisocyanate (TMDI), bisisocyanatomethylcyclohexane, bisisochanatomethyltricyclodecane, norbornane diisocyanate (NDI), cyclohexane diisocyanate (CHDI), 4,4'-dicyclohexhylmethane diisocyanate (H12MDI), diisocyanatododecane, lysine diisocyanate, toluene diisocyanate (TDI), TDI adducts with trimethylolpropane (TMP), methylene diphenyl diisocyanate (MDI), xylylene diisocyanate (XDI), tetramethylxylylene diisocyanate (TMXDI), hydrogenated xylylene diisocyanate (HXDI), naphthalene 1,5-diisocyanate (NDI), 1,5-tetrahydronaphthalene diisocyanate, paraphenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and any combination thereof. In one aspect, the polyurethane comprises or consists essentially of hard segments derived from toluene diisocyanate (TDI), or from methylene diphenyl diisocyanate (MDI), or from both. The soft segments of the polyurethane may be derived from a wide variety of polyols, including polyester polyols, polyether polyols, polyester-ether polyols, polycarbonate polyols, polycaprolactone polyethers, and combinations thereof. The polyurethane may comprise, consist essentially of, or consist of monomeric units derived from $C_4$-$C_{12}$ polyols, or $C_6$-$C_{10}$ polyols, or $C_8$ or lower polyols, meaning polyols with 4 to 12 carbon molecules, or with 6 to 10 carbon molecules, or with 8 or fewer carbon molecules in their chemical structures. The polyurethane may comprise, consist essentially of, or consist of monomeric units derived from polyester polyols, polyester-ether polyols, polyether polyols, or any combination thereof. In yet another aspect, the polyurethane comprises or consists essentially of soft segments derived from polyols or diols having polyester functional units. The soft segments derived from polyols or diols having polyester functional units may comprise about 10 to about 50, or about 20 to about 40, or about 30 weight percent of the soft segments present in the polyurethane. The one or more polymers may include a urethane copolymer. Examples of urethane copolymers include polyester-polyurethane copolymers, including polyester-polyurthane elastomers.

The multi-layered film may be produced by various means such as co-extrusion, lamination, layer-by-layer deposition, or the like. When co-extruding one or more barrier layers alone or with one or more second layers, selecting materials (e.g., a first barrier material and a second barrier material, or a single barrier material and a second material) having similar processing characteristics such as melt temperature and melt flow index, may reduce interlayer shear during the extrusion process, and may allow the alternating barrier layers and second layers to be co-extruded while retaining their structural integrities and desired layer thicknesses. In one example, the one or more barrier materials and, optionally, the second material when used, may be extruded into separate individual films, which may then be laminated together to form the multi-layered film.

The multi-layered film may be produced using a layer-by-layer deposition process. A substrate, which optionally may comprise a second material or a barrier material, may be built into a multi-layered film by depositing a plurality of layers onto the substrate. The layers may include one or more barrier layers (e.g., first barrier layers, second barrier layers, etc.). Optionally, the layers may include one or more second layers. The one or more barrier layers and/or second layers may be deposited by any means known in the art such as, for example, dipping, spraying, coating, or another method. The one or more barrier layers may be applied using charged solutions or suspensions, e.g., cationic solutions or suspensions or anionic solutions or suspensions, including a charged polymer solution or suspension. The one or more barrier layers may be applied using a series of two or more solutions having opposite charges, e.g., by applying a cationic solution, followed by an anionic solution, followed by a cationic solution, followed by an anionic solution, etc.

The barrier films, including the multi-layered film, may have an overall thickness of from about 40 micrometers to about 500 micrometers, or about 50 micrometers to about 400 micrometers, or about 60 micrometers to about 350 micrometers. Each individual layer of the plurality of layers of the multi-layered film may have a thickness of from about 0.001 micrometers to about 10 micrometers. The thickness of an individual barrier layer may range from about 0.001 micrometers to about 3 micrometers thick, or from about 0.5 micrometers to about 2 micrometers thick, or from about 0.5 micrometers to about 1 micrometer thick. The thickness of an individual second layer may range from about 2 micrometers to about 8 micrometers thick, or from about 2 micrometers to about 4 micrometers thick. The thickness of the film and/or their individual layers may be measured by any method known in the art such as, for example, ASTM E252, ASTM D6988, ASTM D8136, or using light microscopy or electron microscopy.

The barrier material, including the multi-layered film comprising the barrier material, may have a Shore hardness of from about 35 A to about 95 A, optionally from about 55 A to about 90 A. In these aspects, hardness may be measured using ASTM DO using the Shore A scale.

When a co-extrusion process is used to form the barrier film from a plurality of alternating barrier layers and second layers, the barrier material may have a melt flow index of from about 5 to about 7 grams per 10 minutes at 190 degrees Celsius when using a weight of 2.16 kilograms, while the second material may have a melt flow index of from about 20 to about 30 grams per 10 minutes at 190 degrees Celsius when using a weight of 2.16 kilograms. The melt flow index of the barrier material may be from about 80 percent to about 120 percent of the melt flow index of the second material per 10 minutes when measured at 190 degrees Celsius when using a weight of 2.16 kilograms. The melt flow index may be measured using ASTM D1238. The barrier material or the second material or both may have a melting temperature of from about 165 degrees Celsius to about 183 degrees Celsius, or from about 155 degrees Celsius to about 165 degrees Celsius. The barrier material may have a melting temperature of from about 165 degrees Celsius to about 183 degrees Celsius, while the second material may have a melting temperature of from about 155 degrees Celsius to about 165 degrees Celsius. The melting temperature may be measured using ASTM D3418.

In an alternative example, instead of being a fluid-filled bladder, the cushioning element comprises a material, such as a foam or an unfoamed solid, to impart properties of cushioning, responsiveness, and energy distribution to the foot of the wearer. The cushioning element may comprise a foam. The foam may comprise a material. Example materials for the alternate cushioning element may include those based on foaming or molding material, e.g. a resilient material, comprising one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In addition to one or more barrier materials, the sole structures described herein may comprise one or more additional polymeric materials. A polymeric material is understood to comprise, consist essentially of, or consist of one or more polymers. In addition to a cushioning element, the sole structures may include additional elements such as support elements, and the support elements may be made using one or more additional materials. Also, in addition to a barrier material, a cushioning element may be made using one or more additional materials, such as a second material as described above.

The additional material may be an elastomeric material comprising, consisting essentially of, or consist of one or more elastomers. The one or more elastomers may consist of one or more thermoplastic elastomers. The additional material may comprise, consist essentially of, or consist of one or more thermoplastic polymers. The additional material may comprise, consist essentially of, or consist of one or more elastomeric polymers. The additional material may comprise, consist essentially of, or consist of one or more thermoplastic elastomers. The additional material may include a polymeric component consisting of all polymers present in the additional material. The polymeric component of the additional material may comprise, consist essentially of, or consist of one or more elastomers, such as one or more thermoplastic elastomers. Alternatively, the polymeric component may comprise, consist essentially of, or consist of one or more thermoset elastomers, or thermosetting elastomers which react to become a thermoset in the finished sole structure. Examples of thermoset and thermosetting elastomers include natural and synthetic rubbers such as a butadiene rubber, an isoprene rubber, a silicone rubber, and the like. Optionally, the additional material may further comprise one or more non-polymeric additives, such as fillers, processing aids, and/or colorants. The additional material may comprise, consist essentially of, or consist of one or more polymers chosen from a polyolefin, a polyamide, a polyimide, a polycarbonate, a polyester, a polyether, a polyacrylate, a polystyrene, a polyvinyl, a polyurea, a polyurethane, a polysilane, a polysiloxane, any copolymer thereof, and any mixture thereof. The one or more polymers of the additional material may comprise, consist essentially of, or consist of a polymer chosen from a polyolefin, a polyamide, a polyester, a polystyrene, and a polyurethane. The additional material may comprise one or more polyolefins. The polymeric component of the additional material may comprise, consist essentially of, or consist of one or more polyolefin, including a thermoplastic polyolefin, for example a thermoplastic polyolefin elastomer. The polyolefin may be an olefin homopolymer or copolymer as described above with respect to second materials. The one or more polyolefin may comprise, consist essentially of, or consist of an EVA copolymer, including a crosslinked EVA copolymer. The additional material may comprise one or more polyamide. The polymeric component of the additional material may comprise, consist essentially of, or consist of one or more polyamide, including a thermoplastic polyamide, for example a thermoplastic polyamide elastomer. The polyamide may be an amide homopolymer or copolymer as described above with respect to second materials. The one or more polyamide may comprise, consist essentially of, or consist of a PEBA copolymer. The additional material may comprise one or more polyester. The polymeric component of the additional material may comprise, consist essentially of, or consist of one or more polyester, including a thermoplastic polyester, for example a thermoplastic polyester elastomer. The polyester may be a polyester homopolymer or copolymer as described above with respect to second materials. The additional material may comprise one or more polystyrene. The polymeric component of the additional material may comprise, consist essentially of, or consist of one or more polystyrene, including a thermoplastic polystyrene, for example a thermoplastic polystyrene elastomer. The one or more polystyrene may be a polystyrene homopolymer or copolymer as described above with respect to second polymers. The one or more polystyrene may comprise, consist essentially of, or consist of a SEBS copolymer. The additional material may comprise one or more polyurethane. The polymeric component of the additional material may comprise, consist essentially of, or consist of one or more polyurethane, including a TPU, such as a TPU elastomer. One example of a polyurethane copolymer is a polyester-polyurethane copolymer, including a polyester-polyurethane elastomer. The one or more polyurethane may be a polyurethane as described above with respect to second polymers.

Optionally, when the resilient material is a foam, the foam may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both. Examples of foamed polymeric materials commonly used in footwear include a foamed polymeric material comprising a polyurethane (PU) or a foamed polymeric material comprising an ethylene-vinyl acetate copolymer (EVA). A solid polymeric support material is also contemplated. Examples of solid polymeric materials commonly used in footwear include solid elastomeric materials, including a solid elastomeric material comprising a polyurethane elastomer or comprising a polyamide elastomer.

The compression molding process desirably starts by forming one or more foam preforms, such as by injection molding and foaming a material, e.g. a resilient material, by forming foamed particles or beads, by cutting foamed sheet stock, and the like. The compression molded foam may then be made by placing the one or more foam preforms in a compression mold, and applying sufficient pressure to the one or more preforms to compress the one or more foam preforms in a closed mold. Once the mold is closed, sufficient heat and/or pressure is applied to the one or more foam preforms in the closed mold for a sufficient duration of time to alter the foam preform(s), to form a skin on the outer surface of the compression molded foam, or to fuse individual foam particles to each other, to permanently or semi-permanently increase the density of the foam(s), or any combination thereof. Following the heating and/or application of pressure, the mold is opened and the molded foam article is removed from the mold.

In another example, the resilient material is an unfoamed solid. The material may be shaped using a molding process, including an injection molding process. In one example, when the material is an elastomeric material, the elastomeric material (e.g., uncured rubber) may be mixed in a Banbury mixer with an optional filler and a curing package such as, for example, a UV curing package or a thermal curing package including a sulfur-based or peroxide-based curing package, calendared, formed into shape, placed in a mold, and cured (e.g., using a UV curing process or a thermal curing process such as a vulcanization process).

The following clauses provide an exemplary configuration for an article of footwear and sole structure described above.

Clause 1. An article of footwear comprising: an anterior end and a posterior end opposite the anterior end; an upper including an interior void partially defined by a ground-facing surface, wherein the ground-facing surface includes a plurality of supports; a sole including a first surface facing the interior void and a second, ground-facing, surface, the sole disposed within the interior void of the upper, wherein the sole includes one or more extensions extending from the second surface, wherein each of the one or more extensions is received by a respective one of the plurality of supports; and a cushioning element extending from the posterior end toward the anterior end, the cushioning element including a first surface facing the upper and a second, ground-facing surface, wherein the one or more supports and one or more extensions engage the first surface of the cushioning element.

Clause 2. The article of footwear of Clause 1, wherein the cushioning element includes a fluid-filled bladder.

Clause 3. The article of footwear of Clause 1, wherein the upper is comprised of a knitted material.

Clause 4. The article of footwear of Clause 1, wherein the upper is directly attached to the cushioning element.

Clause 5. The article of footwear of Clause 1, wherein the sole is removably disposed within the upper.

Clause 6. The article of footwear of Clause 5, wherein the sole includes one or more depressions disposed on a ground facing surface of a respective extension of the one or more extensions.

Clause 7. The article of footwear of Clause 6, wherein the one or more extensions and the cushioning element transfer a force between one another, through the upper.

Clause 8. The article of footwear of Clause 1, an outsole layer is coupled to the second surface of the cushioning element, the outsole layer forming a ground engaging surface of the article of footwear.

Clause 9. The article of footwear of Clause 1, wherein the article of footwear further includes: a heel region, a forefoot region, and a midfoot region disposed between the heel region and the forefoot region; and a first set of bulbs extending around an outer periphery of the cushioning element, and a second set of bulbs extending between respective bulbs of the first set of bulbs, wherein the first set of bulbs extend from the posterior end to the anterior end, and wherein one or more of the first set of bulbs are disposed in one or more of the forefoot region, the midfoot region, or the heel region, wherein an opening extends between adjacent bridge portions of the one or more bridge portions and adjacent bulbs of the first set of bulbs and second set of bulbs connected by the one or more bridge portions.

Clause 10. The article of footwear of Clause 9, wherein the opening is circumferentially enclosed.

Clause 11. The article of footwear of Clause 9, wherein the opening is partially enclosed by either one or both of the one or more bridge portions, the first set of bulbs, and the second set of bulbs.

Clause 12. The article of footwear of Clause 1, wherein only the upper directly contacts the cushioning element.

Clause 13. The article of footwear of Clause 1, wherein the sole has a first thickness, the cushioning element has a second thickness, and the upper has a third thickness, the third thickness being less than the first thickness and the second thickness.

Clause 14. The article of footwear of Clause 1, wherein a gap that is open to the external environment is formed between the upper and a respective bridge portion.

Clause 15. The article of footwear of Clause 1, wherein an outsole layer is coupled to the second surface of the cushioning element, the outsole layer forming a ground engaging surface of the article of footwear.

Clause 16. A sole structure for an article of footwear comprising:

a cushioning element extending from a posterior end to an anterior end, the cushioning element including a first set of openings and a plurality of bulbs, wherein the plurality of bulbs extend around an entirety of an outer surface of the cushioning element; and an outsole layer coupled to the cushioning element.

Clause 17. An article of footwear including an upper coupled directly to the sole structure of Clause 16.

Clause 18. An article of footwear comprising: an upper including an interior void, the upper comprised of a first material; a sole disposed within the interior void of the upper, the sole formed of a second material different from the first material; and a cushioning element formed of a third material different from the first material and the second material, the cushioning element including a first surface facing the upper and a second, ground-facing surface, wherein the upper is directly attached to the cushioning element.

Clause 19. The article of footwear of Clause 18, wherein the cushioning element includes one or more openings disposed between a plurality of bulbs.

Clause 20. The article of footwear of Clause 19, wherein the one or more openings are areas of the cushioning element devoid of material between respective bulbs of the plurality of bulbs.

Clause 21. The article of footwear of Clause 18, wherein the cushioning element is a fluid-filled bladder.

Clause 22. The article of footwear of Clause 18, wherein the cushioning element is wet cement bonded to the upper.

Clause 23. The article of footwear of Clause 18, wherein the cushioning element is thermobonded to the upper.

Clause 24. An article of footwear comprising: a medial side and a lateral side opposite the medial side; a posterior end and an anterior end opposite the posterior end; an upper extending from the posterior end to the anterior end including an interior void; a sole disposed within the interior void of the upper; and a cushioning element including a first surface facing the upper and a second, ground-facing, surface, the cushioning element including a first plurality of bulbs disposed on the medial side and a second plurality of bulbs disposed on the lateral side, wherein each of the first plurality of bulbs extend radially outward of a radially outermost surface of the upper on the medial side and wherein each of the second plurality of bulbs extend radially outward of a radially outermost surface of the upper on the lateral side.

Clause 25. The article of footwear of Clause 24, wherein the cushioning element is a fluid-filled bladder.

Clause 26. An article of footwear comprising: an upper including an interior void, wherein the upper includes one or more supports, and wherein a plurality of ridges are disposed between adjacent ones of the one or more supports; a sole disposed within the interior void of the upper, wherein the sole includes one or more extensions configured to couple with the one or more supports; and a cushioning element extending from a posterior end of the article of footwear to an anterior end of the article of footwear, the cushioning element including a first set of bulbs and a second set of bulbs, wherein the combination of the one or more supports and one or more extensions engage the first set of bulbs, wherein a gap that is open to the external environment is disposed between the plurality of ridges and the cushioning element, the gap defined at a bottom end by an exposed first surface of the cushioning element and the gap defined at a top end by the plurality of ridges of the upper.

Clause 27. The article of footwear of Clause 26, wherein the plurality of ridges includes a gap extending from a medial side of the upper to a lateral side of the upper such that a fluid flows unobstructed through the gap.

Clause 28. The article of footwear of Clause 26, wherein each bulb of the first set of bulbs and the second set of bulbs is interconnected.

Clause 29. The article of footwear of Clause 26, wherein the first set of bulbs are disposed in each of a heel region of the article of footwear, a portion of a midfoot region of the article of footwear, and a forefoot region of the article of footwear.

Clause 30. The article of footwear of Clause 29, wherein the second set of bulbs are disposed exclusively in the midfoot region of the article of footwear.

Clause 31. A sole structure for an article of footwear comprising: a cushioning element extending from a posterior end to an anterior end, the cushioning element including a plurality of bulbs, a first enclosed opening, a second partially enclosed opening, wherein the second partially enclosed openings include a mouth.

Clause 32. An article of footwear including an upper coupled directly to the sole structure of Clause 31.

Clause 33. The sole structure of Clause 31, wherein the mouth exposes inner portions of the second partially enclosed opening to the external environment.

Clause 34. A sole for an article of footwear comprising: a first surface and a second surface opposite the first surface; a posterior portion including one or more extensions extending from the first surface, wherein each of the one or more extensions include a pocket; a midfoot portion; and an anterior portion including a first engagement zone and a second engagement zone, wherein the first engagement zone includes a first depression surrounding a first plateau and a second plateau, and wherein the second engagement zone includes a second depression.

Clause 35. The sole of Clause 34, wherein the sole does not include any features that are permanently attached to the article of footwear.

Clause 36. An article of footwear including the sole of Clause 34.

Clause 37. An article of footwear comprising: an upper including an interior void; and a fluid-filled bladder having a top surface that is directly attached to the upper.

Clause 38. An article of footwear comprising: an upper including an interior void; and a cushioning element having a top surface coupled to the upper, wherein the top surface includes a plurality of exposed portions that are open to the environment exterior of the article of footwear.

Clause 39. An article of footwear comprising: an upper including an interior void; a sole disposed within the interior void of the upper; a cushioning element, the cushioning element including a first surface facing the upper and a second, ground-facing surface, wherein a portion of the upper is directly attached to the first surface of the cushioning element; and an outsole layer coupled to the second surface of the cushioning element, wherein along a first path through the article of footwear, the article of footwear includes the outsole layer, the cushioning element, the upper, and the sole, and wherein along a second path, the article of footwear includes the outsole layer, the cushioning element, a gap that is open to the external environment, the upper, and the sole.

Clause 40. An article of footwear comprising: a posterior end; an anterior end opposite the posterior end; an upper including an interior void; a sole disposed within the interior void of the upper; an outsole extending from the anterior end to the posterior end, the outsole including a first surface facing the upper, a second surface facing a ground surface, a toe portion, and a heel cap; and a cushioning element, the cushioning element including a first surface facing the upper and a second, ground-facing surface attached to the outsole, wherein a portion of the upper is directly attached to the first surface of the cushioning element.

Clause 41. The article of footwear of Clause 40, further comprising a toe cap, wherein the toe cap is disposed between the upper and the outsole.

Clause 42. The article of footwear of Clause 40, wherein the cushioning element comprises: a first set of bulbs extending around an outer periphery of the cushioning element, wherein the first set of bulbs extend from the posterior end to the anterior end.

Clause 43. The article of footwear of Clause 42, wherein the cushioning element further comprises a plurality of enclosed openings.

Clause 44. The article of footwear of Clause 40, wherein the cushioning element is a fluid-filled bladder.

Clause 45. The article of footwear of Clause 40, wherein the outsole includes a plurality of raised portions and a plurality of openings.

Clause 46. The article of footwear of Clause 45, wherein the plurality of raised portions are disposed on the first surface.

Clause 47. The article of footwear of Clause 40, wherein the outsole further comprises a plurality of lugs.

Clause 48. The article of footwear of Clause 47, wherein the plurality of lugs are disposed on the second surface.

Clause 49. The article of footwear of Clause 48, wherein each of the plurality of lugs include a ground-engaging face, and wherein the face of each of the plurality of lugs is disposed in a plane that is offset from a plane of the second surface.

Clause 50. An article of footwear comprising: a medial side and a lateral side opposite the medial side; a posterior end and an anterior end opposite the posterior end; an upper extending from the posterior end to the anterior end; a sole coupled to the upper; and a cushioning element including a first surface facing the upper and a second, ground-facing, surface, the cushioning element including a first plurality of bulbs disposed on the medial side and a second plurality of bulbs disposed on the lateral side, wherein each of the first plurality of bulbs extend radially outward of a radially outermost surface of the upper on the medial side and wherein each of the second plurality of bulbs extend radially outward of a radially outermost surface of the upper on the lateral side.

Clause 51. The article of footwear of Clause 50, wherein the cushioning element is a fluid-filled bladder.

Clause 52. An article of footwear comprising: an upper extending from a posterior end of the article of footwear to an anterior end of the article of footwear; a sole coupled to the upper, wherein the sole includes one or more flanges; and a cushioning element extending from the posterior end of the article of footwear to the anterior end of the article of footwear, the cushioning element including a first set of bulbs and a second set of bulbs, wherein the flanges extend over the first set of bulbs and the second set of bulbs, wherein a gap that is open to the external environment is disposed between the one or more flanges and the cushioning element, the gap defined at a bottom end by an exposed first surface of the cushioning element and the gap defined at a top end by the one or more flanges.

Clause 53. The article of footwear of Clause 52, wherein each bulb of the first set of bulbs and the second set of bulbs is interconnected.

Clause 54. The article of footwear of Clause 52, wherein the first set of bulbs are disposed in each of a heel region of the article of footwear, a portion of a midfoot region of the article of footwear, and a forefoot region of the article of footwear.

Clause 55. The article of footwear of Clause 52, wherein the second set of bulbs are disposed exclusively in the midfoot region of the article of footwear.

Clause 56. The sole of Clause 34, wherein the midfoot portion is free of extensions.

Clause 57. The sole of Clause 34, wherein the midfoot portion includes one or more extensions extending from the first surface.

Clause 58. The sole of Clause 34, wherein the second surface includes one or more textured elements.

Clause 59. A sole, comprised of a first material, for an article of footwear comprising: a first surface extending from a first end to a second end opposite the first end; one or more extensions extending from the first surface; one or more engagement zones disposed within the first surface; a second surface extending from the first end to the second end, the second surface disposed opposite the first surface; and a sidewall circumscribing the second surface.

Clause 60. The sole of Clause 59, wherein the sidewall includes a notch disposed at the second end, a first protrusion disposed at the second end, and a second protrusion disposed at the second end.

Clause 61. The sole of Clause 60, wherein the notch is disposed between the first protrusion and the second protrusion.

Clause 62. The sole of Clause 59, wherein the first material is a polymer foam material.

Clause 63. The sole of Clause 59, wherein the sole is disposed within an upper of the article of footwear, and wherein the upper is comprised of a second material different from the first material of the sole.

Clause 64. The sole of Clause 63, wherein the sole does not include any features that are permanently attached to the upper.

Clause 65. The sole of Clause 63, wherein the upper is directly attached to a cushioning element comprised of a third material, the third material different from the first material and the second material.

Clause 66. The sole of Clause 65, wherein the cushioning element includes one or more bulbs, and wherein the one or more extensions are configured to engage the one or more bulbs.

Clause 67. The article of footwear of Clause 50, wherein the sole is coupled to the first surface of the cushioning element.

Clause 68. The article of footwear of Clause 50, wherein the sole is comprised of a foamed material.

Clause 69. The article of footwear of Clause 50, wherein the article of footwear further includes:

an outsole layer including a first surface, coupled to the second surface of the cushioning element, and a second, ground-engaging, surface.

Clause 70. The article of footwear of Clause 69, wherein the second surface of the outsole layer includes one or textured elements and one or more lugs.

We claim:

1. An article of footwear comprising:

an anterior end and a posterior end opposite the anterior end;

an upper including an interior void partially defined by a ground-facing surface;

a sole including a first surface facing the interior void and a second, ground-facing, surface, the sole disposed within the interior void of the upper, wherein the sole includes one or more extensions extending from the second surface, wherein each of the one or more extensions is received by the ground-facing surface of the upper such that the combination of the one or more extensions and the ground-facing surface of the upper form a plurality of supports; and a cushioning element extending from the posterior end toward the anterior end, the cushioning element including a first surface facing the upper and a second, ground-facing surface, wherein the plurality of supports engage the first surface of the cushioning element.

2. The article of footwear of claim 1, wherein the cushioning element includes a fluid-filled bladder.

3. The article of footwear of claim 1, wherein the upper is comprised of a knitted material.

4. The article of footwear of claim 1, wherein the upper is directly attached to the cushioning element.

5. The article of footwear of claim 1, wherein the sole is removably disposed within the upper.

6. The article of footwear of claim 5, wherein the sole includes one or more depressions disposed on a ground facing surface of a respective extension of the one or more extensions.

7. The article of footwear of claim 6, wherein the one or more extensions and the cushioning element transfer a force between one another, through the upper.

8. The article of footwear of claim 1, an outsole layer is coupled to the second surface of the cushioning element, the outsole layer forming a ground engaging surface of the article of footwear.

9. The article of footwear of claim 1, wherein the article of footwear further includes:

a heel region, a forefoot region, and a midfoot region disposed between the heel region and the forefoot region; and a first set of bulbs extending around an outer periphery of the cushioning element, and a second set of bulbs extending between respective bulbs of the first set of bulbs, wherein the first set of bulbs extend from the posterior end to the anterior end, and wherein one or more of the first set of bulbs are disposed in one or more of the forefoot region, the midfoot region, or the heel region, wherein an opening extends between adjacent bridge portions of one or more bridge portions and adjacent bulbs of the first set of bulbs and second set of bulbs connected by the one or more bridge portions.

10. The article of footwear of claim 9, wherein the opening is circumferentially enclosed.

11. The article of footwear of claim 9, wherein the opening is partially enclosed by either one or both of the one or more bridge portions, the first set of bulbs, and the second set of bulbs.

12. The article of footwear of claim 1, wherein only the upper directly contacts the cushioning element.

13. The article of footwear of claim 1, wherein the sole has a first thickness, the cushioning element has a second thickness, and the upper has a third thickness, the third thickness being less than the first thickness and the second thickness.

14. The article of footwear of claim 1, wherein a gap that is open to the external environment is formed between the upper and a respective bridge portion.

15. An article of footwear comprising:

an upper including an interior void;

a sole disposed within the interior void of the upper, wherein the sole includes one or more extensions received by a ground-facing layer of the upper such that the combination of the one or more extensions and the ground-facing layer of the upper is configured to form one or more supports, wherein a plurality of ridges is disposed between adjacent ones of the one or more supports; and a cushioning element extending from a posterior end of the article of footwear to an anterior end of the article of footwear, the cushioning element including a first set of bulbs and a second set of bulbs, wherein the one or more supports engage the first set of bulbs, wherein a gap that is open to the external environment is disposed between the plurality of ridges and the cushioning element, the gap defined at a bottom end by an exposed first surface of the cushioning element and the gap defined at a top end by the plurality of ridges of the upper.

16. The article of footwear of claim 15, wherein the plurality of ridges includes a gap extending from a medial side of the upper to a lateral side of the upper such that a fluid flows unobstructed through the gap.

17. The article of footwear of claim 15, wherein each bulb of the first set of bulbs and the second set of bulbs is interconnected.

* * * * *